US009053696B2

(12) United States Patent
Watanabe et al.

(10) Patent No.: US 9,053,696 B2
(45) Date of Patent: Jun. 9, 2015

(54) SEARCHING FOR A TONE DATA SET BASED ON A DEGREE OF SIMILARITY TO A RHYTHM PATTERN

(75) Inventors: Daichi Watanabe, Hamamatsu (JP); Keita Arimoto, Barcelona (ES)

(73) Assignee: Yamaha Corporation, Hamamatsu-shi (JP)

( * ) Notice: Subject to any disclaimer, the term of this patent is extended or adjusted under 35 U.S.C. 154(b) by 190 days.

(21) Appl. No.: 13/395,433

(22) PCT Filed: Dec. 1, 2011

(86) PCT No.: PCT/JP2011/077839

§ 371 (c)(1),
(2), (4) Date: Apr. 20, 2012

(87) PCT Pub. No.: WO2012/074070

PCT Pub. Date: Jun. 7, 2012

(65) Prior Publication Data

US 2012/0192701 A1 Aug. 2, 2012

(30) Foreign Application Priority Data

Dec. 1, 2010 (JP) ..... 2010-268661
Nov. 30, 2011 (JP) ..... 2011-263088

(51) Int. Cl.
*G10H 1/40* (2006.01)

(52) U.S. Cl.
CPC ..... *G10H 1/40* (2013.01); *G10H 2210/341* (2013.01); *G10H 2210/071* (2013.01); *G10H 2240/141* (2013.01); *G10H 2210/005* (2013.01); *G10H 2210/361* (2013.01)

(58) Field of Classification Search
CPC ..... G10H 1/40; G10H 2210/341; G10H 2240/141; G10H 2210/071
USPC ..... 84/635
See application file for complete search history.

(56) References Cited

U.S. PATENT DOCUMENTS 6,121,530 A 9/2000 Sonoda
7,908,338 B2 3/2011 Ogasawara (Continued)

FOREIGN PATENT DOCUMENTS

DE 699 08 226 T2 3/2004
EP 0 944 033 A1 9/1999

(Continued)

OTHER PUBLICATIONS

International Search Report mailed Mar. 19, 2012, for PCT Patent Application No. PCT/JP2011/077839, two pages.

(Continued)

*Primary Examiner* — Jianchun Qin
(74) *Attorney, Agent, or Firm* — Morrison & Foerster LLP

(57) ABSTRACT

It is an object of the present invention to provide an improved technique for searching for a tone data set of a phrase constructed in a rhythm pattern that satisfies a predetermined condition of similarity to a rhythm pattern intended by a user. The user inputs a rhythm pattern via a rhythm input device. An input rhythm pattern storage section stores the input rhythm pattern into a RAM on the basis of clock signals output from a bar line clock output section and trigger data included in the input rhythm pattern. A rhythm pattern search section searches through a rhythm database for a tone data set presenting the highest degree of similarity to the stored input rhythm pattern. A performance processing section causes a sound output section to audibly output the searched-out tone data set.

13 Claims, 25 Drawing Sheets

(56) References Cited

U.S. PATENT DOCUMENTS

| | | | | |
|---|---|---|---|---|
| 2006/0065105 | A1 | 3/2006 | Iketani et al. | |
| 2009/0036210 | A1 * | 2/2009 | Kotani | 463/36 |

FOREIGN PATENT DOCUMENTS

| | | | | |
|---|---|---|---|---|
| EP | 2 375 407 | A1 | | 10/2011 |
| JP | 8-087297 | A | | 4/1996 |
| JP | 2000-029487 | A | | 1/2000 |
| JP | 2000-187671 | A | | 7/2000 |
| JP | 2002-215632 | A | | 8/2002 |
| JP | 2002215632 | A | * | 8/2002 |
| JP | 2005-227850 | A | | 8/2005 |
| JP | 2005227850 | A | * | 8/2005 |
| JP | 2005-338353 | A | | 12/2005 |

OTHER PUBLICATIONS

CN Office Action issued Jan. 15, 2013, Chinese Patent Application No. 201180003840.8, with English translation, 13 pages.

Chen, J.C.C. et al. (Feb. 23, 1998). "Query by rhythm: An approach for song retrieval in music databases," Proceedings Eighth International Workshop on research issues in data engineering, Continuous-Media Databases and Applications, Department of Computer Science, Hsinchu, Taiwan, eight pages.

European Search Report dated Nov. 3, 2014, for EP Application No. 11822840.2, nine pages.

Hanna, P. et al. (Apr. 19, 2009). "Query by tapping system based on alignment algorithm," Acoustics, Speech and Signal Processing, ICASSP, 2009, IEEE International Conference on, IEEE, Piscataway, NJ, USA, four pages.

* cited by examiner (a)

| MUSICAL INSTRUMENT TYPE ID | MUSICAL INSTRUMENT TYPE |
|---|---|
| 001 | DRUM KIT |
| 002 | CONGA |
| 003 | DJEMBE |
| ⋮ | ⋮ |

(b)

| RHYTHM CATEGORY ID | RHYTHM CATEGORY |
|---|---|
| 01 | EIGHTH |
| 02 | SIXTEENTH |
| 03 | EIGHTH TRIPLET |
| ⋮ | ⋮ |

(c)

| MUSICAL INSTRUMENT TYPE ID | PHRASE ID | RHYTHM CATEGORY ID | RHRASE TONE DATA | RHYTHM PATTERN DATA | ATTACK INTENSITY PATTERN DATA |
|---|---|---|---|---|---|
| 001 | 001 | 01 | Drums1.wav | Drums1.Rhythm.txt | Drums1.AttackPower.txt |
| 001 | 002 | 01 | Drums2.wav | Drums2.Rhythm.txt | Drums2.AttackPower.txt |
| 001 | 003 | 01 | Drums3.wav | Drums3.Rhythm.txt | Drums3.AttackPower.txt |
| 001 | 004 | 02 | Drums4.wav | Drums4.Rhythm.txt | Drums4.AttackPower.txt |
| 001 | 005 | 02 | Drums5.wav | Drums5.Rhythm.txt | Drums5.AttackPower.txt |
| 001 | 006 | 02 | Drums6.wav | Drums6.Rhythm.txt | Drums6.AttackPower.txt |
| 001 | 007 | 02 | Drums7.wav | Drums7.Rhythm.txt | Drums7.AttackPower.txt |
| 001 | 008 | 03 | Drums8.wav | Drums8.Rhythm.txt | Drums8.AttackPower.txt |
| 001 | 009 | 03 | Drums9.wav | Drums9.Rhythm.txt | Drums9.AttackPower.txt |
| 001 | 0010 | 03 | Drums10.wav | Drums10.Rhythm.txt | Drums10.AttackPower.txt |
| ⋮ | ⋮ | ⋮ | ⋮ | ⋮ | ⋮ |

FIG. 3

| PART ID | PART NAME | NOTE NO. | CHANNEL INFO. |
|---|---|---|---|
| 01 | BASS | <=45 | — |
| 02 | CHORD | 46<=&&<=74 | — |
| 03 | PHRASE | 75=< | — |
| 04 | BASS DRUM | — | 12a |
| 05 | SNARE DRUM | — | 12b |
| 06 | HIGH-HAT | — | 12c |
| 07 | CYMBAL | — | 12d |
| ••• | ••• | ••• | ••• |

(b)

| MUSICAL INSTRUMENT TYPE ID | MUSICAL INSTRUMENT TYPE |
|---|---|
| 001 | WOODEN BASS |
| 002 | ELECTRIC BASS |
| 003 | SLAP BASS |
| 004 | PIANO |
| 005 | ORGAN |
| 006 | TENOR SAX |
| ••• | ••• |

(c)

| RHYTHM CATEGORY ID | RHYTHM CATEGORY |
|---|---|
| 01 | EIGHTH |
| 02 | SIXTEENTH |
| 03 | EIGHTH TRIPLET |
| ••• | ••• |

| AUTO. ACCOM. ID | PART ID | MUSICAL INSTRU. TYPE ID | RHYTHM CATEGORY ID | RHYTHM PATTERN ID | RHYTHM PATTERN DATA | ATTACK INTENSITY PATTERN DATA | TONE DATA | KEY | GENRE | BPM | CHORD |
|---|---|---|---|---|---|---|---|---|---|---|---|
| 001 | 03 | 006 | 01 | 030060101 | Bebop TenorSax01 Rhythm.txt | Bebop TenorSax01 Attack.txt | Bebop TenorSax01. wav | A | Swing& Jazz | 145 | – |

| AUTO. ACCOM. ID | PART ID | MUSICAL INSTRU. TYPE | RHYTHM CATEGORY ID | RHYTHM PATTERN ID | RHYTHM PATTERN DATA | ATTACK INTENSITY PATTERN DATA | TONE DATA | KEY | GENRE | BPM | CHORD |
|---|---|---|---|---|---|---|---|---|---|---|---|
| 001 | 02 | 004 | 01 | 020040101 | BebopPiano01 Rhythm.txt | BebopPiano01 Attack.txt | BebopPiano 01.wav | A | Swing& Jazz | 145 | Maj7 |

| AUTO. ACCOM. ID | PART ID | MUSICAL INSTRU. TYPE | RHYTHM CATEGORY ID | RHYTHM PATTERN ID | RHYTHM PATTERN DATA | ATTACK INTENSITY PATTERN DATA | TONE DATA | KEY | GENRE | BPM | CHORD |
|---|---|---|---|---|---|---|---|---|---|---|---|
| 001 | 01 | 001 | 01 | 010010101 | BebopBass01 Rhythm.txt | BebopBass01 Attack.txt | Bebop Base01.wav | A | Swing& Jazz | 120 | – |
| 002 | 01 | 001 | 01 | 010010102 | BebopBass02 Rhythm.txt | BebopBass02 Attack.txt | Bebop Base02.wav | A | Swing& Jazz | 120 | – |
| 003 | 01 | 001 | 01 | 010010103 | BebopBass03 Rhythm.txt | BebopBass03 Attack.txt | Bebop Base03.wav | A | Swing& Jazz | 120 | – |
| 004 | 01 | 001 | 01 | 010010104 | BebopBass04 Rhythm.txt | BebopBass04 Attack.txt | Bebop Base04.wav | A | Swing& Jazz | 120 | – |
| 005 | 01 | 002 | 02 | 010020201 | FreeJazzBass01 Rhythm.txt | FreeJazzBass01 Attack.txt | FreeJazz Base01.wav | E | Swing& Jazz | 140 | – |
| 006 | 01 | 002 | 02 | 010020202 | FreeJazzBass02 Rhythm.txt | FreeJazzBass02 Attack.txt | FreeJazz Base02.wav | E | Swing& Jazz | 140 | – |
| 007 | 01 | 002 | 02 | 010020203 | FreeJazzBass03 Rhythm.txt | FreeJazzBass03 Attack.txt | FreeJazz Base03.wav | E | Swing& Jazz | 140 | – |
| ... | ... | ... | ... | ... | ... | ... | ... | ... | ... | ... | ... |

FIG. 13A

| AUTO. ACCOM. ID | PART ID | MUSICAL INSTRU. TYPE ID | RHYTHM CATEGORY ID | RHYTHM PATTERN ID | RHYTHM PATTERN DATA | ATTACK INTENSITY PATTERN DATA | TONE DATA | KEY | GENRE | BPM | CHORD |
|---|---|---|---|---|---|---|---|---|---|---|---|
| 001 | 99 | 999 | 01 | 999990101 | Bebop01 Rhythm.txt | Bebop01 Attack.txt | Bebop01.wav | A | Swing& Jazz | 120 | – |
| 001 | 001 | 001 | 01 | 010010101 | BebopBass01 Rhythm.txt | BebopBass01 Attack.txt | BebopBass 01.wav | A | Swing& Jazz | 120 | – |
| 001 | 02 | 004 | 01 | 020040101 | BebopPiano01 Rhythm.txt | BebopPiano01 Attack.txt | BebopPiano 01.wav | A | Swing& Jazz | 120 | 7 |
| 001 | 03 | 006 | 01 | 030060101 | BebopTenorSax01 Rhythm.txt | BebopTenorSax01 Attack.txt | BebopTenorSax 01.wav | A | Swing& Jazz | 120 | – |
| 001 | 04 | 020 | 01 | 040200101 | BebopBassDrum01 Rhythm.txt | BebopBassDrum01 Attack.txt | BebopBassDrum 01.wav | – | Swing& Jazz | 120 | – |
| 001 | 05 | 033 | 01 | 050330101 | BebopSnareDrum01 Rhythm.txt | BebopSnareDrum01 Attack.txt | BebopSnareDrum 01.wav | – | Swing& Jazz | 120 | – |
| 001 | 06 | 050 | 01 | 060500101 | BebopHi-hat01 Rhythm.txt | BebopHi-hat01 Attack.txt | BebopHi-hat 01.wav | – | Swing& Jazz | 120 | – |
| 001 | 07 | 061 | 01 | 070610101 | BebopCymbal01 Rhythm.txt | BebopCymbal01 Attack.txt | BebopCymbal 01.wav | – | Swing& Jazz | 120 | – |
| ... | ... | ... | ... | ... | ... | ... | ... | ... | ... | ... | ... |

FIG. 13B

| KEY NO. | KEY |
|---|---|
| 1 | C |
| 2 | D♭ |
| 3 | D |
| 4 | E♭ |
| 5 | E |
| 6 | F |
| 7 | G♭ |
| 8 | G |
| 9 | A♭ |
| 10 | A |
| 11 | B♭ |
| 12 | B |

FIG. 18

| STYLE ID | STYLE NAME | SECTION | KEY | GENRE | BPM | TIME | BASE RHYTHM PATTERN ID | CHORD RHYTHM PATTERN ID | PHRASE RHYTHM PATTERN ID | BASS DRUM RHYTHM PATTERN ID | SNARE DRUM RHYTHM PATTERN ID | HIGH-HAT RHYTHM PATTERN | CYMBAL RHYTHM PATTERN |
|---|---|---|---|---|---|---|---|---|---|---|---|---|---|
| 0001 | Bebop01 | Intro-I | A | Swing&Jazz | 120 | 4 | 010010101 | 020040101 | 030060101 | 040200101 | 050330101 | 060500101 | 070610101 |
| 0002 | Bebop01 | Intro-II | A | Swing&Jazz | 120 | 4 | 010010102 | 020040102 | 030060102 | 040200102 | 050330102 | 060500102 | 070610102 |
| 0003 | Bebop01 | Intro-III | A | Swing&Jazz | 120 | 4 | 010010103 | 20040103 | 030060103 | 040200103 | 050330103 | 060500103 | 070610103 |
| 0004 | Bebop01 | Main-A | A | Swing&Jazz | 120 | 4 | 010010104 | 020040104 | 030060104 | 040200104 | 050330104 | 060500104 | 070610104 |
| 0005 | Bebop01 | Main-B | A | Swing&Jazz | 120 | 4 | 010010105 | 020040105 | 030060105 | 040200105 | 050330105 | 060500105 | 070610105 |
| 0006 | Bebop01 | Main-C | A | Swing&Jazz | 120 | 4 | 010010106 | 020040106 | 030060106 | 040200106 | 050330106 | 060500106 | 070610106 |
| 0007 | Bebop01 | Main-D | A | Swing&Jazz | 120 | 4 | 010010107 | 20040107 | 030060107 | 040200107 | 050330107 | 060500107 | 070610107 |
| 0008 | Bebop01 | End01 | A | Swing&Jazz | 120 | 4 | 010010108 | 020040108 | 030060108 | 040200108 | 050330108 | 060500108 | 070610108 |
| 0009 | Bebop01 | End02 | A | Swing&Jazz | 120 | 4 | 010010109 | 020040109 | 030060109 | 040200109 | 050330109 | 060500109 | 070610109 |
| 0010 | Bebop01 | End03 | A | Swing&Jazz | 120 | 4 | 010010110 | 020040110 | 030060110 | 040200110 | 050330110 | 060500110 | 070610110 |
| 0011 | Bebop01 | Fillin-AA | A | Swing&Jazz | 120 | 4 | 010010111 | 020040111 | 030060111 | 040200111 | 050330111 | 060500111 | 070610111 |
| 0002 | Bebop01 | Fillin-AB | A | Swing&Jazz | 120 | 4 | 010010112 | 020040112 | 030060112 | 040200112 | 050330112 | 060500112 | 070610112 |
| 0003 | Bebop01 | Fillin-BB | A | Swing&Jazz | 120 | 4 | 010010113 | 20040113 | 030060113 | 040200113 | 050330113 | 060500113 | 070610113 |
| 0004 | Bebop01 | Fillin-CC | A | Swing&Jazz | 120 | 4 | 010010114 | 020040114 | 030060114 | 040200114 | 050330114 | 060500114 | 070610114 |
| ... | ... | ... | ... | ... | ... | ... | ... | ... | ... | ... | ... | ... | ... |

FIG. 19A (a)

| STYLE ID | St | Sni | Tssi | Tsei | Se |
|---|---|---|---|---|---|
| 0001 | Bebop01 | Intro-I | Tss01 | TSe01 | Se01 |
| 0002 | Bebop01 | Main-A | Tss02 | TSe02 | Se02 |
| 0003 | Bebop01 | Fillin-AA | Tss03 | TSe03 | Se03 |
| 0004 | Bebop01 | End01 | Tss04 | TSe04 | Se04 |

(b)

| STYLE ID | Key | Cni | Cri | Cti | Tcsi | Tcei | Ce |
|---|---|---|---|---|---|---|---|
| 0001 | A | Amaj | A | maj | Tcs1 | Tce1 | C1 |
| 0001 | A | D7 | D | 7 | Tcs2 | Tce2 | C2 |
| 0001 | A | E | E | — | Tcs3 | Tce3 | C3 |
| 0001 | A | Amaj | A | maj | Tcs4 | Tce4 | C4 |

FIG. 19B (a)

INPUT BPM 100 (301)

TEMPO FILTER OFF (302)

MUSICAL TIME FILTER OFF (303)

| 1ST SEARCH PART | CHORD |
|---|---|
| 2ND SEARCH PART | |

| No. | STYLE NAME | SIMILARITY | KEY | GENRE | BPM | TIME |
|---|---|---|---|---|---|---|
| 1 | Bebop 01 | 0.0312 | A | Swing&Jazz | 120 | 4/4 |
| 2 | Hard Rock 02 | 0.0352 | B | Pop&Rock | 120 | 4/4 |
| 3 | Free Jazz 03 | 0.0356 | D | Swing&Jazz | 124 | 4/4 |
| 4 | Roots Reggae 03 | 0.0356 | A | Reggae | 105 | 4/4 |
| 5 | Blues Rock 04 | 0.0469 | E | Pop&Rock | 148 | 8/8 |
| 6 | Dancehall Reggae 01 | 0.0480 | B | Reggae | 135 | 4/4 |
| 7 | 70's Funk 05 | 0.0921 | D | Soul,R&B | 130 | 8/8 |
| 8 | Deep House 02 | 0.1125 | C | House | 124 | 8/8 |
| 9 | Salsa 03 | 0.1145 | A | Latin | 176 | 4/4 |
| 10 | AfroBeat 04 | 0.3854 | E | Africa | 113 | 4/4 |

(b)

INPUT BPM 100 (301)

TEMPO FILTER ON (302)

MUSICAL TIME FILTER OFF (303)

| 1ST SEARCH PART | CHORD |
|---|---|
| 2ND SEARCH PART | |

| No. | STYLE NAME | SIMILARITY | KEY | GENRE | BPM | TIME |
|---|---|---|---|---|---|---|
| 1 | Bebop 01 | 0.0312 | A | Swing&Jazz | 120 | 4/4 |
| 2 | Hard Rock 02 | 0.0352 | B | Pop&Rock | 120 | 4/4 |
| 3 | Free Jazz 03 | 0.0356 | D | Swing&Jazz | 124 | 4/4 |
| 4 | Roots Reggae 03 | 0.0356 | A | Reggae | 105 | 4/4 |
| 5 | Dancehall Reggae 01 | 0.0480 | B | Reggae | 135 | 4/4 |
| 6 | 70's Funk 05 | 0.0921 | D | Soul,R&B | 130 | 8/8 |
| 7 | Deep House 02 | 0.1125 | C | House | 124 | 8/8 |
| 8 | AfroBeat 04 | 0.3854 | E | Africa | 113 | 4/4 |

(c)

INPUT BPM 100 (301)

TEMPO FILTER OFF (302)

MUSICAL TIME FILTER 4/4 (303)

| 1ST SEARCH PART | CHORD |
|---|---|
| 2ND SEARCH PART | HIGH-HAT |

| No. | STYLE NAME | SIMILARITY | KEY | GENRE | BPM | TIME |
|---|---|---|---|---|---|---|
| 1 | Bebop 01 | 0.0457 | A | Swing&Jazz | 120 | 4/4 |
| 2 | Hard Rock 02 | 0.0670 | B | Pop&Rock | 120 | 4/4 |
| 3 | Dancehall Reggae 01 | 0.1214 | B | Reggae | 135 | 4/4 |
| 4 | Roots Reggae 03 | 0.1295 | A | Reggae | 105 | 4/4 |
| 5 | AfroBeat 04 | 0.4258 | E | Africa | 113 | 4/4 |

FIG. 21

| RHYTHM CATEGORY | TARGET ON-SET TIME INTERVAL |
|---|---|
| FOURTH | 11,12,23,24,35,36 |
| EIGHTH | 5,6,29,30,41,42 |
| EIGHTH TRIPLET | 3,4 |
| SIXTEENTH | 2,3,14,15,20,21,27,28,32,33,44,45 |
| 1.5 BEAT | 17,18 |
| 0.75 BEAT | 8,9 |
| Swing | 7,8,15,16,19,20 |

FIG. 24

| | | RHYTHM CATEGORY OF DB | | | | | | |
|---|---|---|---|---|---|---|---|---|
| | | FOURTH | EIGHTH | 1.5 BEAT | SIXTEENTH | 0.75 BEAT | EIGHTH TRIPLET | Swing |
| INPUT RHYTHM CATEGORY | FOURTH | 0 | 0.8 | 0.8 | 0.8 | 0.8 | 0.8 | 0.5 |
| | EIGHTH | 0.8 | 0 | 0.4 | 0.5 | 0.8 | 1 | 1 |
| | 1.5 BEAT | 0.8 | 0.4 | 0 | 0.8 | 0.6 | 1 | 1 |
| | SIXTEENTH | 0.8 | 0.5 | 0.8 | 0 | 0.6 | 1 | 1 |
| | 0.75 BEAT | 0.8 | 0.8 | 0.6 | 0.6 | 0 | 1 | 1 |
| | EIGHTH TRIPLET | 0.8 | 1 | 1 | 1 | 1 | 0 | 0.2 |
| | Swing | 0.5 | 1 | 1 | 1 | 1 | 0.2 | 0 |

FIG. 25

| RHYTHM CATEGORY | TARGET ON-SET TIME | SCORE |
|---|---|---|
| FOURTH | 0,11,12,23,24,35,36,47 | 2 |
| EIGHTH | 5,6,17,18,29,30,41,42 | 2 |
| | 0,11,12,23,24,35,36,47 | 1 |
| EIGHTH TRIPLET | 3,4,7,8,15,16,19,20,27,28,31,32,39,40,43,44 | 2 |
| | 0,11,12,23,24,35,36,47 | 1 |
| SIXTEENTH | 2,3,8,9,14,15,20,21,26,27,32,33,38,39,44,45 | 2 |
| | 0,11,12,23,24,35,36,47,5,6,17,18,29,30,41,42 | 1 |
F I G. 2 6
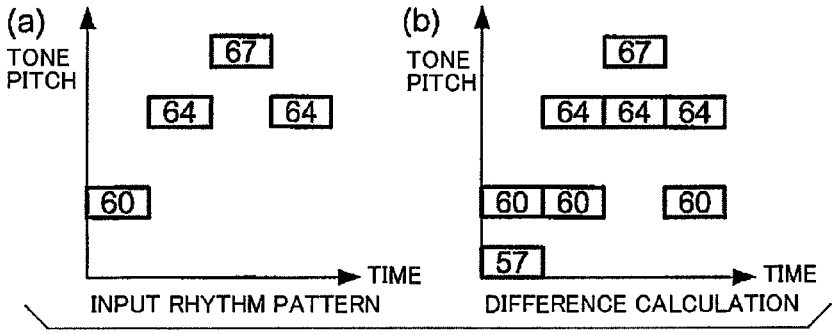
F I G. 2 7
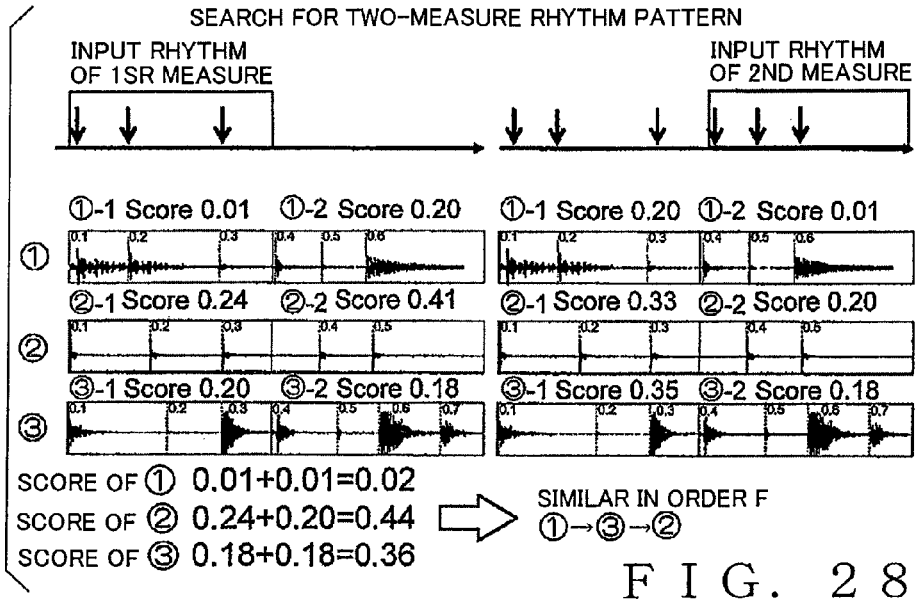
F I G. 2 8

(a)

| | FILE NAME | SIMILARITY | KEY | GENRE | BPM |
|---|---|---|---|---|---|
| 1 | JazzFunk | 0.0332 | B | R&B | 120 |
| 2 | BossaNova | 0.0332 | D | Latin | 124 |
| 3 | Rumba | 0.0332 | C | Latin | 108 |
| 4 | Salsa | 0.0417 | A | Latin | 177 |
| 5 | EPBalld | 0.0827 | C | Ballad | 60 |
| 6 | FrenchJazz | 0.1237 | D | Swing&Jazz | 232 |
| 7 | PowerRock 1 | 0.3024 | C | Pop&Rock | 112 |
| 8 | RumbaFlamenco | 0.3024 | B | Latin | 106 |
| 9 | Pasodoble | 0.3234 | A | Swing&Jazz | 122 |
| 10 | 70's8Beat 1 | 0.4262 | C | Pop&Rock | 182 |
| 11 | 70's8Beat 2 | 0.4370 | B | Pop&Rock | 182 |
| 12 | PowerRock 2 | 0.4370 | D | Pop&Rock | 112 |
| 13 | ModBigBandShfl | 0.4370 | D | Swing&Jazz | 156 |
| 14 | ChaChaCha | 0.4370 | A | BallRoom | 128 |
| 15 | Dancehall | 0.4502 | D | Dance | 103 |

(b)

| | FILE NAME | SIMILARITY | KEY | GENRE | BPM |
|---|---|---|---|---|---|
| 1 | BossaNova 1 | 0.0332 | D | Latin | 124 |
| 2 | Rumba | 0.0332 | C | Latin | 108 |
| 3 | Salsa | 0.0417 | A | Latin | 177 |
| 4 | RumbaFlamenco1 | 0.3024 | B | Latin | 106 |
| 5 | RumbaFlamenco2 | 0.5141 | C | Latin | 106 |
| 6 | FastBossa 1 | 0.5488 | B | Latin | 175 |
| 7 | FastBossa 2 | 0.5488 | C | Latin | 175 |
| 8 | PopRumba | 0.5496 | B | Latin | 160 |
| 9 | GuitarRumba | 0.5604 | A | Latin | 166 |
| 10 | BossaNova 2 | 0.5629 | A | Latin | 124 |

FIG. 30

SEARCHING FOR A TONE DATA SET BASED ON A DEGREE OF SIMILARITY TO A RHYTHM PATTERN

CROSS-REFERENCE TO RELATED APPLICATIONS

This application is a National Stage application under 35 U.S.C. §371 of International Application No. PCT/JP2011/077839 filed Dec. 1, 2011, which claims priority benefit of Japanese Patent Application No. 2010-268661 filed Dec. 1, 2010 and Japanese Patent Application No. 2010-263088 filed Nov. 30, 2011. The entire contents of the above applications are herein incorporated by reference in their entirety for all intended purposes.

TECHNICAL FIELD

The present invention relates a technique for searching for a tone data set based on a degree of similarity to a rhythm pattern, and particularly relates to a tone data processing apparatus, tone data processing system, tone data processing method and tone data processing program using the technique.

BACKGROUND

DAWs (Digital Audio Workstations) including an audio input/output device with a PC (Personal Computer) as its operational core have been in widespread use today as music production environments. In the field of such DAWs, it has been common to add necessary hardware to the PC and execute a dedicated software application on the PC. When a rhythm pattern is to be punched or input via the DAW, for example, there is a need for a user to select by itself (i.e., himself or herself) a desired tone color, performance part (snare, high-hat cymbals, or the like), phrase etc. from a database having tone sources stored therein. Thus, if the number of the sound sources stored in the database is enormous, it would take a lot of time and labor for the user to find out or search out a desired tone source from the database. International Publication No. 2002/047066 (hereinafter referred to as "patent literature 1") discloses a technique, which, in response to a user inputting a rhythm pattern, searches for a music piece data set corresponding to the input rhythm pattern from among music piece data sets stored in a memory and presents the thus-searched-out music piece data set. Further, Japanese Patent Application Laid-open Publication No. 2006-106818 (hereinafter referred to as "patent literature 2") discloses a technique, in accordance with which, in response to input of a time-serial signal having an alternate repetition of ON and OFF states, a search section searches for and retrieves rhythm data having a variation pattern identical or similar to the input time-serial signal so that the thus-retrieved rhythm data set is output as a searched-out result after being imparted with related music information (e.g., name of a music piece in question).

However, if a rhythm pattern is to be directly input via an input device, such as a pad or keyboard, with the technique disclosed in patent literature 1 or patent literature 2, the rhythm pattern is input in accordance with a feeling of time passage or lapse felt by a user itself. Thus, a temporal error may occur in the input rhythm due to deviation of the user's feeling of time lapse. As a consequence, a rhythm pattern different from the rhythm pattern originally intended by the user may be output as a searched-out result (e.g., sixteenth-note phrase (hereinafter "sixteenth phrase") different from an eighth-note phrase (hereinafter "eighth phrase") originally intended by the user may be output as a searched-out result), which would give an uncomfortable feeling and stress to the user.

LIST OF PRIOR ART DOCUMENTS

Patent Literatures

[Patent Literature 1] International Publication No. 2002/047066

[Patent Literature 2] Japanese Patent Application Laid-open Publication No. 2006-106818

SUMMARY OF THE INVENTION

In view of the foregoing prior art problems, it is an object of the present invention to provide an improved technique for searching for a tone data set of a phrase constructed in a rhythm pattern that satisfies a predetermined condition of a degree of similarity to a rhythm pattern intended by a user.

In order to accomplish the above-mentioned object, the present invention provides an improved tone data processing apparatus, which comprises: a storage section storing therein tone data sets, each representative of a plurality of sounds in a predetermined time period, and tone rhythm patterns, each representative of a series of sound generation times of the plurality of sounds, in association with each other; a notification section which not only causes designated times in the time period to progress in accordance with passage of time but also notifies a user of the designated times; an acquisition section which, on the basis of operation input by a user while the designated times are being notified by the notification section, acquires an input rhythm pattern representative of a series of the designated times corresponding to a pattern of the operation input by the user; and a search section which searches the tone data sets stored in the storage section for a tone data set associated with a tone rhythm pattern whose degree of similarity to the input rhythm pattern satisfies a predetermined condition.

Preferably, in the tone data processing apparatus of the present invention, the storage section stores therein categories of rhythms, determined on the basis of the sound generation time intervals represented by the tone rhythm patterns, in association with the tone rhythm patterns. The tone data processing apparatus of the invention further comprises: a determination section which, on the basis of intervals between the designated times represented by the input rhythm pattern, determines a category of rhythm the input rhythm pattern belongs to; and a calculation section which calculates a distance between the input rhythm pattern and each of the tone rhythm patterns. The search section calculates a degree of similarity between the input rhythm pattern and each of the tone rhythm patterns on the basis of relationship between the category of rhythm the input rhythm pattern belongs to and a category of rhythm the tone rhythm pattern belongs to, and the tone data set identified by the search section is a tone data set associated with a tone rhythm pattern of which the degree of similarity to the input rhythm pattern, calculated by the search section, satisfies a predetermined condition.

Preferably, in the tone data processing apparatus of the present invention, the search section compares an input time interval histogram representative of a frequency distribution of sound generation times represented by the input rhythm pattern and a rhythm category histogram representative, for each the categories of rhythms, a frequency distribution of the sound generation time intervals in the tone rhythm patterns, to thereby identify a particular category of rhythm of the rhythm category histogram that presents high similarity to the input time interval histogram. The tone data identified by the search section is a tone data set associated with a tone rhythm pattern, included in the tone rhythm patterns associated with the identified category of rhythm, of which the degree of similarity to the input rhythm pattern satisfies a predetermined condition.

Preferably, the predetermined time period comprises a plurality of time segments, the storage section stores therein, for each of the time segments, a tone rhythm pattern representative of a series of sound generation times of the plurality of sounds and the tone data set in association with each other, the calculation section calculates a distance between the input rhythm pattern and the tone rhythm pattern of each of the time segments stored in the storage section, and the search section calculates a degree of similarity between the input rhythm pattern and the tone rhythm pattern on the basis of relationship among the distance between the input rhythm pattern and the tone rhythm pattern calculated for each of the time segments by the calculation section, the category of rhythm the input rhythm pattern belong to and the category of rhythm the tone rhythm pattern belong to. The tone data set identified by the search section is a tone data set associated with a tone rhythm pattern of which the calculated degree of similarity to the input rhythm pattern satisfies a predetermined condition.

Preferably, the tone data processing apparatus further comprises a supply section which, in synchronism with notification of the designated times by the notification section, supplies the tone data set, searched out by the search section, to a sound output section which audibly output sounds corresponding to the tone data set.

Preferably, in the tone data processing apparatus of the invention, the storage section stores therein tone pitch patterns, each representative of a series of tone pitches of sounds represented by a corresponding one of the tone data sets, in association with the tone data sets. The tone data processing apparatus further comprises a tone pitch pattern acquisition section which, on the basis of operation input by the user while the designated times are being notified by the notification section, acquires an input pitch pattern representative of a series of tone pitches. The search section calculates the degree of similarity between the input pitch rhythm and each of the tone pitch patterns on the basis of a variance in tone pitch difference between individual sounds of the input pitch pattern and individual sounds of the tone pitch pattern, and the tone data identified by the search section is a tone data set associated with a tone rhythm pattern of which the calculated degree of similarity to the input pitch pattern satisfies a predetermined condition.

Preferably, the storage section stores therein tone velocity patterns, each representative of a series of sound intensity represented by a corresponding one of the tone data sets, in association with the tone data sets, and the tone data processing apparatus further comprises a velocity pattern acquisition section which, on the basis of operation input by the user while the designated times are being notified by the notification section, acquires an input velocity pattern representative of a series of sound intensity. The search section calculates the degree of similarity between the input rhythm pattern and each of the tone rhythm patterns on the basis of absolute values of differences in intensity between individual sounds of the input velocity pattern and individual sounds of the tone velocity pattern, and the tone data set identified by the search section is a tone data set associated with a tone rhythm pattern of which the calculated degree of similarity to the input rhythm pattern satisfies a predetermined condition.

Preferably, the storage section stores therein tone duration patterns, each representative of a series of durations of sounds represented by a corresponding one of the tone data sets, in association with the tone data sets, and the tone data processing apparatus further comprises a duration pattern acquisition section which, on the basis of operation input by the user while the designated times are being notified by the notification section, acquires an input duration pattern representative of a series of sound intensity. The search section calculates the degree of similarity between the input rhythm pattern and each of the tone rhythm patterns on the basis of absolute values of differences in duration between individual sounds of the input duration pattern and individual sounds of a corresponding one of the tone duration patterns, and the tone data set identified by the search section is a tone set data associated with a tone rhythm pattern of which the calculated degree of similarity to the input rhythm pattern satisfies a predetermined condition.

According to another aspect of the present invention, there is provided a tone data creating system comprising: an input device via which performance operation by a user is input; and a tone data processing apparatus recited in any one of claims 1 to 8, the tone data processing apparatus acquiring, as a rhythm pattern representative of a series of sound generation times at which individual sounds are to be audibly generated, a series of time intervals at which individual performance operation has been input by the user to the input device while designated times in a predetermined time period are being caused to progress by a notification section of the tone data processing apparatus.

A computer-readable storage medium storing therein a program for causing a computer to perform: a step of storing in a storage device tone data sets, each representative of a plurality of sounds in a predetermined time period, and tone rhythm patterns, each representative of a series of sound generation times of the plurality of sounds, in association with each other; a notification step of not only causing designated times in the time period to progress in accordance with passage of time but also notifying a user of the designated times; a step of, on the basis of operation input by a user while the designated times are being notified by the notification step, acquiring an input rhythm pattern representative of a series of the designated times corresponding to a pattern of the operation; and a step of searching the tone data sets stored in the storage device for a tone data set associated with a tone rhythm pattern whose degree of similarity to the input rhythm pattern satisfies a predetermined condition.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

FIG. 3 is a block diagram showing example stored contents of a rhythm DB (database) of the information processing device;

FIG. 13A is a schematic diagram showing contents of a table included in the accompaniment database;

FIG. 13B is a schematic diagram showing contents of a table included in the accompaniment database;

FIG. 18 is a diagram showing an example of a key table;

FIG. 19A is a diagram showing an example of a table related to style data;

FIG. 19B is a diagram showing an example of a table related to style data;

FIG. 21 is a schematic diagram showing an example of searched-out results of style data;

FIG. 24 is a diagram showing an example of an ON-set time interval table;

FIG. 25 is a diagram showing an example of a distance reference table:

FIG. 26 is a diagram showing an example of an ON-set time table;

FIG. 27 is schematic diagram explanatory of search processing using a tone pitch pattern;

FIG. 28 is a schematic diagram explanatory of processing for searching for a rhythm pattern of a plurality of measures;

FIG. 30 is a schematic diagram showing lists of searched-out results obtained for accompaniment sound sources.

EMBODIMENTS OF THE INVENTION

Certain preferred embodiments of the present invention will hereinafter be described in detail.

<First Embodiment>

(Tone Data Search System)

<Construction>

Figure 1:
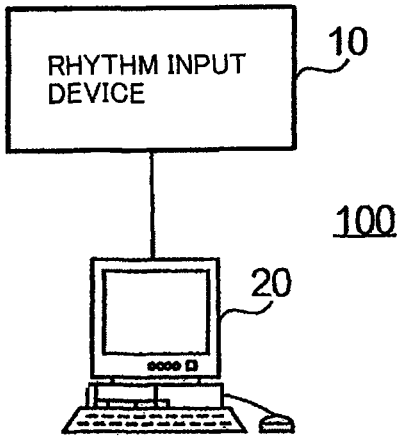
FIG. 1 is a schematic diagram showing a general setup of a tone data processing system according to a first embodiment of the present invention.

FIG. 1 is a schematic diagram showing a general setup of a tone data processing system 100 according to an embodiment of the present invention. The tone data processing system 100 includes a rhythm input device 10 and an information processing device 20, and the rhythm input device 10 and the information processing device 20 are communicatably interconnected via communication lines. The communication between the rhythm input device 10 and the information processing device 20 may be implemented in a wireless fashion. The rhythm input device 10 includes, for example, an electronic pad as an input means or section. In response to a user hitting a hitting surface of the electronic pad of the rhythm input device 10, the rhythm input device 10 inputs, to the information processing device 20, trigger data indicating that the electronic pad has been hit, i.e. that performance operation has been performed by the user and velocity data indicative or representative of intensity of the hitting operation, i.e. performance operation, on a per measure (or bar) basis. One trigger data is generated each time the user hits the hitting surface of the electronic pad, and one velocity data is associated with each such trigger data. A set of the trigger data and velocity data generated within each measure (or bar) represents a rhythm pattern input by the user using the rhythm input device 10 (hereinafter sometimes referred to as "input rhythm pattern"). Namely, the rhythm input device 10 is an example of an input device via which performance operation is performed or input by the user.

The information processing device 20 is, for example, a PC. Among operation modes in which the information processing device 20 executes an application program are a loop reproduction mode, performance reproduction mode and performance loop reproduction mode. The user can switch among these operation modes via a later-described operation section 25 provided in the information processing device 20. When the operation mode is the loop reproduction mode, the information processing device 20 searches through a database, storing therein a plurality of tone data sets having different rhythm patterns, for a tone data set identical or most similar to a rhythm pattern input via the rhythm input device 10, retrieves the searched-out tone data set, converts the retrieved tone data set into sounds, and then audibly outputs the converted sounds. At that time, the information processing device 20 repetitively reproduces the sounds based on the searched-out and retrieved tone data set. Further, when the operation mode is the performance reproduction mode, the information processing device 20 cannot only output sounds based on the retrieved tone data set, but also output sounds based on performance operation using component sounds of the retrieved tone data set. Furthermore, when the operation mode is the performance loop reproduction mode, the information processing device 20 can not only repetitively output the sounds based on the retrieved tone data set, but also repetitively output sounds based on a performance executed by the user using component sounds of the retrieved phrase. Note that the search function can be turned on or off as desired by the user via the operation section 25.

Figure 2:
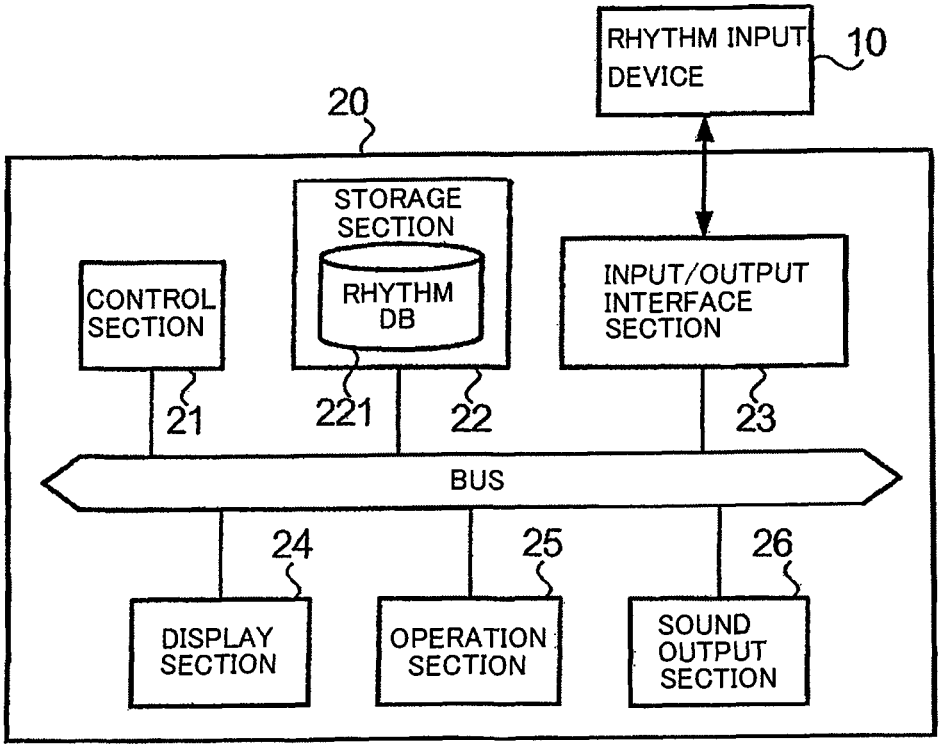
FIG. 2 is a block diagram showing a hardware setup of an information processing device provided in the first embodiment of the tone data processing system.

FIG. 2 is a block diagram showing a hardware setup of the information processing device 20. The information processing device 20 includes a control section 21, a storage section 22, an input/output interface section 23, a display section 24, the operation section 25 and a sound output section 26, which are interconnected via a bus. The control section 21 includes a CPU (Central Processing Unit), a ROM (Read-Only Memory), a RAM (Random Access Memory), etc. The CPU reads out an application program stored in the ROM or storage section 22, loads the read-out application program into the RAM, executes the loaded application program, and thereby controls the various sections via the bus. Further, the RAM functions as a working area to be used by the CPU, for example, in processing data.

The storage section 22 includes a rhythm database (DB) 221 which contains (stores therein) tone data sets having different rhythm patterns and information related to the tone data sets. The input/output interface section 23 not only inputs data, output from the rhythm input device 10, to the information processing device 20, but also outputs, in accordance with instructions of the control section 21, various signals to the input device 10 for controlling the rhythm input device 10. The display section 24 is, for example, in the form of a visual display which displays a dialog screen etc. to the user. The operation section 25 is, for example, in the form of a mouse and/or keyboard which receives and supplies signals, responsive to operation by the user, from and to the control section 21, so that the control section 21 controls various sections in accordance with the signals received from the operation section 25. The sound output section 26 includes a DAC (Digital-to-Audio Converter), amplifier and speaker. The sound output section 26 converts a digital tone data set, searched out and retrieved by the control section 21 from the rhythm DB 221, into an analog tone data set by means of the DAC, amplifies the analog tone data set by means of the amplifier and then audibly outputs sounds, corresponding to the amplified analog sound signal, by means of the speaker. Namely, the sound output section 26 is an example of a sound output section for audibly outputting sounds corresponding to the tone data set.

FIG. 3 is a diagram showing example contents of the rhythm DB 221. The rhythm DB 221 contains a musical instrument type table, a rhythm category table and a phrase table. (a) of FIG. 3 shows an example of the musical instrument type table, where each "musical instrument type ID" is an identifier, for example in the form of a three-digit number, uniquely identifying a musical instrument type. Namely, a plurality of unique musical instrument type IDs are described in the musical instrument type table in association with individual ones of different musical instrument types, such as "drum kit", "conga" and "djembe". For example, unique musical instrument type ID "001" is described in the musical instrument type table in association with musical instrument type "drum kit". Similarly, unique musical instrument type IDs are described in the musical instrument type table in association with the other musical instrument types. Note that the "musical instrument types" are not limited to those shown in (a) of FIG. 3.

(b) of FIG. 3 shows an example of the rhythm category table, where each "rhythm category ID" is an identifier uniquely identifying a category of a rhythm pattern (hereinafter referred to as "rhythm category") and is represented, for example, by a 2-digit number. Here, each "rhythm pattern" represents a series of times at which individual sounds are to be audibly generated within a time period of a predetermined time length. Particularly, in the instant embodiment, each "rhythm pattern" represents a series of times at which individual sounds are to be audibly generated within a measure that is an example of the time period. Each "rhythm category" is the name of a rhythm category, and a plurality of unique rhythm category IDs are described in the rhythm category table in association with individual ones of different rhythm categories, such as "eighth", "sixteenth" and "eighth triplet". Similarly, unique rhythm category IDs are described in the rhythm category table in association with the other rhythm categories. Note that the "rhythm categories" are not limited to those shown in (b) of FIG. 3. For example, there may be employed rougher categorization into beats or genres, or finer assignment of a separate category ID to each rhythm pattern.

(c) of FIG. 3 shows an example of a phrase table, where a plurality of phrase records, each comprising a tone data set of a phrase constituting one measure and information associated with the tone data set. Here, the "phrase" is one of units each representing a set of several notes. Such phrases are grouped on a musical instrument type ID by musical instrument type ID basis, and, before inputting a rhythm by use of the rhythm input device 10, the user can select a desired musical instrument type via the operation section 25. The musical instrument type selected by the user is stored into the RAM. As one example content of the phrase table, (c) of FIG. 3 shows a plurality of phrase records of which the musical instrument type is "drum kit" (the musical instrument type ID is "001"). Each of the phrase records comprises a plurality of items of data, such as the musical instrument type ID, phrase ID, rhythm category ID, phrase tone data set, rhythm pattern data and attack intensity pattern data. As noted above, the musical instrument type ID is an identifier uniquely identifying a musical instrument type, and the phrase ID is an identifier uniquely identifying a phrase record and is, for example, in the form of a four-digit number. The rhythm category ID is an identifier identifying which one of the above-mentioned rhythm categories the phrase record in question belongs to. In the illustrated example of (c) of FIG. 3, the phrase record whose rhythm category ID is "01" belongs to rhythm category "eighth" as indicated in the rhythm category table shown in (b) of FIG. 3.

The "phrase tone data set" is a data file that pertains to sounds included in a phrase constituting one measure (hereinafter referred to as "component sounds") and that is prepared in a sound file format, such as the WAVE (RIFF Waveform Audio Format) or mp3 (MPEG Audio Layer-3). Each "rhythm pattern data" is a data file having recorded therein sound generation start times of individual component sounds of a phrase constituting one measure; for example, each "rhythm pattern data" is a text file with sound generation start times of individual component sounds recorded therein. The sound generation start time of each component sound is normalized in advance using the length of a measure as a value "1". Namely, the sound generation start time of each component sound described in the rhythm pattern data takes a value in a range of from "0" to "1". As seen from the foregoing, the rhythm DB 211 is an example of a storage section in which a plurality of rhythm patterns, each representative of a series of times when individual component sounds are to be audibly generated within a time period of a predetermined length (one measure in this case), and tone data sets of phrases constructed in the rhythm patterns are prestored in association with the rhythm patterns. Further, in the case where the plurality of rhythm patterns are classified into categorized rhythm pattern groups, the rhythm DB 211 is also an example of a storage section in which rhythm classification IDs (rhythm category IDs in the instant embodiment) are stored in association with the individual rhythm patterns allocated to the rhythm pattern groups defined as above.

The rhythm pattern data may be created in advance in the following manner. A person or human operator who wants to create rhythm pattern data extracts component sound generation start times from a commercially available audio loop material having the component sound generation start times embedded therein. Then, the human operator removes, from among the extracted component sound generation start times, unnecessary component sound generation start times falling within a range of ignorable notes, such as ghostnotes. The data from which such unnecessary component sound generation start times have been removed may be used as rhythm pattern data.

Further, the attack intensity pattern data is a data file having recorded therein attack intensity of individual component sounds in a phrase constituting one measure; for example, the attack intensity pattern data is a text file having recorded therein attack intensity values of the individual component sounds. The attack intensity corresponds to velocity data, indicative or representative of performance operation intensity, included in the input rhythm pattern. Namely, each of the attack intensity represents an intensity value of one of the individual component sounds in the phrase tone data set. The attack intensity may be calculated, for example, by using a maximum value of a waveform of the component sound, or by integrating waveform energy in a predetermined portion of the waveform where a waveform volume is great. FIG. 3 illustratively shows a phrase record of which the musical instrument type is "drum kit"; actually, however, in the phrase table, there are described phrase records corresponding to a plurality of types of musical instruments (conga, maracas, djembe, TR-808, etc.).

Figure 4:
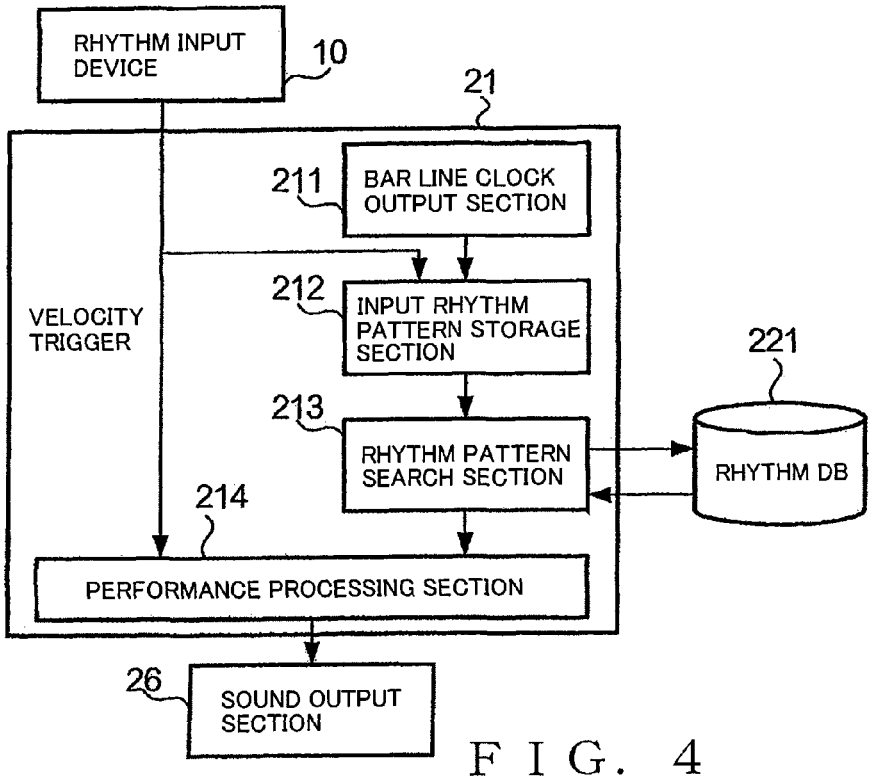
FIG. 4 is a block diagram showing functional arrangements of the information processing device in the first embodiment.

FIG. 4 is a block diagram showing functional arrangements of the above-mentioned information processing device 20. The control section 21 performs respective functions of a bar line clock output section 211, input rhythm pattern storage section 212, rhythm pattern search section 213 and performance processing section 214. Although the following describe various processing as being performed by the above-mentioned various sections, a main component that performs the processing is, in effect, the control section 21. In the following description, the term "ON-set" means that the input state of the rhythm input device 10 is switched from OFF to ON. For example, the term "ON-set" means that the electronic pad has been hit if the electronic pad is an input section or means of the rhythm input device 10, that a key has been depressed if a keyboard is the input means of the rhythm input device 10, or that a button has been depressed if the button is the input means of the rhythm input device 10. Further, in the following description, the term "ON-set time" indicates a time point at which the input state of the rhythm input device 10 has been changed from OFF to ON. In other words, the "ON-set time" indicates a time point at which trigger data has occurred (has been generated) in the rhythm input device 10.

In the case where the sound generation start time of each component sound is normalized in advance using the length of one measure (bar) as "1" as noted above, the bar line clock output section 211 outputs, to the input rhythm pattern storage section 212 once every several dozens of msec (milliseconds), data indicating where in a measure the current time is located on an advancing time axis, as a clock signal (hereinafter referred to as "bar line clock signal"). Namely, the bar line clock signal takes a value in the range from "0" to "1". Then, on the basis of such a bar line clock signal, the input rhythm pattern storage section 212 stores, into the RAM, time points at which trigger data input from the input device 10 have occurred (i.e. ON-set times), per measure. A series of ON-set times thus stored in the RAM per measure constitutes an input rhythm pattern. Because each of the ON-set times stored in the RAM is based on the bar line clock signal, it takes a value in the range from "0" to "1" just like the bar line clock. Namely, the bar line clock output section 211 is an example of a time-lapse notification section for not only causing the time to pass or lapse within a time period of a predetermined time length (one measure in this case) but also informing or notifying the user of the time passage or lapse in the predetermined time period. Further, the input rhythm pattern storage section 212 is an example of an acquisition section for acquiring a rhythm pattern that has been input by the user while the time is being caused by the bar line clock output section 211 to lapse within the time period of the predetermined length (one measure in this case) (i.e. while the time period of the predetermined length is caused to progress by the bar line clock output section 211), and that is indicative or representative of a series of generation times (ON-set times) of individual sounds. Further, the information processing device 20 is an example of a tone data processing device for acquiring, as a rhythm pattern (input rhythm pattern) indicative or representative of a series of generation times of individual sounds, a series of time points at which individual performance operation has been input by the user while the time is being caused by the bar line clock output section 211 to lapse within the time period of the predetermined length (one measure in this case), i.e. while the time period of the predetermined length is caused to progress by the bar line clock output section 211. Note that the time period caused to progress by the bar line clock output section 211 may or may not be repeated, and bar line clock signal input from an external source to the information processing device 20 may be used as the above-mentioned bar line clock signal.

Further, a time point at which a bar line starts has to be fed back from the information processing device 20 to the user so that the user can accurately input a rhythm pattern per measure. For that purpose, it is only necessary that the position of the bar line be visually or audibly indicated to the user by the information processing device 20 generating a sound or light at the time of each measure and/or beat, for example, like a metronome. Alternatively, the performance processing section 214 may reproduce an accompaniment sound source, having the position of each bar line added thereto in advance, in accordance with the bar line clock signal. In such a case, the user inputs a rhythm pattern in accordance with a bar line felt by the user from the reproduced accompaniment sound source.

The rhythm pattern search section 213 uses the input rhythm pattern, stored in the RAM, to search through the phrase table of the rhythm DB 221 and causes the RAM to store, as a searched-out result, a phrase record having rhythm pattern data identical to or most similar to the input rhythm pattern. Namely, the rhythm pattern search section 213 is an example of a search section for searching for and retrieving, from among the tone data sets stored in the storage section, a tone data set associated with a rhythm pattern that satisfies a condition of presenting a high degree of similarity to the rhythm pattern acquired by the input rhythm pattern storage section 212 as the acquisition section. The performance processing section 214 sets, as an object or subject of reproduction, the phrase tone data set of the phrase record (searched-out result) stored in the RAM and then causes the sound output section 26 to audibly output sounds based on the phrase tone data (set as the object or subject of reproduction) in synchronism with the bar line clock signal. In addition, the performance processing section 214 controls performance operation by the user using the component sounds in the phrase record if the operation mode is the performance reproduction mode or performance loop reproduction mode.

<Behavior of Embodiment>

Next, with reference to FIGS. 5 to 7, a description will be given about processing performed by the rhythm pattern search section 213 for detecting a particular phrase record from the phrase table on the basis of an input rhythm pattern when the search function is ON.

Figure 5:
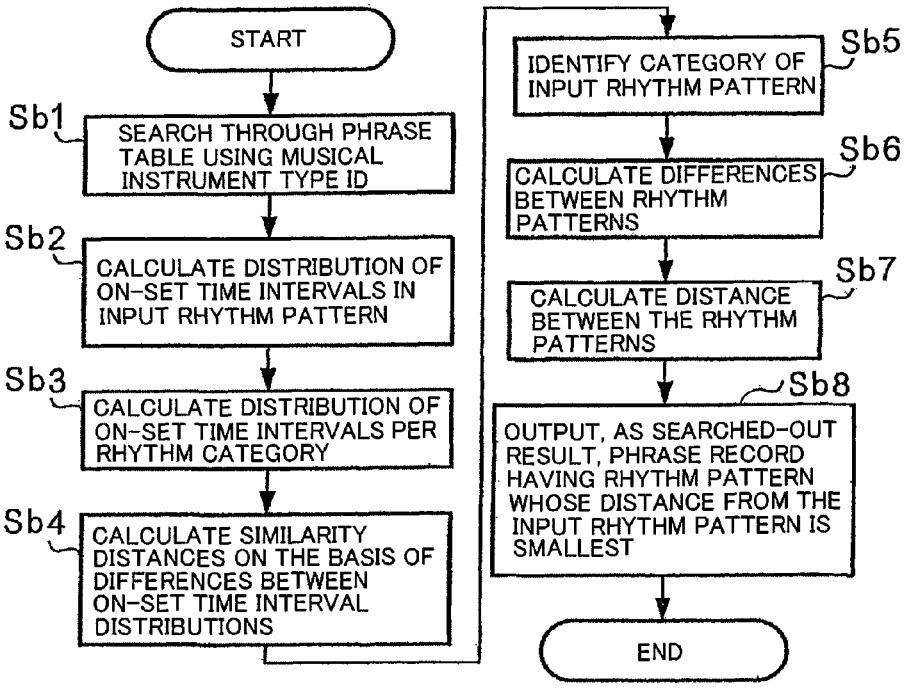
FIG. 5 is a flow chart showing an example operational sequence of search processing performed by a rhythm pattern search section of a rhythm input device in the tone data processing system.

FIG. 5 is a flow chart showing an example operational sequence of search processing performed by the rhythm pattern search section 213. First, at step Sb1, the rhythm pattern search section 213 uses the musical instrument type ID, stored in the RAM, to search through the phrase table. The musical instrument type ID is one stored in the RAM in response to the user designating it in advance via the operation section 25. In subsequent operations, the rhythm pattern search section 213 uses, as an object of processing, a phrase record searched out at step Sb1.

As set forth above, the input rhythm pattern includes ON-set times normalized with the length of one measure as "1". At next step Sb2, the rhythm pattern search section 213 calculates a distribution of ON-set time intervals in the input rhythm pattern stored in the RAM. The ON-set time intervals are each an interval between a pair of adjoining ON-set times on the time axis and represented by a numerical value from "0" to "1". Further, assuming that one measure is divided into 48 equal time segments, the distribution of the ON-set time intervals can be represented by the numbers of the ON-set time intervals corresponding to the time segments. The reason why one measure is divided into 48 equal time segments is that, if each beat is divided into 12 equal time segments assuming a quadruple-time rhythm, there can be achieved resolution suitable for identification among a plurality of different rhythm categories, such as eighth, eighth triplet and sixteenth. Here, the "resolution" is determined by a note of the shortest length that can be expressed by sequence software, such as a sequencer or the application program employed in the instant embodiment. In the instant embodiment, the resolution is "48" per measure, and thus, one quarter note is dividable into 12 segments.

In the following description about the phrase record too, the terms "ON-set time" and "ON-set time interval" are used in the same meanings as for the input rhythm pattern. Namely, the sound generation start time of each component sound described in the phrase record is the ON-set time, and an interval between adjoining ON-set times on the time axis is the ON-set time interval.

The following describe, using specific values of the ON-set times, how the distribution of the ON-set time intervals is calculated at step Sb2. Let it be assumed here that the user has input a rhythm pattern of an eighth phrase having recorded therein ON-set times indicated in item (a) below.

(a) 0, 0.25, 0.375, 0.5, 0.625, 0.75 and 0.875

On the basis of the input rhythm pattern indicated in item (a) above, the rhythm pattern search section 213 calculates ON-set time intervals as indicated in item (b) below.

(b) 0.25, 0.125, 0.125, 0.125, 0.125 and 0.125

Then, the rhythm pattern search section 213 calculates a group of values as indicated in item (c) below by multiplying each of the ON-set time intervals, calculated as above, by a value "48", adding "0.5" to the resultant product and then rounding down digits after the decimal point of the resultant sum (i.e., "quantizing process").

(c) 12, 6, 6, 6, 6 and 6

Here, "quantizing process" means that the rhythm pattern search section 213 corrects each of the ON-set time intervals in accordance with the resolution. The reason why the quantizing is performed is as follows. The sound generation times described in the rhythm pattern data in the phrase table are based on the resolution (48 in this case). Thus, if the phrase table is searched using the ON-set time intervals, accuracy of the search would be lowered unless the ON-set time intervals are also based on the resolution. For this reason, the rhythm pattern search section 213 performs the quantizing process on each of the ON-set time intervals indicated in item (b) above.

Figure 6:
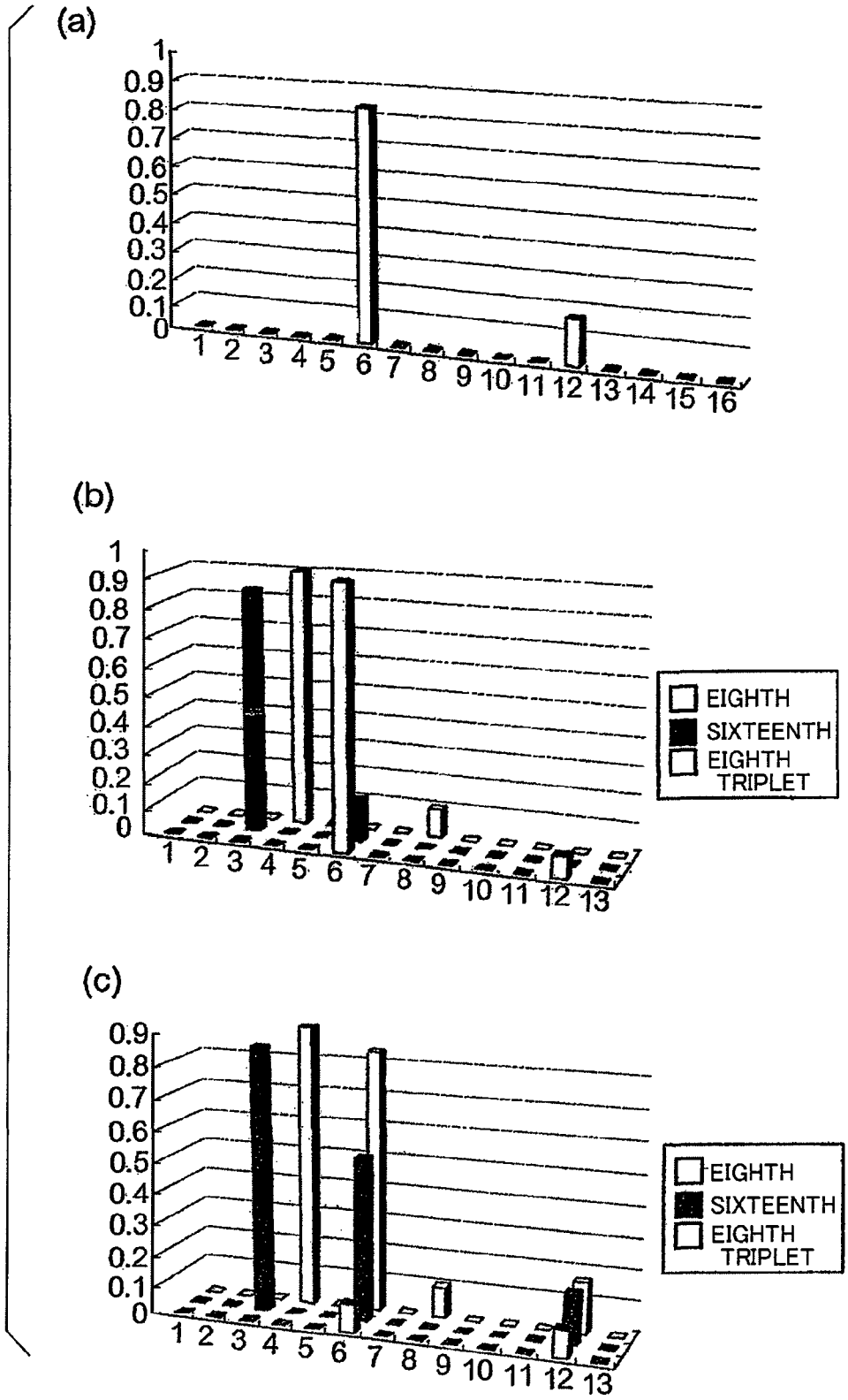
FIG. 6 is a diagram showing a distribution table of ON-set time intervals.

The following further describe the distribution of the ON-set time intervals, with reference to distribution tables shown in (a) to (c) of FIG. 6.

(a) of FIG. 6 is a distribution table of the ON-set time intervals in the input rhythm pattern. In (a) of FIG. 6, the horizontal axis represents time intervals in the case where one measure is divided into 48 time segments, while the vertical axis represents ratios in the numbers of the quantized ON-set time intervals ("number ratios"). In (a) of FIG. 6, the values in item (c) are allocated to the distribution table. The number ratios are normalized by the rhythm pattern search section 213 such that a sum of the number ratios becomes "1" (one). From (a) of FIG. 6, it can be seen that a peak of the distribution is in time interval "6" that is the greatest in number in the group of values of item (c) that are quantized ON-set time intervals.

At step Sb3 following step Sb2, the rhythm pattern search section 213 calculates a distribution of ON-set time intervals for each one of the rhythm categories, using all of the rhythm patterns described in the phrase table. Let it be assumed here that two eighth rhythm patterns, two sixteenth rhythm patterns and two eighth triplet rhythm patterns are described in rhythm pattern data of individual phrase records as follows:

Eighth Rhythm Category (A) 0, 0.25, 0.375, 0.5, 0.625, 0.75 and 0.875;

(B) 0, 0.121, 0.252, 0.37, 0.51, 0.625, 0.749 and 0.876;

Sixteenth Rhythm Category (C) 0, 0.125, 0.1875, 0.251, 0.374, 0.4325, 0.5, 0.625, 0.6875, 0.75, 0.876 and 0.9325;

(D) 0, 0.625, 0.125, 0.1875, 0.251, 0.3125, 0.375, 0.4325, 0.5, 0.5625, 0.625, 0.6875, 0.75, 0.8125, 0.875 and 0.9325;

Eighth Triplet Rhythm Category (E) 0, 0.8333, 0.1666, 0.25, 0.3333, 0.4166, 0.5, 0.5833, 0.6666, 0.75, 0.8333 and 0.91666; and (F) 0, 0.1666, 0.25, 0.333, 0.4166, 0.5, 0.6666, 0.75, 0.8333 and 0.91666.

The rhythm pattern search section 213 calculates a distribution of ON-set time intervals for each of the rhythm categories, using a calculation scheme, similar to that used at step Sb2 above, for the patterns indicated in (A)-(F) above. (b) of FIG. 6 shows a distribution table to which are allocated distributions of ON-set time intervals calculated for the individual rhythm categories, i.e. eighth rhythm category, sixteenth rhythm category and eighth triplet rhythm category. When the search processing is repeated while the search function is in the ON state, the phrase record and rhythm category remain the same (without being changed) unless the musical instrument type is changed at step Sb1 in second or subsequent execution of the processing, and thus, the operation of step Sb3 is omitted. Conversely, when the search processing is repeated while the search function is in the ON state, and if the musical instrument type has been changed at step Sb1, then the operation of step Sb3 is performed.

At step Sb4 following step Sb3, the rhythm pattern search section 213 calculates distances indicative of values of similarity (hereinafter referred to as "similarity distances") between the distribution table of ON-set time intervals based on the input rhythm pattern ((a) of FIG. 6) and the distribution table of ON-set time intervals based on the rhythm patterns of the individual rhythm categories described in the phrase table ((b) of FIG. 6). (c) of FIG. 6 shows a distribution table indicative of differences between the distribution table of ON-set time intervals based on the input rhythm pattern ((a) of FIG.

6) and the distribution table of ON-set time intervals based on the rhythm patterns of the individual rhythm categories described in the phrase table ((b) of FIG. 6). The similarity distance calculation at step Sb4 may be performed in the following manner. First, the rhythm pattern search section 213 calculates, for each same time interval in both the distribution table of ON-set time intervals based on the input rhythm pattern and the distribution table of ON-set time intervals based on the rhythm patterns of the individual rhythm categories described in the phrase table, absolute values of differences in the number ratio between the two tables. Then, the rhythm pattern search section 213 calculates, for each of the rhythm categories, a square root of a sum obtained by adding up the absolute values calculated for the individual time intervals. The value of the thus-calculated square root indicates the above-mentioned similarity distance. A smaller value of the similarity distance represents a higher degree of similarity, while a greater value of the similarity distance represents a lower degree of similarity. In the illustrated example of (c) of FIG. 6, the eighth rhythm category presents the smallest difference in the number ratio based on the distribution tables of (a) of FIG. 6 and (b) of FIG. 6, which means that, of the eighth, sixteenth and eighth triplet rhythm categories represented in the distribution tables, the eighth rhythm category has the smallest similarity distance to the input rhythm pattern.

At step Sb5 following step Sb4, the rhythm pattern search section 213 determines that one of the rhythm categories described in the phrase table which presents the smallest similarity distance is the rhythm category the input rhythm pattern falls in or belongs to. More specifically, at this step, the rhythm pattern search section 213 identifies that the input rhythm pattern falls in or belongs to the eighth rhythm category. Namely, through the operations of steps Sb2 to Sb5 above, the rhythm pattern search section 213 identifies a particular rhythm category which the input rhythm pattern is very highly likely to fall in. Namely, the rhythm pattern search section 213 is an example of a search section which determines, for each of the rhythm classification identifiers (rhythm categories in the instant embodiment), an absolute value of a difference between an input time interval histogram indicating a frequency distribution of sound generation time intervals represented by a rhythm pattern input by the user and acquired by the input rhythm pattern storage section 212 functioning as the acquisition section (illustrated example of (a) of FIG. 6 in the case of the instant embodiment) and a rhythm classification histogram indicating, for each of the rhythm classification identifiers (rhythm categories), a frequency distribution of sound generation time intervals in rhythm patterns stored in the storage section (illustrated example of (b) of FIG. 6 in the case of the instant embodiment), and which then searches for a tone data set associated with a particular rhythm pattern that is among rhythm patterns associated with the rhythm classification identifier presenting the smallest absolute value and that satisfies a condition of presenting a high degree of similarity to the input or acquired input pattern.

Then, at step Sb6, the rhythm pattern search section 213 calculates levels of differences between all of the rhythm patterns described in the phrase table and the input rhythm pattern, in order to identify, from among the described rhythm patterns, one rhythm pattern that is identical to the input rhythm pattern or presents the highest degree of similarity to the input rhythm pattern. Here, the "levels of differences" indicate how much the individual ON-set time intervals in the input rhythm pattern and the individual ON-set time intervals of the individual rhythm patterns described in the phrase table are different or distant from each other. Namely, smaller levels of the differences between the input rhythm pattern and any one of the rhythm patterns described in the phrase table represent a higher degree of similarity between the input rhythm pattern and the one rhythm pattern described in the phrase table.

Namely, while the rhythm pattern search section 213 identifies one rhythm category highly likely to correspond to the input rhythm pattern in the operations up to step Sb5, it handles, as objects of calculation, the phrase records belonging to all of the rhythm categories in the operation of step Sb6. The reason for this is as follows. Among the rhythm pattern data included in the phrase records, there may be rhythm pattern data for which it is hard to clearly determine which one of the rhythm categories the rhythm pattern data belongs to, such as rhythm pattern data where substantially the same numbers of eighth ON-set time intervals and sixteenth ON-set time intervals exist in one and the same measure. In such a case, the possibility of a user's intended rhythm pattern being detected accurately would be advantageously enhanced by the rhythm pattern search section 213 handling, as objects of calculation, the phrase records belonging to all of the rhythm categories at step Sb6 as noted above.

Figure 7:
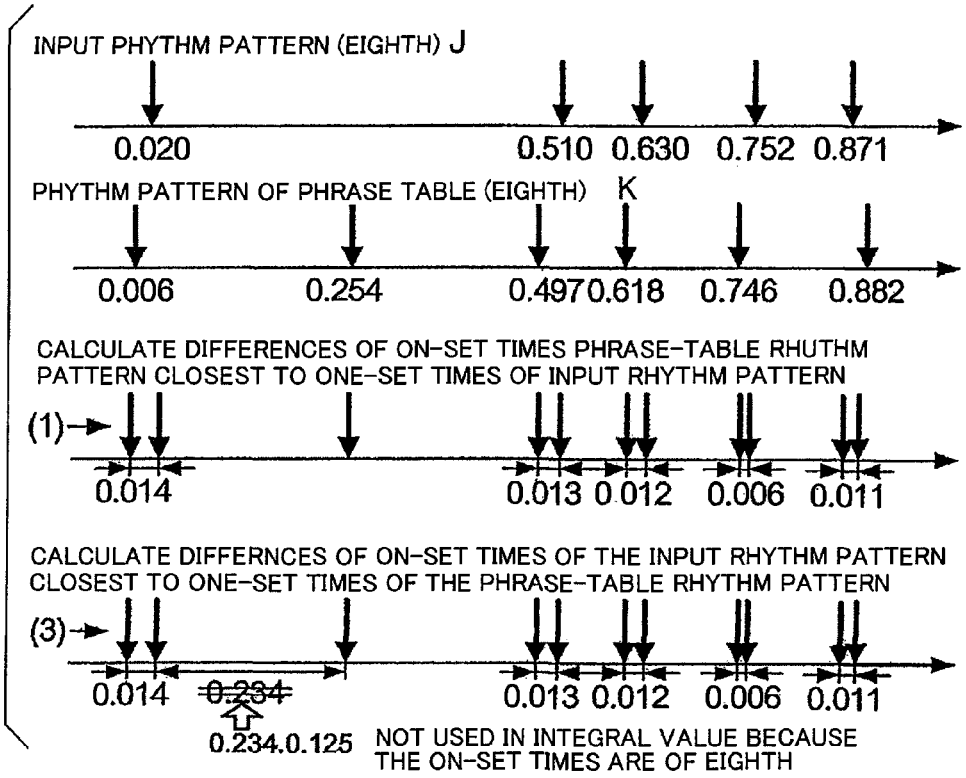
FIG. 7 is a schematic diagram explanatory of a difference between rhythm patterns.

The following describe in greater detail the operation of step Sb6, with reference to FIG. 7. FIG. 7 is a schematic diagram explanatory of calculation of a difference between rhythm patterns. In FIG. 7, the input rhythm pattern is depicted by J, and one of the rhythm patterns described in the phrase table is depicted by K. A level of a difference between the input rhythm pattern J and the rhythm pattern K is calculated in the following manner.

(1) The rhythm pattern search section 213 calculates absolute values of differences between the individual ON-set times of the input rhythm pattern J and the ON-set times of the rhythm pattern K that are closest to the individual ON-set times of the input rhythm pattern J ((1) of FIG. 7), in other words, on the basis of the individual ON-set times of the input rhythm pattern J.

(2) Then, the rhythm pattern search section 213 calculates an integrated value of the absolute values calculated in (1).

(3) Then, the rhythm pattern search section 213 calculates absolute values of differences between the individual ON-set times of the rhythm pattern K and the ON-set times of the input rhythm pattern J that are closest to the individual ON-set times of the rhythm pattern K ((3) of FIG. 7), in other words, on the basis of the individual ON-set times of the input rhythm pattern K.

(4) The rhythm pattern search section 213 calculates an integrated value of the absolute values calculated in (3).

(5) Then, the rhythm pattern search section 213 calculates, as a difference between the input rhythm pattern J and the rhythm pattern K, an average value between the integrated value calculated in (2) and integrated value calculated in (4).

In the instant embodiment, where a sufficient number of rhythm patterns are not prepared, the rhythm pattern search section 213 performs an operation for refraining from using the absolute value of each ON-set time interval difference greater than a reference time interval (in the illustrated example, "0.125" because the rhythm category here is "eighth") in the calculation of the integrated value. In a case where a sufficient number of rhythm patterns can be prepared, on the other hand, the rhythm pattern search section 213 does not have to perform the above-mentioned operation for refraining from using the absolute value of each ON-set time interval difference greater than the reference time interval. The rhythm pattern search section 213 performs the aforementioned calculations (1) to (5) for rhythm patterns in all of the phrase records included in the phrase table. Namely, the rhythm pattern search section 213 is an example of a search section which calculates an integrated value of differences between individual sound generation times represented by an input rhythm pattern acquired by the input rhythm pattern storage section 212 as the acquisition section and sound generation times that are represented by a rhythm pattern stored in the storage section and that are closest, on the time axis, to the sound generation times represented by the input rhythm pattern acquired by the acquisition section, and which identifies a particular rhythm pattern, for which the calculated integrated value is the smallest among the rhythm patterns in all of the phrase records, as a rhythm pattern satisfying a condition of presenting a high degree of similarity to the input rhythm pattern and then retrieves a tone data set associated with the particular rhythm pattern.

Next, at step Sb7, the rhythm pattern search section 213 multiplies the similarity distance, calculated for each of the rhythm categories at step Sb4, by the difference calculated at step Sb6, to thereby calculate a distance, from the input rhythm pattern, of each of the rhythm patterns in the phrase records included in the phrase table. The following is a mathematical expression explanatory of the operation of step Sb7, where "J" indicates the input rhythm pattern, as noted above, and "K" indicates a rhythm pattern K in the N-th phrase record; note that a smaller distance between the rhythm patterns J and K means that the rhythm pattern K has a higher degree of similarity to the input rhythm pattern J.

Distance between the Rhythm Pattern $J$ and the Rhythm Pattern $K$=(Similarity Distance between the Rhythm Pattern $J$ and the Rhythm Category the Rhythm Pattern $K$ belongs to)×(Difference between the Rhythm Patterns $J$ and $K$)

Note, however, that, in the aforementioned calculation of the distance, the following operations are performed so that a searched-out result is output from within the category which the input rhythm pattern was determined to belong to at step Sb5 above. Namely, the rhythm pattern search section 213 determines whether the rhythm category identified at step Sb5 and the rhythm category of the rhythm pattern K are identical to each other, and, if not identical, it adds a predetermined constant (e.g., 0.5) to the calculated result of the above-mentioned mathematical expression. By such addition of the predetermined constant, the rhythm pattern distance would become greater for each phrase record belonging to a rhythm category that is not identical to the rhythm category identified at step Sb5, and thus, the searched-out result can be more readily output from within the rhythm category identified at step Sb5. Then, at step Sb8, the rhythm pattern search section 213 regards a particular rhythm pattern, of which the distance from the input rhythm pattern is the smallest, as a rhythm pattern that satisfies a condition of presenting a high degree of similarity to the input rhythm pattern, and then the rhythm pattern search section 213 outputs, as the searched-out result, the phrase record having the rhythm pattern data of the particular rhythm pattern. The foregoing has described the operational sequence of the processing performed by the rhythm pattern search section 213 for outputting, as a searched-out result, a particular phrase record from the phrase table on the basis of the input rhythm pattern when the search function is ON.

The following describe processing performed by the performance processing section 214 in individual ones of the loop reproduction mode, performance reproduction mode and performance loop reproduction mode. As set forth above, by inputting an input rhythm pattern, the user can cause the performance processing section 214 to output sounds based on a phrase record identified through the aforementioned search (hereinafter referred to also as "searched-out phrase") (in each of the loop reproduction mode and performance loop reproduction mode). Further, as set forth above, the user can execute performance operation on the rhythm input device 10 using the component sounds of the searched-out phrase and cause the performance processing section 214 to output sounds of the phrase based on the performance operation (in each of the performance reproduction mode and performance loop reproduction mode). The following description explain differences among the loop reproduction mode, performance reproduction mode and performance loop reproduction mode.

Figure 8:
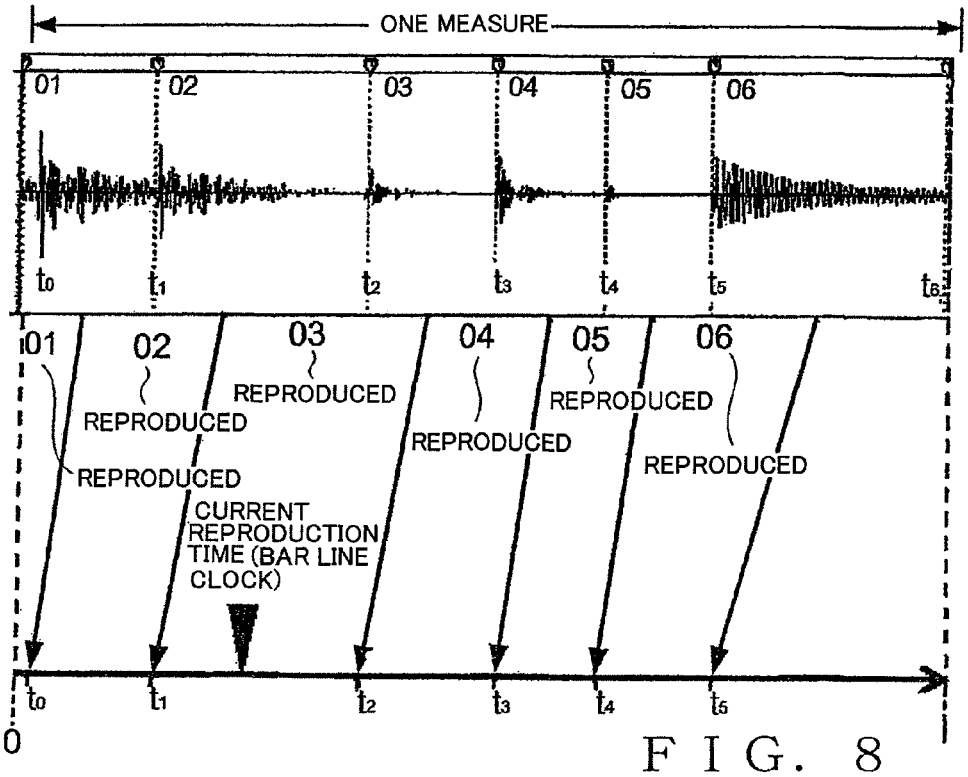
FIG. 8 is a schematic diagram explanatory of processing performed by a performance processing section in a loop reproduction mode.

FIG. 8 is a diagram explanatory of the processing performed by the performance processing section 214 in the loop reproduction mode. The loop reproduction mode is a mode in which the performance processing section 214 repetitively outputs, as objects of reproduction, sounds based on the searched-out phrase of one measure in accordance with BPM (Beats Per Minute) indicated by the bar line clock output section 211 and in time with an accompaniment. Once the bar line clock passes the sound generation start time of any one of the component sounds within the one measure of the searched-out phrase, the performance processing section 214 sets the one component sound as an object of reproduction. Here, once the bar line clock reaches the value "1", i.e. once one measure passes, the bar line clock again takes the value "0", after which the bar line clock repeats taking values from "0" to "1". Thus, with a repetition period of the bar line clock, the sounds based on the searched-out phrase are repetitively output as objects of reproduction. In the illustrated example of FIG. 8, once the bar line clock passes the sound generation start time of any one of the component sounds of the searched-out phrase, the performance processing section 214 sets the one component sound as an object of reproduction as indicated by an arrow. Namely, the loop reproduction mode is a mode which is designated primarily when the user wants to ascertain what types of a sound volume, color and rhythm pattern the searched-out phrase is composed of.

Figure 9:
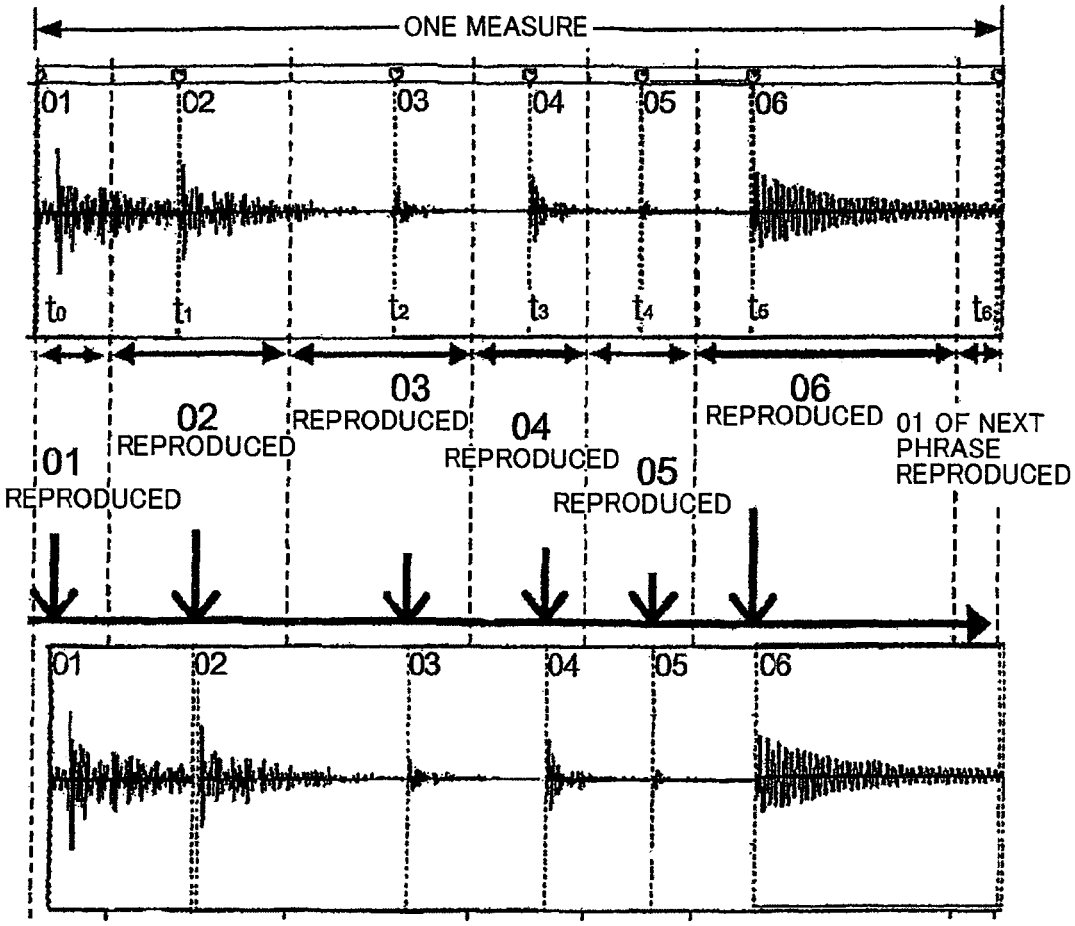
FIG. 9 is a schematic diagram explanatory of processing performed by the performance processing section in a performance reproduction mode.

FIG. 9 is a diagram explanatory of the processing performed by the performance processing section 214 in the performance reproduction mode. The performance reproduction mode is a mode in which, once the user executes performance operation via the rhythm input device 10, a component sound of a searched-out phrase corresponding to the time at which the performance operation has been executed is set as an object of processing by the performance processing section 214. In the performance reproduction mode, one component sound is set as an object of processing only at the time at which the performance operation has been executed. Namely, in the performance reproduction mode, unlike in the loop reproduction mode, no sound is output at all at a time when the user does not execute performance operation. Namely, in the performance reproduction mode, when the user executes performance operation in a rhythm pattern that is exactly identical to the rhythm pattern of the searched-out phrase, only sounds based solely on the searched-out phrase are audibly output. In other words, the performance reproduction mode is a mode that is designated when the user wants to continually executes a performance by himself or herself using the component sounds of the searched-out phrase.

In FIG. 9, it is shown that the user has executed performance operation using the rhythm input device 10 at time points indicated by arrows in individual time periods ("01"-"06") indicated by bi-directional arrows. More specifically, in the performance reproduction mode, four types of parameters, i.e. velocity data, trigger data, sound generation start times of the individual component sounds of the searched-out phrase and waveforms of the individual component sounds, are input to the performance processing section 214. Of those parameters, the velocity data and trigger data are based on the rhythm pattern input by the user via the rhythm input device 10. Further, the sound generation start times and waveforms of the individual component sounds of the searched-out phrase are included in the phrase record of the searched-out phrase. In the performance reproduction mode, each time the user executes performance operation using the rhythm input device 10, velocity data and trigger data are input to the performance processing section 214, so that the performance processing section 214 performs the following processing. Namely, the performance processing section 214 outputs, to the sound output section 26, a waveform of any one of the component sounds of the searched-out phrase of which the sound generation time is least different from the ON-set time of trigger data, while designating a sound volume corresponding to velocity data. Here, attack intensity levels of the individual component sounds of the searched-out phrase may also be input to the performance processing section 214 as additional input parameters, so that the performance processing section 214 outputs, to the sound output section 26, a waveform of any one of the component sounds of which the sound generation time is least different from the ON-set time of the trigger data, while designating a sound volume corresponding to velocity data that corresponds to the attack intensity level of the component sound. It should be noted that a waveform of any one of the component sounds corresponding to a period during which no trigger data is input (e.g., "02" and "03" in this case) is not output to the sound output section 26.

Next, the performance loop reproduction mode is a mode that is a combination of the loop reproduction mode and the performance reproduction mode. In the performance loop reproduction mode, the performance processing section 214 determines, per measure, whether or not performance operation has been executed by the user using the rhythm input device 10. In the performance loop reproduction mode, the performance processing section 214 sets, as objects of reproduction, sounds based on the searched-out phrase until the user executes performance operation using the rhythm input device 10. Namely, until the user executes performance operation using the rhythm input device 10, the performance processing section 214 behaves in the same manner as in the loop reproduction mode. Then, once the user executes performance operation within a given measure using the rhythm input device 10, the performance processing section 214 behaves in the same manner as in the performance reproduction mode as long as the given measure lasts. Namely, one of the component sounds of the searched-out phrase which corresponds to the time when the user has executed performance operation is set as an object of reproduction by the performance processing section 214. In the performance loop reproduction mode, if the user executes only one performance operation but does not execute any performance operation in a subsequent measure, the component sounds of the searched-out phrase which correspond to time points at which the user made input in an immediately-preceding measure are set as objects of reproduction. Namely, the performance loop reproduction mode is a mode in which the user not only wants to execute a performance by himself or herself using the component sounds of the searched-out phrase but also wants to cause the component sounds of the searched-out phrase to be reproduced in a looped fashion (i.e., loop-reproduced) in accordance with the user-input rhythm pattern.

The information processing device 20 constructed in the above-described manner can search for and retrieve a tone data set constructed in a rhythm pattern whose similarity to a user's intended rhythm pattern satisfies a predetermined condition. Further, the user is allowed to execute a performance using the component sounds of the searched-out phrase.

Next, a description will be given about a second embodiment of the present invention.

<Second Embodiment>

(Music Data Creation System)

<Construction>

The second embodiment of the present invention is practiced or implemented or practiced as a music data creation system that is an example of a music data processing system, and this music data creation system is arranged to create automatic accompaniment data (more specifically, automatic accompaniment data set) as an example of music data. Automatic accompaniment data to be handled in the instant embodiment are read into an electronic musical instrument, sequencer or the like and function like so-called MIDI automatic accompaniment data. The music data creation system 100*a* according to the second embodiment is constructed in generally the same manner as the music data creation system shown in FIG. 1, except for constructions of the rhythm input device and information processing device. Therefore, the rhythm input device and the information processing device in the second embodiment are indicated by respective reference numerals with a suffix "a". Namely, the music data creation system 100*a* includes the rhythm input device 10*a* and the information processing device 20*a* which are communicatably interconnected via communication lines. The communication between the rhythm input device 10*a* and the information processing device 20*a* may alternatively be implemented in a wireless fashion. In the second embodiment, the rhythm input device 10*a* includes, for example, a keyboard and pads as input means. In response to the user depressing keys of the keyboard provided in the rhythm input device 10*a*, the rhythm input device 10*a* inputs, to the information processing device 20*a*, trigger data indicating that the keys of the keyboard have been depressed, i.e. that performance operation has been performed by the user and velocity data indicative of intensity of the key depression, i.e. performance operation, on a per measure basis. One trigger data is generated each time the user depresses a key of the keyboard, and it is represented by key-on information indicative of the key depression. One velocity data is associated with each such trigger data. A set of the trigger data and velocity data generated within each measure (or bar) represents a rhythm pattern input within the measure by the user using the rhythm input device 10*a* (hereinafter sometimes referred to as "input rhythm pattern"). The user inputs such a rhythm pattern for each of performance parts corresponding to key ranges of the keyboard. Further, for a performance part representative of a percussion instrument, the user inputs a rhythm pattern using the pad. Namely, the rhythm input device 10*a* is an example of the input means via which performance operation is input by the user.

The information processing device 20*a*, which is for example a PC, includes a database containing automatic accompaniment data sets and tone data sets to be used for individual parts constituting the automatic accompaniment data sets, and an application using the database. The application includes a selection function for selecting a performance part on the basis of a rhythm pattern input when a tone data set is to be searched for, and a reproduction function for reproducing an automatic accompaniment data set being currently created or an already-created automatic accompaniment data set. The automatic accompaniment data set comprises data of a plurality of performance parts each having a specific rhythm pattern; the plurality of parts are, for example, a bass, chord, single-note phrase (i.e., phrase comprising a combination of single notes), bass drum, snare drum, high-hat cymbals, etc. More specifically, these data comprise an automatic accompaniment data table, and various files, such as txt and WAVE (RIFF Waveform Audio Format) files defined in the automatic accompaniment data table. A tone data set of each of the parts is recorded in a file format, such as the WAVE (RIFF Waveform Audio Format) or mp3 (MPEG Audio Layer-3), for performance sounds having a single tone color and a predetermined length or duration (such as a two-measure, four-measure or eight-measure duration). Note that, in the database are also recorded tone data that are for use in replacement of automatic accompaniment data but currently not used in the automatic accompaniment data.

Further, for a performance part for which a rhythm pattern has been input by the user, the information processing device 20*a* searches through the database for tone data sets having an identical or similar rhythm to the rhythm pattern input via the rhythm input device 10*a* by means of the selection function, and then the information processing device 20*a* displays a list of names of automatic accompaniment data sets having the searched-out tone data set. After that, the information processing device 20*a* outputs sounds based on one of the automatic accompaniment data sets which has been selected by the user from the displayed list. At that time, the information processing device 20*a* repetitively reproduces sounds based on the searched-out tone data sets. Namely, once the user selects one of the automatic accompaniment data sets having been searched out on the basis of the rhythm pattern input by the user for any one of a plurality of performance parts, the information processing device 20*a* audibly reproduces sounds based on the selected automatic accompaniment data set. If any performance part is already selected, then the information processing device 20*a* audibly reproduces sounds based on the selected automatic accompaniment data set after changing (i.e., speeding up or slowing down) the tempo as necessary in such a manner that predetermined timing (e.g., beat timing) is synchronized with that already-selected part. Namely, in the music data creation system 100*a*, a plurality of different performance parts are selected, and the user inputs a rhythm pattern for each of the selected parts so that the database is searched through. Then, the user selects and combines automatic performance data sets of desired parts from among searched-out automatic performance data sets, so that these automatic performance data sets are audibly reproduced in a mutually synchronized manner. Note that switching can be made between ON and OFF states of the search function in response to the user operating the operation section 25.

Figure 10:
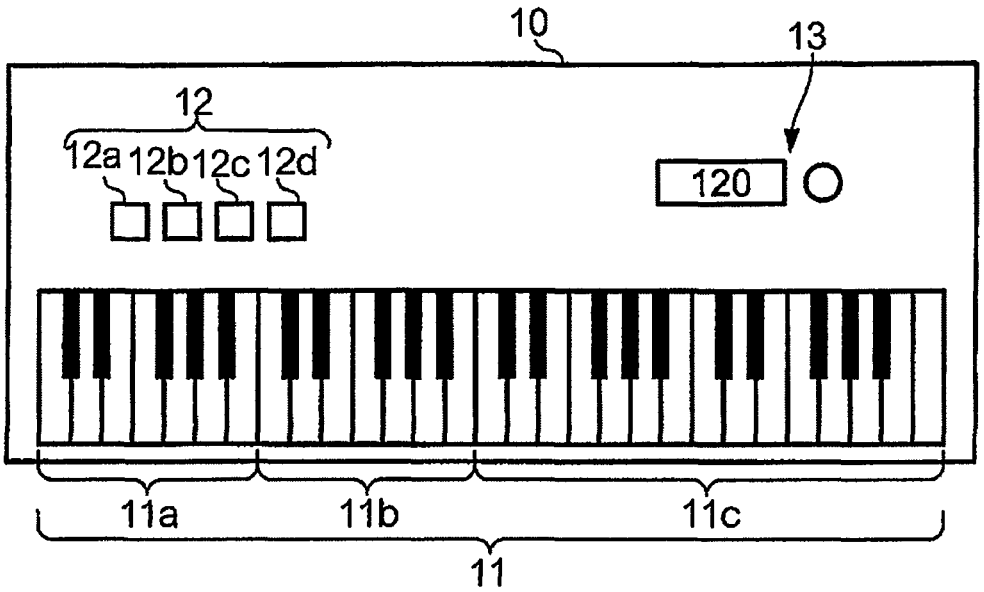
FIG. 10 is a schematic diagram showing an overall setup of a rhythm input device in a second embodiment of the present invention.

FIG. 10 is a schematic diagram showing an overall setup of the rhythm input device 10*a* which includes, as the input means, the keyboard 11 and input pads 12. Once the user inputs a rhythm pattern by use of the input means, the information processing device 20*a* searches for a tone data set on the basis of the user-input rhythm pattern. The aforementioned performance parts are associated respectively with predetermined ranges of the keyboard 11 and types of the input pads 12. For example, the entire key range of the keyboard 11 is divided, at two split points, into a low-pitch key range, medium-pitch key range and high-pitch key range. The low-pitch key range is for use as a bass inputting range keyboard 11*a* with which the bass part is associated. The medium-pitch key range is for use as a chord inputting range keyboard 11*b* with which the chord part is associated. The high-pitch key range is for use a phrase inputting range keyboard 11*c* with which the single-note phrase part is associated. Further, the bass drum part is associated with the bass drum input pad 12*a*, the snare drum part is associated with the snare drum input pad 12*b*, the high-hat part is associated with the high-hat input pad 12*c*, and the cymbal part is associated with the cymbal input pad 12*d*. By executing performance operation after designating any one of the key ranges that is to be depressed on the keyboard 11 or any one of the input pads 12 that is to be depressed, the user can search for and retrieve a tone data set for the performance part associated with the designated input means (key range or pad). Namely, individual regions where the keyboard 11 and the input pads 12 are located correspond to performance controls, such as the keyboard 11 and the input pads 12.

For example, once the user inputs a rhythm pattern by depressing the key range corresponding to the bass inputting range keyboard 11*a*, the information processing device 20*a* identifies a bass tone data set having a rhythm pattern identical to or falling within a predetermined range of similarity to the input rhythm pattern, and then the information processing device 20*a* displays the thus-identified bass tone data set as a searched-out result. In the following description, the bass inputting range keyboard 11*a*, chord inputting range keyboard 11*b*, phrase inputting range keyboard 11*c*, bass drum input pad 12*a*, snare drum input pad 12*b*, high-hat input pad 12*c* and cymbal input pad 12*d* are sometimes also referred to as "performance controls". Once the user operates any one of the performance controls, the rhythm input device 10*a* inputs an operation signal, corresponding to the user's operation, to the information processing device 20*a*. Let it be assumed here that the operation signal is information of the MIDI (Musical Instrument Digital Interface) format; thus, such information will hereinafter be referred to as "MIDI information". Such MIDI information includes, in addition to the aforementioned trigger data and velocity data, a note number if the performance control used is the keyboard, or channel information if the performance control used is one of the pads. The information processing device 20*a* identifies, on the basis of the MIDI information received from the rhythm input device 10*a*, the performance part for which the performance operation has been executed by the user.

Further, the rhythm input device 10*a* includes a BPM input control 13. "BPM" indicates the number of beats per minute and more specifically a tempo of tones notified to the user on the rhythm input device 10*a*. The BPM input control 13 comprises, for example, a display surface, such as a liquid display, and a wheel. Once the user rotates the wheel, a BPM value corresponding to a rotation-stopped position of the wheel (i.e., rotational position to which the wheel has been rotated). The BPM input via the BPM input control 13 will be referred to as "input BPM". The rhythm input device 10*a* inputs, to the information processing device 20*a*, MIDI information, including information identifying the input BPM, together with the input rhythm pattern. Then, on the basis of the input BPM included in the MIDI information, the information processing device 20*a* informs the user of the tempo and performance progression timing, for example, by audibly outputting sounds via the sound output section 26 and/or blinking light on the display section 24 (so-called "metronome function"). Thus, the user can operate the performance control on the basis of the tempo and performance progression timing felt from these sounds or lights.

Figures 11, 12:
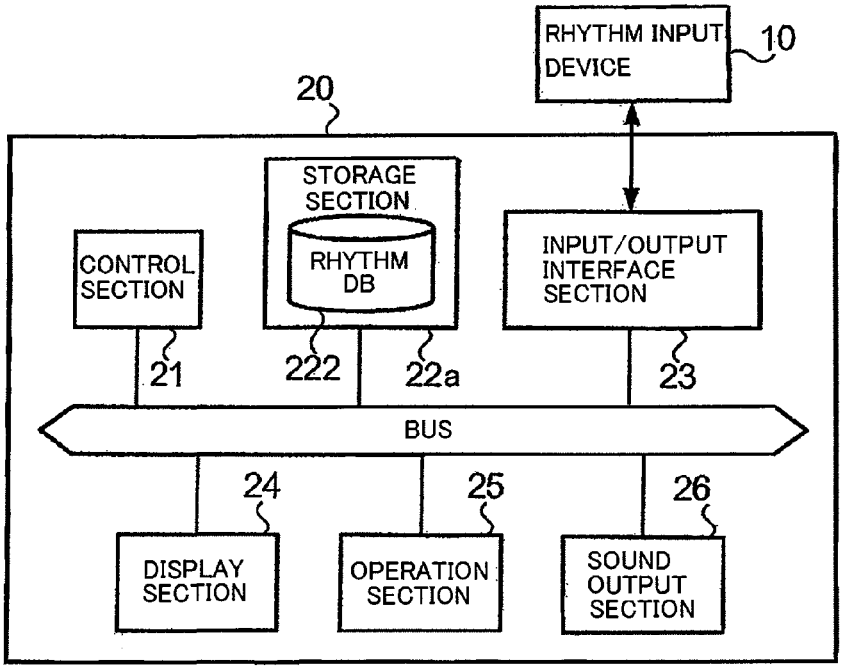
FIG. 11 is a block diagram showing an example hardware setup of an information processing device in the second embodiment of the present invention.
FIG. 12 is a schematic diagram showing contents of tables included in an accompaniment database.

FIG. 11 is a block diagram showing an example general hardware setup of the information processing device 20*a*. The information processing device 20*a* includes the control section 21, the storage section 22*a*, the input/output interface section 23, the display section 24, the operation section 25 and the sound output section 26, which are interconnected via a bus. The control section 21, input/output interface section 23, display section 24, operation section 25 and sound output section 26 are similar to those employed in the above-described first embodiment. The storage section 22*a* includes an automatic accompaniment database (DB) 222, and the accompaniment database 222 contains various information related to automatic accompaniment data sets, tone data sets, and various information related to the tone data sets.

FIGS. 12 and 13 are schematic diagrams showing contents of tables contained in the above-mentioned accompaniment database 222. The accompaniment database 222 includes a part table, musical instrument type table, rhythm category table, rhythm pattern table and automatic accompaniment data table. (a) of FIG. 12 shows an example of the part table. "part ID" in (a) of FIG. 12 is an identifier uniquely identifying a performance part in question constituting an automatic accompaniment data set, and it is represented, for example, by a 2-digit number. "part name" is a name indicative of a type of a performance part. Different part IDs are described in the part table in association with the individual performance parts, "bass", "chord", "phrase", "bass drum", "snare drum", "high-hat" and "cymbal". The part names shown in (a) of FIG. 12 are just illustrative, and any other part names may be used. "note number" is MIDI information indicating which one of the key ranges of the keyboard a performance part is allocated to. According to the MIDI information, note number "60" is allocated to "middle C" of the keyboard. With note number "60" used as a basis, a note number equal to or smaller than a first threshold value "45" is allocated to the "bass" part, a note number equal to or greater than a second threshold value "75" is allocated to the "phrase" part and a note number equal to or greater than "46" but equal to or smaller than "74" is allocated to the "chord" part, as shown in (a) of FIG. 12. Note that the above-mentioned first threshold value "45" and second threshold value "75" are just illustrative and may be changed as necessary by the user.

Further, "channel information" is MIDI information indicating which one of the input pads a performance part is allocated to. In the illustrated example of (a) of FIG. 12, channel information "12*a*" is allocated to the "bass drum" part, channel information "12*b*" is allocated to the "snare drum" part, channel information "12*c*" is allocated to the "high-hat" part, and channel information "12*d*" is allocated to the "cymbal" part.

(b) of FIG. 12 shows an example of the musical instrument type table. "musical instrument type ID" is an identifier uniquely identifying a type of a musical instrument, and the "musical instrument type ID" is represented, for example, by a three-digit number. "musical instrument type" is a name indicative of a type of a musical instrument. For example, different musical instrument type IDs are described in the musical instrument type table in association with individual musical instrument types, such as "wooden bass", "electric bass" and "slap bass". For example, the musical instrument type "wood bass" is described in the musical instrument type table in association with musical instrument type ID "001". Similarly, the other musical instrument types are described in the musical instrument type table in association with their respective musical instrument type IDs. Note that the musical instrument types shown in (b) of FIG. 12 are just illustrative and any other musical instrument types may be used.

(c) of FIG. 12 shows an example of the rhythm category table. "rhythm category ID" is an identifier uniquely identify a category of rhythm pattern (herein also referred to as "rhythm category"), and each "rhythm category ID" is represented, for example, by a two-digit number. Here, each rhythm pattern represents a series of times at which individual sounds are to be audibly generated within a time period of a predetermined time length. Particularly, in the instant embodiment, each "rhythm pattern" represents a series of times at which individual sounds are to be audibly generated within a measure (bar) that is an example of the predetermined time period. "rhythm category" is a name indicative of a rhythm category, and a plurality of unique rhythm category IDs are described in the rhythm category table in association with individual rhythm categories, such as "eighth", "sixteenth" and "eighth triplet". For example, the "eighth" rhythm category is described in the rhythm category table in association with rhythm category ID "01". Note that the rhythm categories shown in (c) of FIG. 12 are just illustrative and any other rhythm categories may be used. For example, there may be employed rougher categorization into beats or genres, or finer categorization achieved by assigning a separate category ID to each rhythm pattern. Alternatively, these categories may be combined to provide a plurality of hierarchical layers of categories.

FIG. 13A shows an example of the rhythm pattern table. In the rhythm pattern table, a plurality of grouped rhythm pattern records are described for each part ID that uniquely identifies a performance part. In FIG. 13A, a plurality of rhythm pattern records of the "bass" part (part ID "01") are shown, as an example of the rhythm pattern table. Each of the rhythm pattern records includes a plurality of items, such as "automatic accompaniment ID", "part ID", "musical instrument type ID", "rhythm category ID", "rhythm pattern ID", "rhythm pattern data", "attack intensity pattern data", "tone data", "key", "genre", "BPM" and "chord". Such a rhythm pattern table is described for each of the performance parts.

"automatic accompaniment ID" is an identifier uniquely identifying an automatic accompaniment data set, and the same automatic accompaniment ID is allocated to a combination of respective rhythm pattern records of individual performance parts. For example, automatic accompaniment data sets having the same automatic accompaniment ID are combined together in advance in such a manner that the automatic accompaniment data sets have the same content for an item, such as "genre", "key" or "BPM", as a result of which an uncomfortable feeling can be significantly reduced when the automatic accompaniment data sets are reproduced in an ensemble for a plurality of performance parts. As noted above, the "musical instrument type ID" is an identifier uniquely identifying a type of a musical instrument. Rhythm pattern records having the same part ID are grouped per musical instrument type ID, and the user can select a musical instrument type by use of the operation section 25 before inputting a rhythm by use of the input device 10*a*. The musical instrument type selected by the user is stored into the RAM. "rhythm category ID" is an identifier identifying which one of the rhythm categories each of the rhythm pattern records belongs to. In the illustrated example of FIG. 13A, the rhythm pattern record of which the "rhythm category ID" is "01" belongs to the "eighth" (i.e., eight-note) rhythm category as indicated in the rhythm category table shown in (c) of FIG. 12. "rhythm pattern ID" is an identifier uniquely identifying a rhythm pattern record, and it is, for example, in the form of a nine-digit number. The nine-digit number comprises a combination of two digits of the "part ID", three digits of the "musical instrument type ID", two digits of the "rhythm category ID" and two digits of a suffix number.

"rhythm pattern data" is a data file having recorded therein generation start times of individual component sounds of a phrase constituting one measure; for example, the rhythm pattern data is a text file having the sound generation start times of the individual component sounds described therein. The sound generation start times correspond to trigger data included in an input rhythm pattern and indicating that performance operation has been executed. Here, the sound generation start time of each of the component sounds is normalized in advance using the length of one measure as a value "1". Namely, the sound generation start time of each of the component sounds described in the rhythm pattern data takes a value in the range from "0" to "1".

The rhythm pattern data may be extracted from a commercially available audio loop material by automatically removing ghostnotes from the material, rather than being limited to the above-mentioned scheme or method where the rhythm pattern data are created by a human operator removing ghostnotes from the commercially available audio loop material. For example, in a case where data from which rhythm pattern data are extracted are in the MIDI format, rhythm pattern data may be created by a computer in the following manner. A CPU of the computer extracts generation start times of channel-by-channel component sounds from the MIDI-format data for one measure and removes ghostnotes (such as those having extremely small velocity data) that are difficult to be judged as rhythm inputs. Then, if there are a plurality of inputs, like chord inputs, within a predetermined time period in the MIDI-format data having the ghostnotes removed therefrom, then the CPU of the computer automatically creates rhythm pattern data by performing a process for organizing or combining the plurality of inputs into one rhythm input.

Further, for the drum parts, sounds of a plurality of musical instruments, such as the bass drum, snare drum and cymbals may sometimes exist within one channel. In such a case, the CPU of the computer extracts rhythm pattern data in the following manner. Further, for the drum parts, musical instrument sounds are, in many cases, fixedly allocated in advance to various note numbers. Let it be assumed here that a tone color of the snare drum is allocated to note number "40". On the basis of such assumption, the CPU of the computer extracts, in the channel having recorded therein the drum parts of the accompaniment sound sources, rhythm pattern data of the snare drum by extracting sound generation start times of individual component sounds of the note number to which tone color of the snare drum is allocated.

"attack intensity pattern data" is a data file having recorded therein attack intensity of individual component sounds of a phrase constituting one measure; for example, the attack intensity pattern data is a text file having the sound generation start times of the individual component sounds described therein as numerical values. The attack intensity corresponds to velocity data included in an input rhythm pattern and indicative of intensity of user's performance operation. Namely, each attack intensity represents an intensity value of a component sound of a phrase. The attack intensity may be described in a text file as velocity data itself of MIDI information.

"tone data" is a name of a data file pertaining to sounds themselves based on a rhythm pattern record; for example, the "tone data" represents a file of tone data in a sound file format, such as the WAVE or mp3. "key" represents a tone pitch (sometimes referred to simply as "pitch") functioning as a basis for pitch-converting tone data. Because a value of the "key" indicates a note name within a particular octave, the "key", in effect, represents a pitch of the tone data. "genre" represents a musical genre which a rhythm pattern record belongs to. "BPM" represents the number of beats per minute and more particularly a tempo of sounds based on a tone data set included in a rhythm pattern record.

"chord" represents a type of a chord of tones represented by tone data. Such a "chord" is set in a rhythm pattern record of which the performance part is the chord part. In the illustrated example of FIG. 13A, "Maj7" is shown as an example of the "chord" in a rhythm pattern record of which the "part ID" is "02". A rhythm pattern record of which the performance part is the "chord" part has a plurality of types of "chords" for a single rhythm pattern ID, and tone data corresponding to the individual "chords". In the illustrated example of FIG. 13A, a rhythm pattern record of which the rhythm pattern ID is "020040101" has tone data corresponding to a plurality of chords, such as "Maj", "7", "min", "dim", "Sus4" (not shown). In this case, rhythm pattern records having a same rhythm pattern ID each have same contents except for the "tone data" and "chord". In this case, each of the rhythm pattern records may have a tone data set comprising only root notes of individual chords (each having the same pitch as the "key") and a tone data set comprising individual component sounds, excluding the root notes, of the individual chords. In this case, the control section 21 simultaneously reproduces tones represented by the tone data set comprising only root notes of individual chords and the tone data set comprising individual component sounds, excluding the root notes, of the individual chords. FIG. 13A shows, by way of example, the rhythm pattern record of which the performance part is the "bass" part; actually, however, rhythm pattern records corresponding to a plurality of types of performance parts (in this case, chord, phrase, bass drum, snare drum, high-hat and cymbals) are described in the rhythm pattern table, as partly shown in FIG. 13A.

FIG. 13B shows an example of the automatic accompaniment data table. This automatic accompaniment data table is a table defining, per performance part, under which conditions and which tone data are to be used in an automatic accompaniment. The automatic accompaniment data table is constructed in generally the same manner as the rhythm pattern table. An automatic accompaniment data set described in a first row of the automatic accompaniment data table comprises a combination of particular related performance parts and defines information related to an automatic accompaniment in an ensemble performance. In order to be distinguished from the other data, the information related to an automatic accompaniment in an ensemble performance is assigned a part ID "99", musical instrument type ID "999" and rhythm pattern ID "999990101". These values indicate that the automatic accompaniment data set in question comprises data of an ensembled automatic accompaniment. Further, the information related to an automatic accompaniment during an ensemble performance includes one tone data set "Bebop01.wav" synthesized by combination of tone data sets of individual performance parts. In reproduction, the tone data set "Bebop01.wav" is reproduced with all of the performance parts combined together. Note that a file that permits a performance of the plurality of performance parts with a single tone data set as an automatic accompaniment data set is not necessarily required. If there is no such file, no information is described in a "tone data" section of the information related to an automatic accompaniment. Further, a rhythm pattern and attack intensity based on tones of the ensembled automatic accompaniment (i.e., Bebop01.wav). are described in "rhythm pattern data" and "attack intensity pattern data" sections, respectively, in the information related to an automatic accompaniment, Further, an automatic accompaniment data set in a second row represented by a part ID "01" and automatic accompaniment data sets in rows following the second row represent contents selected by the user on a part-by-part basis. In this example, particular musical instruments are designated by the user for individual performance parts of part IDs "01" to "07", and then automatic accompaniment data sets in a "BeBop" style are selected by the user. Further, in the illustrated example of FIG. 13B, no "key" is designated for performance parts corresponding to rhythm musical instruments. In the illustrated example of FIG. 13B, no "key" is designated for performance parts corresponding to rhythm musical instruments. However, when tone pitch conversion is to be performed, a tone pitch functioning as a basis (i.e., basic pitch) for the tone pitch conversion may be designated so that a pitch of tone data is converted in accordance with an interval between a designated pitch and the basic pitch.

Figure 14:
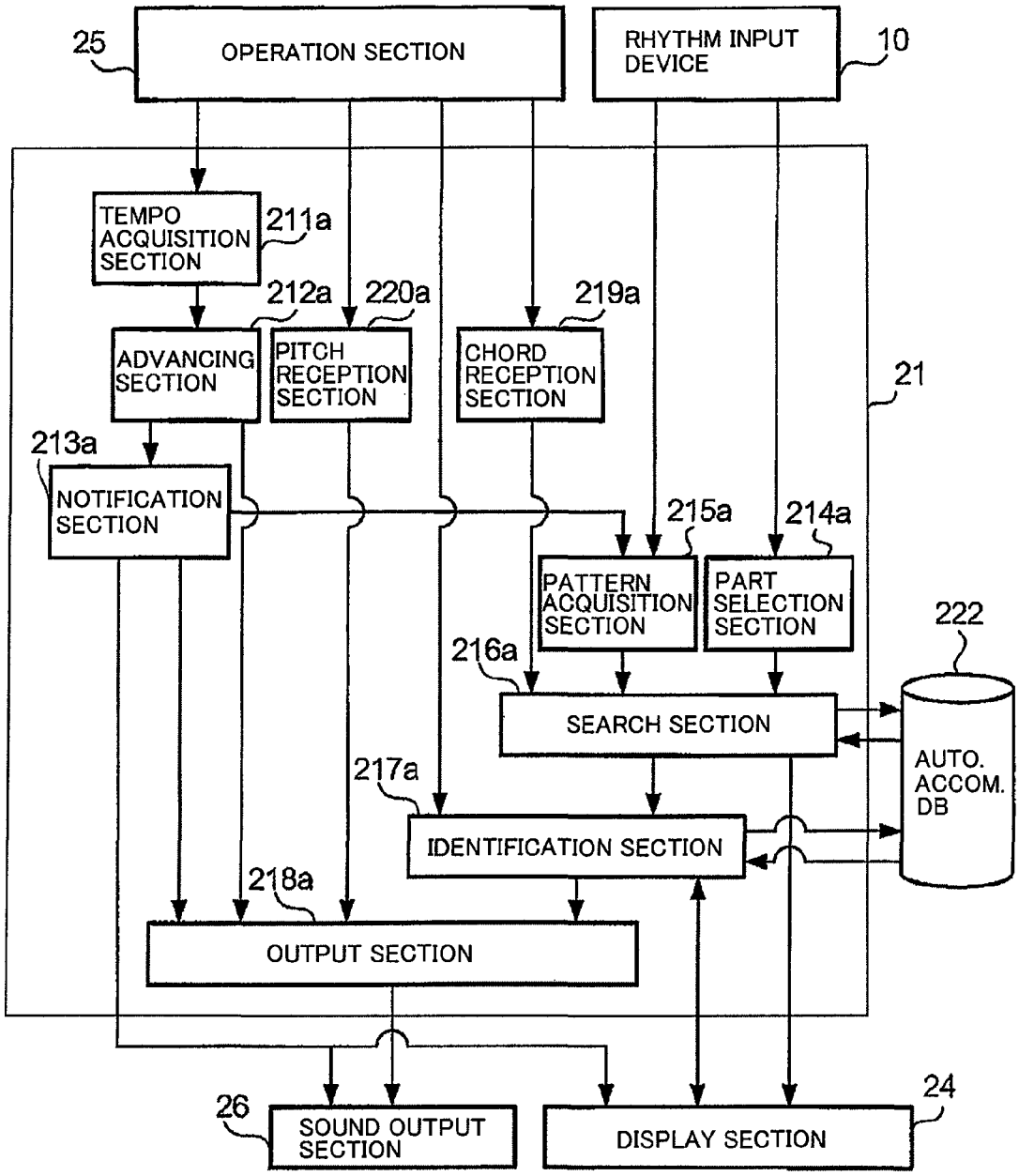
FIG. 14 is a block diagram showing functional arrangements of the information processing device and other components around the information processing device in the second embodiment of the present invention.

FIG. 14 is a block diagram showing functional arrangements of the information processing device 20*a* and other components around the information processing device 20*a*. The control section 21 reads out individual programs, constituting the application stored in the ROM or storage section 22, into the RAM, and executes the read-out programs to thereby implement respective functions of a tempo acquisition section 211*a*, advancing section 212*a*, notification section 213*a*, part selection section 214*a*, pattern acquisition section 215*a*, search section 216*a*, identification section 217*a*, output section 218*a*, chord reception section 219*a* and pitch reception section 220*a*. Although the following describe various processing as being performed by the above-mentioned various sections, a main component that performs the processing is, in effect, the control section 21. In the following description, the term "ON-set" means that the input state of the rhythm input device 10*a* is switched from OFF to ON. For example, the term "ON-set" means that a key has been depressed if a keyboard is the input means of the rhythm input device 10*a*, that a pad has been hit if the pad is the input means of the rhythm input device 10*a*, or that a button has been depressed if the button is the input means of the rhythm input device 10*a*. The term "OFF-set", on the other hand, means that a key has been released from the depressed state if the keyboard is the input means of the rhythm input device 10*a*, that hitting of the pad has been completed if the pad is the input means of the rhythm input device 10*a*, or that a finger has been released from the button if the button is the input means of the rhythm input device 10*a*. Further, in the following description, the term "ON-set time" indicates a time point at which the input state of the rhythm input device 10*a* has been changed from OFF to ON. In other words, the "ON-set time" indicates a time point at which trigger data has been generated in the rhythm input device 10*a*. The term "OFF-set time", on the other hand, indicates a time point at which the input state of the rhythm input device 10*a* has been changed from ON to OFF. In other words, the "OFF-set time" indicates a time point at which generated trigger data has disappeared in the rhythm input device 10*a*. Furthermore, in the following description, the term "ON-set information" is information input from the rhythm input device 10*a* to the information processing device 20*a* at the ON-set time. The "ON-set information" includes, in addition to the above-mentioned trigger data, a note number of the keyboard information, channel information, and the like.

The tempo acquisition section 211*a* acquires a BPM designated by the user, i.e. a user-designated tempo. Here, the BPM is designated by the user using at least one of the BPM input control 13 and a later-described BPM designating slider 201. The BPM input control 13 and the BPM designating slider 201 are constructed to operate in interlocked relation to each other, so that, once the user designates a BPM using one of the BPM input control 13 and the BPM designating slider 201, the designated BPM is displayed on a display section of the other of the BPM input control 13 and the BPM designating slider 201. Upon receipt of a tempo notification start instruction given by the user via a not-shown switch, the advancing section 212*a* advances a current position (performance progression timing) within a measure from (i.e., starting with) the time point when the instruction has been received. The notification section 213*a* notifies the current position within the measure. More specifically, in the case where each component sound is normalized using the length of one measure as "1", the notification section 213*a* outputs, to the pattern acquisition section 215 once every several dozens of msec (milliseconds), the current position located on the advancing time axis, as a clock signal (hereinafter referred to as "bar line clock signal"). Namely, the bar line clock indicates where in the measure the current time is located, and it takes a value in the range from "0" to "1". The notification section 213*a* generates bar line clock signals on the basis of a tempo designated by the user.

The part selection section 214*a* selects a particular performance part on the basis of user's designation from among a plurality of performance parts. More specifically, the part selection section 214*a* identifies whether performance-part identifying information included in MIDI information input from the rhythm input device 10*a* is a note number or channel information. Then, the part selection section 214*a* determines, on the basis of the identified information and the part table included in the automatic accompaniment database (DB) 222, which of the performance controls has been operated by the user, i.e. which of a plurality of performance parts, constituting a tone data set, has been designated by the user for rhythm pattern input, and then the part selection section 214*a* selects tone data sets, rhythm pattern table, etc. of the performance part to be subjected to search processing. If the received MIDI information is a note number, the part selection section 214*a* compares the received note number and the described content of the part table to thereby determine which of the bass inputting range keyboard 11*a*, chord inputting range keyboard 11*b* and phrase inputting range keyboard 11*c* the user's operation corresponds to, and then the part selection section 214*a* selects tone data sets, rhythm pattern table, etc. of the corresponding performance part. Further, if the received MIDI information is channel information, the part selection section 214*a* compares the received MIDI information and the described content of the part table to thereby determine which of the bass drum input pad 12*a*, snare drum input drum 12*b*, high-hat input pad 12*c* and cymbal input pad 12*d* the user's operation corresponds to, and then the part selection section 214*a* selects tone data sets, rhythm pattern table, etc. of the corresponding performance part. The part selection section 214*a* outputs, to the search section 216*a*, the part ID corresponding to the selected performance part.

The pattern acquisition section 215*a* acquires an input pattern for a particular performance from among a plurality of performance parts. More specifically, using the pattern acquisition section 215*a* stores, on the basis of the bar line clock, individual time points where trigger data has occurred (i.e. individual ON-set times), input from the rhythm input device 10*a*, into the RAM per measure. A series of the ON-set times thus stored in the RAM per measure constitutes an input rhythm pattern. Because each of the ON-set times stored in the RAM is based on the bar line clock, it takes a value in the range from "0" to "1" just like the bar line clock. Bar line clock signals input from an external source to the information processing device 20*a* may be used as the above-mentioned bar line clock signals.

In order for the user to accurately input a rhythm pattern per measure, a time point when a bar line starts has to be fed back to the user from the information processing device 20*a*. For that purpose, it is only necessary that the position of the bar line be visually or audibly indicated to the user by the information processing device 20 generating a sound or light or changing displayed content on a display screen per measure and/or beat, for example, like a metronome. At that time, the sound output section 26 generates sounds or the display section 24 generates lights on the basis of the bar line clock signals output from the notification section 213*a*. Alternatively, the output section 218*a* may audibly reproduce, in accordance with the bar line clock signals, accompaniment sounds having click sounds, each indicative of the position of the bar line, added thereto in advance. In this case, the user inputs a rhythm pattern in accordance with the bar line felt by the user from the accompaniment sound source.

The search section 216*a* searches through the automatic accompaniment database 222 having stored therein a plurality of tone data sets each comprising data of tones, to thereby acquire tone data sets as searched-out results on the basis of a result of comparison between a rhythm pattern of tones included in each of tone data sets of a particular performance part and the input rhythm pattern. Further, the search section 216*a* displays the searched-out results on the display section 24 so that the user selects a desired tone data set from among the acquired tone data sets, and then the search section 216*a* registers the user-selected tone data set as automatic accompaniment part data of a performance part in an automatic accompaniment data set. By repeating such operations for each performance part, the user can create an automatic accompaniment data set. The automatic accompaniment database 222 comprises separate tone data sets and automatic accompaniment data sets corresponding to a plurality of performance parts, and a plurality of tables for managing information of the respective data. In reproduction of tone data and automatic accompaniment data sets, the output section 218*a* reads out tone data identified from a current position within a measure, i.e. a data position based on the bar line clock, then reproduces a tone represented by the read-out tone data at a speed, based on relationship between a performance tempo associated with the tone data and a designated tempo, and then outputs a reproduction signal of the tone to the sound output section 26. The sound output section 26 audibly outputs a sound based on the reproduction signal. Further, the output section 218*a* controls user's performance operation using component sounds of the searched-out and selected tone data set in the performance reproduction mode and performance loop reproduction mode. Further, the chord reception section 219*a* receives input of a user-designated chord. The pitch reception section 220*a* receives input of tone pitch information indicative of pitches of user-designated sounds.

Figure 15:
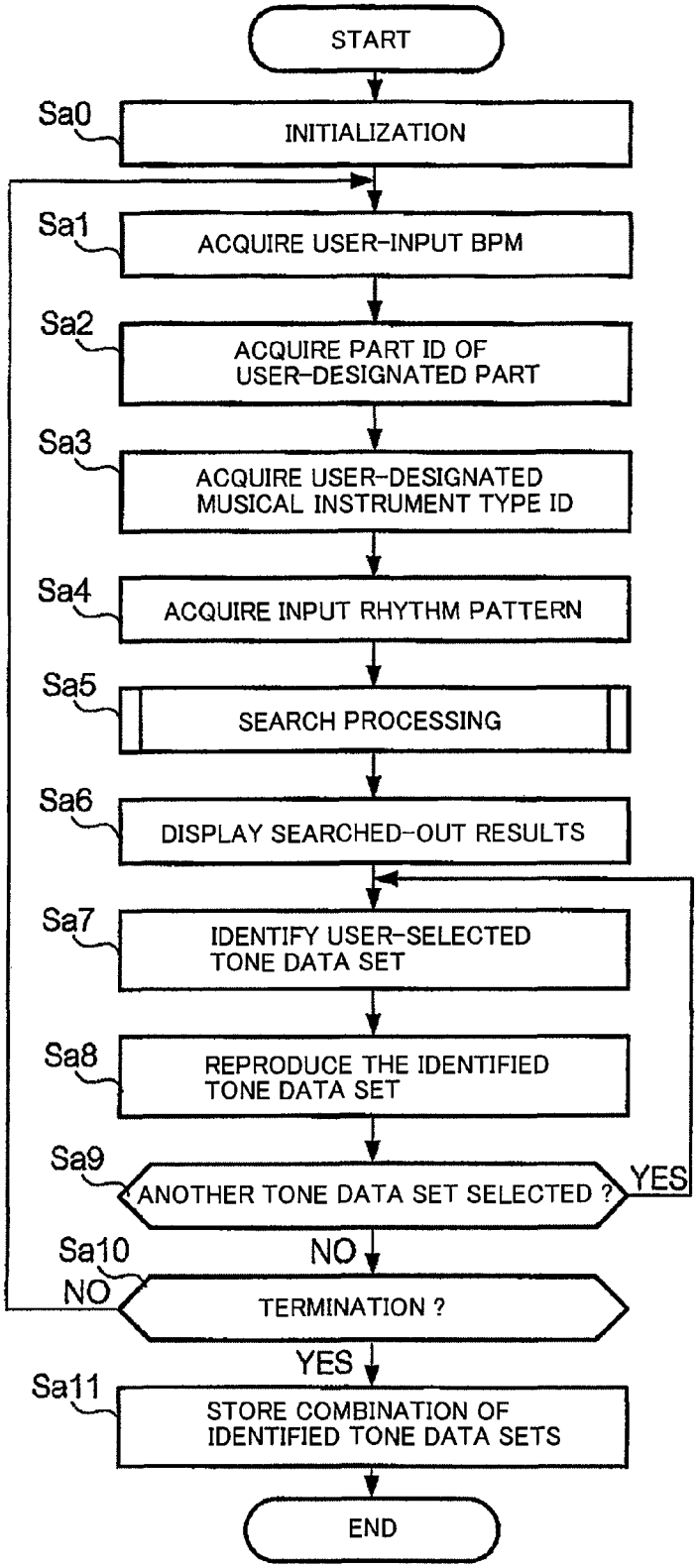
FIG. 15 is a flow chart showing an example operational sequence of processing performed by the information processing device in the second embodiment of the present invention.
Figure 16:
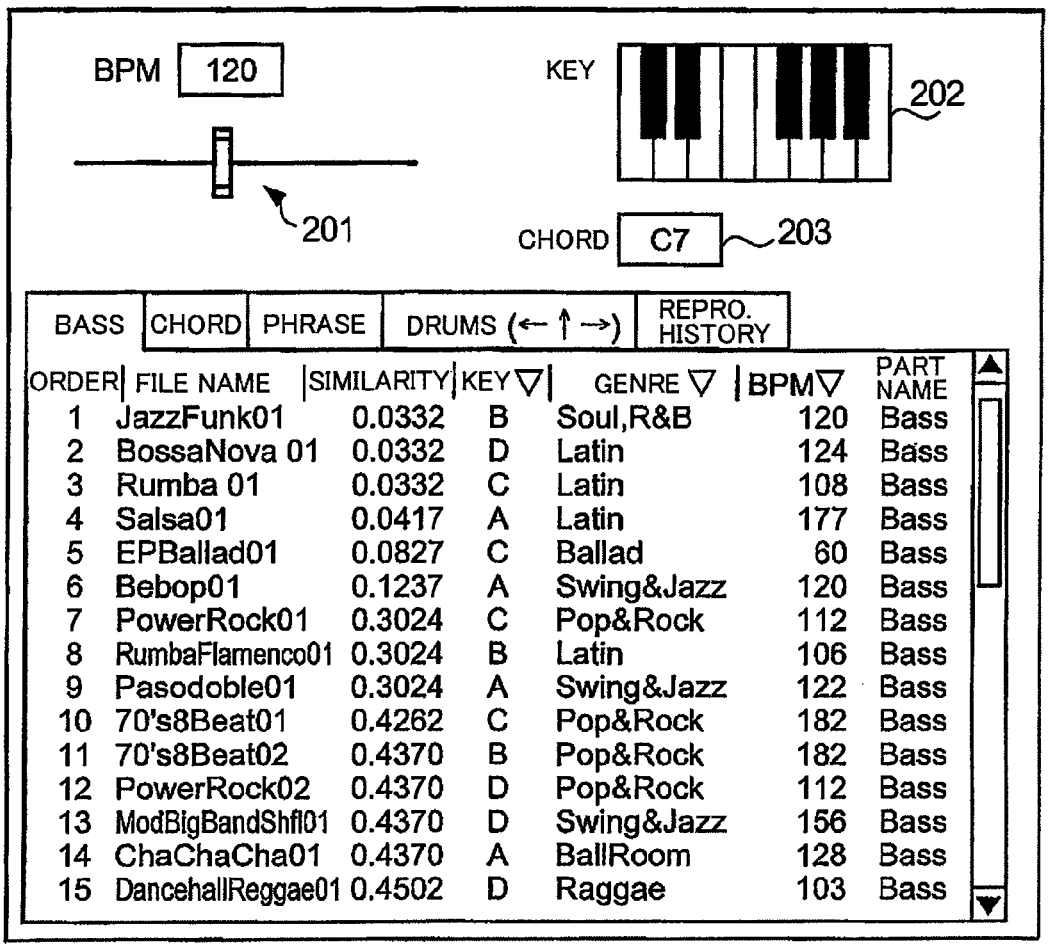
FIG. 16 is a schematic diagram showing an example of searched-out results of automatic accompaniment data.

With reference to FIGS. 15 and 16, the following describe an example operational sequence of processing performed by the control section 21 for searching for an automatic accompaniment data set on the basis of an input rhythm pattern while the search function is ON. FIG. 15 is a flow chart showing an example operational sequence of processing performed by the information processing device 20*a*. Once the user instructs creation of an automatic accompaniment data set via a not-shown control of the rhythm input device 10*a*, a program of this processing is executed. On the basis of the user's instruction, the information processing device 20*a* performs an initialization process at step Sa0 following the start of the program. In the initialization process, the user uses the operation section 25 to designate musical instrument types corresponding to the individual key ranges and musical instrument types corresponding to the input pads, and uses the BMP input control 13 to input a BPM. Further, the control section 21 reads out the various tables shown in FIGS. 12, 13A and 13B into the RAM. After the initialization process, the user uses the rhythm input device 10*a* to designate any one of the predetermined key ranges of the keyboard 11 or any one of the input pads 12*a* to 12*d*, i.e. designate a performance part, and inputs a rhythm pattern for the designated part. The rhythm input device 10*a* transmits, to the information processing device 20*a*, MIDI information including information identifying the designated performance part, information identifying the designated musical instrument type, information identifying the input BPM and the input rhythm pattern. Once the control section 21 receives the MIDI information from the rhythm input device 10*a* via the input/output interface section 23, it performs the processing in accordance with the flow shown in FIG. 15.

First, at step Sa1, the control section 21 acquires the user-input information identifying the input BPM and stores the acquired BPM as a BPM of an automatic accompaniment data set to be recorded in the automatic accompaniment table read out into the RAM. Then, at step Sa2, the control section 21 acquires the part ID of the user-selected performance part on the basis of the information identifying the user-selected performance part, such as the note number or channel information, included in the received MIDI information, and then stores the acquired part ID as a part ID of a performance part to be recorded in the part table and automatic performance table in the RAM. Let it be assumed here that, in response to the user inputting a rhythm pattern using the bass inputting range keyboard 11*a*, the control section 21 has acquired "01" as the part ID as shown in (a) of FIG. 12 and then stored the acquired the part ID "01" into the RAM at step Sa2.

Then, once the control section 21 acquires a musical instrument type ID of the user-designated musical instrument type on the basis of the information identifying the designated musical instrument type included in the received MIDI information and the musical instrument type table included in the automatic accompaniment database 211, its stores the acquired musical instrument type ID as a musical instrument type ID of a performance part to be recorded in the musical instrument type table and automatic performance table read out in the RAM, at step Sa3. Let it be assumed here that, in response to the user using the operation section 25 to designate "electric bass" as the musical instrument type, the control section 21 has acquired "002" as the musical instrument type ID as shown in (b) of FIG. 12 and has stored "002" as the musical instrument type ID of a performance part to be recorded in the automatic performance table read out in the RAM. Then, once the control section 21 acquires the input rhythm pattern included in the received MIDI information, it stores the acquired input rhythm pattern into the RAM at step Sa4. After that, for the user-designated performance part and musical instrument type, the control section 21 searches through the automatic accompaniment database 222 for tone data sets identical or similar to the input rhythm pattern, at step Sa5. At step Sa5, the same process described above in relation to the first embodiment with reference to FIG. 5 is performed.

At step Sb8 of FIG. 5, on the basis of the rhythm pattern table of the selected performance part and the input rhythm pattern, the control section 21 acquires, as searched-out results, a predetermined number of tone data sets in ascending order of the similarity distance from among tone data sets having rhythm pattern data small in distance from the input rhythm pattern, and the control section 21 stores the predetermined number of tone data sets into the RAM and then brings the processing of FIG. 5 to an end. The "predetermined number" may be stored in advance as a parameter in the storage section 22*a* and may be made changeable by the user using the operation section 25. Here, the control section 21 has a filtering function for outputting, as searched-out results, only tone data sets having a BPM close to the user-input BPM, and the user can turn on or off the filtering function as desired via the operation section 25. When the filtering function is ON, the control section 21, at step Sb8, excludes, from the searched-out results, tone data sets having a BPM whose difference from the input BPM does not fall within a predetermined range. More specifically, the control section 21, at step Sb8, for example acquires, as the searched-out results, only tone data sets having a BPM in the range of $(1/2^{1/2})$ times to $2^{1/2}$ times of the input BPM, excluding the other tone data sets from the searched-out results. Note that the coefficients "$(1/2^{1/2})$ times" and "$2^{1/2}$ times" are just illustrative and may be any other values.

The reason why the control section 21 has such a filtering function is as follows. The control section 21 in the second embodiment can reproduce tones of any of the tone data sets, acquired as the searched-out results, with the user-input BPM or user-designated BPM. If a BMP greatly different from an original BPM of a tone data set is input by the user, then tones of the tone data set would undesirably give an uncomfortable feeling to the user etc. when audibly output by the sound output section 26. For example, let's assume a case where the user inputs a rhythm pattern at a tempo of a BPM "240" and where an original BPM represented by a tone data set, included among tone data sets acquired as a result of searching for tone data sets having the aforementioned rhythm pattern, is "60". In this case, tones based on the tone data set included among the searched-out results are audibly output by the sound output section 26 with a BPM four time as many as the original BPM, namely, the tones based on the tone data set are reproduced in a fast-forward fashion with a BPM four time the original BPM, as a result of which an uncomfortable feeling would be given to the user. Further, if the tone data set is an audio file of the WAVE or mp3 format, reproduced sound quality would deteriorate as a difference between the original BPM and the user-designated BPM increases. To avoid such an inconvenience, the control section 21 in the second embodiment has the filtering function.

Referring back to FIG. 15, upon completion of the search operation at step Sa5, the control section 21 displays the tone data sets, stored in the RAM at step Sb8, on the display section 24 (step Sa6).

FIG. 16 is a schematic diagram showing an example of the searched-out results of tone data sets. More specifically, FIG. 16 shows a case where tone data sets, acquired as search results by the control section 21 on the basis of a rhythm pattern input by the user using the bass inputting range keyboard 11*a*, are displayed on the display section 24. In an upper area of the display section 24 are displayed the BPM designating slider 201, key (musical key) designating keyboard 202 and chord designating box 203. The BPM designating slider 201 comprises, for example, a groove portion of a predetermined length, a knob provided in the groove portion, and a BPM display portion. As the user changes a position of the knob by use of the operation section 25, the control section 21 displays, on the BPM display portion, a BPM corresponding to the changed (changed-to) position of the knob. In the illustrated example of FIG. 16, the BPM displayed on the display portion becomes greater (quicker) as the knob is moved in a direction from the left end toward the right end of the groove portion, but becomes smaller (slower) as the knob is moved from in a direction the right end toward the left end of the groove portion. The control section 21 reproduces, with the BPM designated via the BPM designating slider 201 (hereinafter referred to as "designated BPM"), tones, represented by a tone data set included in a group of tone data sets selected by the user from among the searched-out results. Namely, the control section 21 synchronizes a BPM of the tone data set, included in the group of tone data sets selected by the user from among the searched-out results, to the designated BPM. Alternatively, if the information processing device 20 is connected with an external device in synchronized relation with the latter, the information processing device 20 may receive a BPM designated in the external device and use the received BPM as the designated BPM. Further, in such a case, the BPM designated via the BPM designating slider 201 may be transmitted to the external device.

The key designating keyboard 202 is an image simulating a keyboard having a predetermined pitch range (one octave in this case) allocated thereto, and corresponding tone pitches are allocated to individual keys of the key designating keyboard 202. In response to the user designating a key via the operation section 25, the control section 21 acquires the tone pitch allocated to the designated key and stores the acquired tone pitch into the RAM. Then, the control section reproduces, with the key designated via the key designating keyboard 202, tones, represented by the tone data included in the tone data set selected by the user from among the searched-out results. Namely, the control section 21 synchronizes the key of tone data included in the tone data set selected by the user from among the searched-out results, to the designated key. Alternatively, if the information processing device 20 is connected with an external device in synchronized relation with the latter, the information processing device 20 may receives a key designated in the external device and use the received key as the designated key. Further, in such a case, the key designated via the key designating slider 202 may be transmitted to the external device.

The chord designating box 203 is an input box 203 for receiving input of a chord designated by the user. Once the user designates and inputs a chord type, such as "Maj7", using the operation section 25, the control section 21 stores the input chord type into the RAM as a designated chord. The control section 21 acquires, as a searched-out result, a tone data set having the chord type designated via the chord designating box 203 from among the searched-out results. The chord designating box 203 may display a pull-down list of chord names to permit filtered display. Alternatively, if the information processing device 20 is connected with an external device in synchronized relation with the latter, the information processing device 20 may receive a chord designated in the external device and use the received chord as the designated chord. Further, in such a case, the chord designated via the chord designating box 203 may be transmitted to the external device. As another form of chord input, buttons may be displayed on the display section in corresponding relation to various chord types so that any one of the displayed chord types may be designated by the user clicking on a corresponding one of the displayed buttons.

A list of tone data sets searched-out as above is displayed on a lower region of the display section 24. The user can display a listing of searched-out tone data sets per performance part by designating, in the aforementioned list of searched-out results, any one of tabs indicative of different performance parts (hereinafter referred to as "part tabs"). If the part tab of the drums has been designated by the user, the user can further use the operation section (keyboard in this case) 25 to depress any one of keys having upward, rightward and leftward arrows allocated thereto, in response to which the control section 21 displays searched-out results of one of the performance parts, such as the bass drum, high-hat and cymbals, that corresponds to the user-depressed part tab. Among the part tabs is one labeled "reproduction history" with which, of the searched-out results, tone data sets having heretofore been selected by the user and then audibly reproduced are displayed. In addition to the aforementioned tabs, a tab labeled "automatic accompaniment data" may be provided for displaying a list of automatic accompaniment data sets each comprising a registered combination of waveform data of individual performance parts desired by the user, so that the user can subsequently search for any one of the registered automatic accompaniment data sets.

In the searched-out results, item "order" represents ascending ranking order, among the searched-out tone data sets, of similarity to an input rhythm pattern. Item "file name" represents a file name of each individual one of the searched-out tone data sets. Item "similarity" represents, for each of the searched-out tone data sets, a distance, from the input rhythm pattern, a rhythm pattern of the tone data set. Namely, a smaller value of the "similarity" represents a smaller distance from the input rhythm pattern and hence a higher degree of similarity to the input rhythm pattern. In displaying the searched-out results, the control section 21 displays the respective names of the tone data sets and related information in the ascending order of the degree of similarity. Item "key" represents, for each of the searched-out tone data sets, a basic pitch to be used for pitch-converting the tone data set; note that the "key" for a tone data set of a performance part corresponding to a rhythm musical instrument is displayed as "undesignated". Item "genre" represents, for each of the searched-out tone data sets, a genre which the tone data set belongs to. Item "BPM" represents, for each of the searched-out tone data sets, a BPM of the tone data set and more specifically an original BPM of tones represented by the tone data set. "part name" represents, for each of the searched-out tone data sets, a name of a performance part identified by the part ID included in the tone data set. Here, the user can display the searched-out results after filtering the results using at least one of the items "key", "genre" and "BPM".

Referring again back to FIG. 15, once the user selects one of the tone data sets displayed as the searched-out results and performs double-click on the selected tone data set using, for example, the mouse, the control section 21 identifies the user-selected tone data set as a data set of one of the performance parts of an automatic accompaniment data set being currently created, and then records the identified data set into a row, corresponding to the performance part, of the automatic accompaniment data table of the RAM (step Sa7). At that time, the control section 21 displays, on the display screen of the searched-out results, the background of the selected and double-clicked tone data set in a different color from the background of the other or non-selected tone data sets.

Then, the control section 21 reads out, from data positions based on the bar line clock, tone data of the individual performance parts identified and registered in the automatic accompaniment data table at step Sa7, and then audibly reproduces the tone data after performing a time-stretch process, and pitch conversion as necessary, on tones represented by the tone data in such a manner that the tone data are reproduced at a speed based on relationship between BPMs associated with the individual tone data and the user-designated BPM, i.e. that the BPMs of the identified tone data are synchronized to the user-designated BPM (step Sa8). The aforementioned input BPM is used as the user-designated BPM at the first execution of the search. Then, if the user has designated a BPM via the BPM designating slider 201 with regard to the searched-out results, the thus-designated BPM is used. As an alternative, the control section 21 may read out the tone data from the head of the bar line rather than data positions based on the bar line clock.

Figure 17:
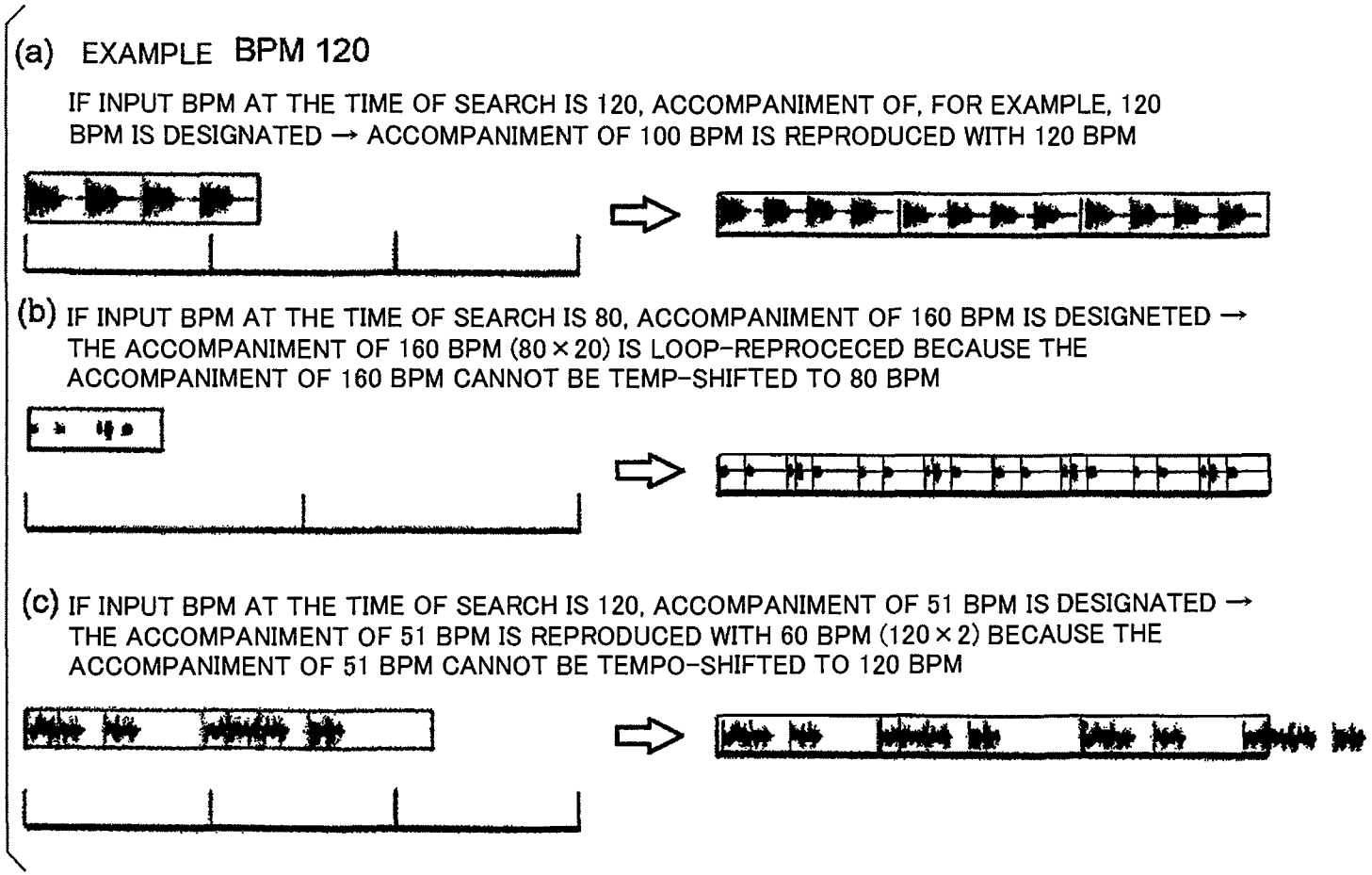
FIG. 17 is a schematic diagram explanatory of BPM synchronization processing.

FIG. 17 is a schematic diagram explanatory of BPM synchronization processing. Although the time-stretch process may be performed in the well-known manner, it may also be performed as follows. If the tone data set is an audio file of the WAVE, mp3 or the like format, reproduced sound quality of the tone data set would deteriorate as a difference between the BPM of the tone data set and the user-designated BPM becomes greater. To avoid such an inconvenience, the control section 21 performs the following operations. If "(BPM of the tone data$\times(\frac{1}{2}^{1/2})$)<(user-designated BPM)<(BPM of the tone data$\times 2^{1/2}$)", the control section 21 performs the time-stretch process on the tone data such that the BPM of the tone data equals the user-designated BPM ((a) of FIG. 17). Further, if "(user-designated BPM)<(BPM of the tone data$\times(\frac{1}{2}^{1/2})$)", the control section 21 performs the time-stretch process on the tone data set such that the BPM of the tone data equals two times of the user-designated BPM ((b) of FIG. 17). Furthermore, if "(BPM of the tone data$\times 2^{1/2}$)<(user-designated BPM)", the control section 21 performs the time-stretch process on the tone data such that the BPM of the tone data equals half of the user-designated BPM ((c) of FIG. 17). In the aforementioned manner, it is possible to minimize the possibility of a situation where reproduced sound quality of the tone data will deteriorate due to a great difference between the BPM of the tone data and the user-designated BPM. Note that the coefficients "$(\frac{1}{2}^{1/2})$" and "$2^{1/2}$" just illustrative and may be any other values. In the aforementioned manner, it is possible to maintain, within a predetermined range, variation of a length of a sound extended by the time stretch process, when a difference between an ON-set time and an OFF-set time in the user input rhythm pattern has become great because of a long time of key depression by the user or, conversely, has become small because of a short time of key depression by the user. As a result, it is possible to significantly reduce an uncomfortable feeling which the user would feel from the searched-out results responsive to the input rhythm pattern will give the user a less uncomfortable feeling.

Further, when the user has designated a key via the key designating slider 202, the control section 21 reproduces the tone data set after pitch-converting tones, represented by the tone data set, in accordance with a difference between the key associated with the tone data set and the designated key, i.e. synchronizing the key of the identified tone data set to the designated key. For example, if the key associated with the tone data set is "C" and the designated key is "A", there are two available approaches of raising the pitches of the identified tone data set and lowering the pitch of the identified tone data set. The instant embodiment employs the approach of raising the pitches of the identified tone data set, because pitch shift amounts required in this case are relatively small and less deterioration of sound quality can be expected.

FIG. 18 is a diagram showing a key table that is stored in the storage section 22*a*. In the key table are described names of keys in each of which one octave is represented by a twelve-note scale, and key numbers consecutively assigned to the individual keys. In performing pitch conversion, the control section 21 references the key table and calculates a predetermined value by subtracting a key number corresponding to the designated key from a key number corresponding to the key associated with the identified tone data set. Such a predetermined value will hereinafter be referred to as "key difference". Then, if "$-6 \leq$key difference$\leq 6$", the control section 21 pitch-converts the identified tone data in such a manner that the frequency of the tone becomes "$2^{(key\ difference/12)}$", Further, if "key difference>7", the control section 21 pitch-converts the identified tone data in such a manner that the frequency of the tone becomes "$2^{(key\ difference-12)/12}$". Further, if "key difference<−7", the control section 21 pitch-converts the identified tone data in such a manner that the frequency of a tone represented by the tone data becomes "$2^{(key\ difference+12)/12}$". The control section 21 causes the tone, represented by the pitch-converted tone data, to be audibly output via the sound output section 26. The aforementioned mathematical expressions are illustrative, and they may be predetermined so as to ensure reproduced sound quality.

Further, when the user has designated a chord via the chord designating box 203, the control section 21 reproduces tone data having been pitch-converted in accordance with the designated chord in the tone data set selected from among the searched-out results. Namely, the control section 21 reproduces the chord of the identified tone data after pitch-converting the chord of the identified tone data to the designated chord.

Once the user selects and double-clicks on another tone data set from among the searched-out results (YES determination at step Sa9) following step Sa8, the control section 21 reverts to step Sa1. In this case, the control section 21 identifies the newly selected tone data set as one of the performance parts of the automatic accompaniment data set being currently created (step Sa7), and then it performs the operation of step sa8. Note that tone data sets can be registered until they reach a predetermined number of performance parts of an automatic accompaniment data set. Namely, each of the performance parts has an upper limit number of registrable tone data sets, for example, up to four channels for the drum part, one channel for the bass part, up to three channels for the chord part, etc. For example, if the user attempts to designate five drum parts, a newly-designated tone data set will be registered in place of a drum tone data set having so far being reproduced.

Once the user instructs termination of the search processing (YES determination is made at step Sa10) without selecting another tone data set from among the searched-out results (NO determination at step Sa9) following step Sa8, the control section 21 combines the automatic accompaniment data table and files designated by the table into a single data file and stores this data file into the storage section 22 (step Sa11) and then brings the processing flow to an end. The user can use the operation section 25 to read out, as desired, an automatic accompaniment data set stored in the storage section 22. If, on the other hand, the user has not instructed termination of the search processing (NO determination at step Sa10), the control section 21 reverts to step Sa1. Then, the user selects a different performance part and inputs a rhythm pattern via the rhythm input device 10*a*, in response to which subsequent processes as described above are performed. Thus, a tone data set of the different performance part in the automatic accompaniment data set is registered. In the above-mentioned manner, an automatic accompaniment data set is created in response to the user continuing to perform operation until registration of a predetermined number of performance parts necessary for creating an automatic accompaniment data set is completed. Further, tones represented by the tone data set of the newly-selected performance part are audibly output in overlapped relation to tones represented by the tone data sets of currently-reproduced performance parts. At that time, because the control section 21 reads out tone data from data positions based on the bar line clock, tones of tone data sets of a plurality of performance parts are output in a mutually-synchronized fashion.

As the form of advancement of the individual performance parts, the following three variations are conceivable. As regards synchronization control of performance progression (or advancement) timing, an automatic accompaniment data set searched out in accordance with predetermined settings and designated by the user can be reproduced at timing quantized using any one of standards like "per-measure", "per-two-beat", "per-one-beat", "per-eighth" and "no designation". Namely, according to the first form of advancement, synchronization is effected at the head of the measure. In this case, after the user designates an accompaniment of each of the performance parts, tone data are reproduced from a position of the head of a corresponding measure once the bar line clock signal reaches the head of the measure. According to the second form of advancement, synchronization is effected at the heat of a beat. In this case, after the user designates an accompaniment of each performance part, tone data are reproduced from corresponding beat positions once the bar line clock signal reaches the head of the beat. According to the third form of advancement, no synchronization is effected. In this case, immediately after the user designates an accompaniment of each performance part, tone data are reproduced from corresponding advancement positions. Settings of such variations of the form of advancement are prestored in the storage section 22 so that the user can read out any desired one of the prestored settings via the operation section 25.

According to the second embodiment of the invention, as set forth above, it is possible to identify, from among automatic-accompaniment-related tone data sets searched out on the basis of a user-intended tone pattern, a particular tone data set at least closest to the user-intended tone pattern. At that time, the user inputs a rhythm pattern after selecting a desired one of different performance parts associated with the plurality of performance controls, and thus, if the user hits upon a rhythm pattern for a particular performance part, then the user can perform a search by selecting the particular performance part and inputting the hit-upon rhythm pattern. Further, because the user only has to select performance parts, input rhythm patterns and registers any of searched-out results as performances of the individual performance parts, the second embodiment allows the user to create an automatic accompaniment data set intuitively and efficiently. Furthermore, because, of searched-out automatic accompaniment data sets, automatic accompaniment data selected by the user are reproduced in a mutually-synchronized fashion, the user can obtain sounds of an ensembled automatic accompaniment intuitively and efficiently.

Next, a description will be given about a third embodiment of the present invention.

<Third Embodiment>

(Style Data Search System)

<Construction>

The third embodiment of the present invention is a system for searching for a style data set which is constructed as an example of the music data processing system of the invention. The third embodiment is similar in construction to the above-described second embodiment, except that the automatic accompaniment database 222 stores therein style data sets and includes a style table for searching for a style data set.

The style data in the instant embodiment are read into an electronic musical instrument, sequencer or the like as in the second embodiment to function like so-called automatic accompaniment data sets. First, the following outline the style data and related data employed in the instant embodiment.

Each style data set comprises a set of accompaniment sound data pieces collected for individual ones of different styles, such as "Bebop01", "HardRock01" and "Salsa01" and combined as section data for each of sections (one to several measures) that are each a minimum unit of an accompaniment pattern, and the style data sets are stored in the storage section 22. In the instant embodiment, there are provided a plurality of types of sections, such as structural types like "intro", "main", "fill-in" and "ending", and pattern types like "normal", "variation 1" and "variation 2" in each of the sections. Further, style data of each of the sections include identifiers (rhythm pattern IDs) of performance data described in the MIDI format for individual ones of the bass drum, snare drum, high-hat, cymbal, phrase, chord and bass performance parts. For each of the sections of the style data sets, the control section 21 analyzes, for each of the parts, a rhythm pattern of the performance data, so that content corresponding to the analyzed results is registered into the style table. For example, for the performance data of the bass part, the control section 21 analyzes a time series of tone pitches in the performance data by use of a predetermined basic pitch, and then it registers contents corresponding to the analyzed results into the style table. Further, for the performance data of the chord part, the control section 21 analyzes chords employed in the performance data by use of a predetermined basic chord, and it registers, into a later-described chord progression information table, chord information, such as "Cmaj7", as content corresponding to the analyzed results.

Further, the instant embodiment includes section progression information and chord progression information in corresponding relation to the individual style data sets. The section progression information is information for sequentially designating, in a time-serial manner, sections from the style data set. The chord progression information is information for sequentially designating, in a time-serial manner, chords to be performed in accordance with a progression of a music piece performance. Once a certain style data set is selected, data are registered into the section progression information table and the chord progression information table on the basis of the selected style data set and the section progression information and chord progression information corresponding to the selected style data set. Alternatively, individual sections may be selected in response to user's designation, without the section progression information being used. As another alternative, chord information may be identified from sounds input via the keyboard 11, without the chord progression information being used, so that an accompaniment can be reproduced on the basis of the identified chord information. The chord information includes information indicative of root notes of chords and types of the chords.

The following describe a construction of the style data. FIGS. 19A and 19B are examples of tables related to the style data. First, the following briefly describe the style table, section progression information, chord progression information, etc.

FIG. 19A is a diagram showing an example of the style table, in which a plurality of style data sets whose "genre" is "Swing & Jazz" are shown. Each of the style data sets comprises a plurality of items, such as "style ID", "style name", "section", "key", "genre", "BPM", "musical time", "bass rhythm pattern ID", "chord rhythm pattern ID", "phrase rhythm pattern ID", "bass drum rhythm pattern ID", "snare drum rhythm pattern ID", "high-hat rhythm pattern ID" and "cymbal rhythm pattern ID". The "style ID" is an identifier uniquely the identifying style data set, and the "style name" is also an identifier uniquely identifying the style data set.

In the style data table, a style data set having a certain style name comprises a plurality of sections that are divided into a plurality of segments, such as intro (intro-I (normal), intro-II (variation 1), III (variation 2)), main (main-A (normal), main-B (variation 1), main-C (variation 2), main-D (variation 3)), and ending (end01 (normal), end02 (variation 1), end03 (variation 2)). Each of the segments has normal and variation patterns. Namely, the "section" represents a section which each of styles having a certain name belongs to. For example, once the user selects a style of style name "Bebop01" and instructs reproduction of that style, the control section 21 reproduces tones based on a style data set whose section is intro-normal pattern "I" among the style data sets having the style name "Bebop01", then repetitively reproduces tones based on a style data set whose section is main-normal pattern "A" a predetermined number of times, and then reproduces tones based on a style data set whose section is ending-normal pattern "1". In the aforementioned manner, the control section 21 reproduces tones, based on style data sets of the selected style, in accordance with the order of the sections. The "key" represents a tone pitch that becomes a basis for pitch-converting the style data. Although the "key" is indicated by a note name in the illustrated example, it practically represents a tone pitch because it indicates a note name in a particular octave. The "genre" represents a musical genre which the style data set belongs to. The "BPM" represents a tempo at which sounds based on a style data set are reproduced. The "musical time" represents a type of musical time of a style data set, such as triple time or quadruple time. Once a variation change instruction is given during a performance, the performance is switched to a variation pattern of the corresponding section.

In each of the style data sets, part-specific rhythm pattern IDs are associated, in one to one relationship, with the individual performance parts. In the style data set whose style ID is "0001" in the illustrated example of FIG. 19A, the "bass rhythm pattern ID" is "010010101". This means that, in the rhythm pattern table of FIG. 13A, (1) a rhythm pattern record where the part ID is "01" (bass), the rhythm pattern ID is "010010101", the rhythm pattern data is "BebopBass01Rhythm.txt" and the tone data is "BebopBass01Rhythm.Wav" and (2) the style data set where the style ID is "0001" are associated with each other. For the rhythm pattern IDs of the other performance parts than the bass part too, association similar to the above is described in the respective style data sets. Once the user selects a style data set of a certain style name and instructs reproduction of the selected style data set, the control section 21 reproduces tone data, associated with the rhythm pattern IDs of the individual performance parts included in the selected style data set, in a mutually-synchronized fashion. For each of the style data, a combination of the rhythm pattern IDs of individual performance parts constituting the style data set is predetermined such that the combination designates rhythm pattern records that are well suited to one another. The "rhythm pattern records that are well suited to one another" may be predetermined, for example, on the basis of factors that the rhythm pattern records of the different performance parts have similar BPMs, have a same musical key, belong to a same genre, and/or have a same musical time.

(a) of FIG. 19B shows an example of the section progression information table.

The section progression information table is a table comprising a combination of section progression information for sequentially designating, in a time-serial manner, sections from among the style data sets in accordance with a progression of a music piece performance. As shown in the example of (a) of FIG. 19B, each of the section progression information may comprise a style ID, style designating data St for designating a style, section information Sni for designating a section, section start/end timing data Tssi and Tsei (i=1, 2, 3, . . . ) indicative of positions of start and end times (normally, on a per-measure basis) of each section, and section progression end data Se indicative of a final end position of the section progression information, and such section progression information is stored, for example, in the storage section 22. Namely, each of the section information Sni designates a stored region of data related to the corresponding section, and the timing data Tssi and Tsei located preceding and following the section information Sni indicate a start and end of an accompaniment based on the designated section. Thus, using the section progression information, it is possible to sequentially designate, from among accompaniment style data sets designated by the style designating data St, sections by repeated combinations of the timing data Tssi and Tsei.

(b) of FIG. 19B shows an example of the chord progression information table.

The chord progression information table is a table comprising a combination of chord progression information for sequentially designating, in a time-serial manner, chords to be performed in accordance with a progression of a music piece performance. As shown in the example of (b) of FIG. 19B, each of the chord progression information may comprise a style ID, key information Key, chord name Cnj, chord's root note information Crj for defining a chord name Cnj, chord type information Ctj, chord start and end timing data Tcsj and Tcej (j=1, 2, 3, . . . ) indicative of start and end time positions of the chord (normally, represented in beats), and chord progression end data Ce indicative of a final end position of the chord progression information, and these chord progression information is stored, for example, in the storage section 22. Here, the chord information Cnj defined by the two information Crj and Ctj indicates a type of a chord to be performed in accordance with chord performance data of the section designated by the section information Sni, and the timing data Tsci and Tcei located preceding and following the section indicate a start and end of the performance of the chord. Thus, with such chord progression information, chords to be performed can be sequentially designated by repeated combinations of the timing data Tsci and Tcei designating after a musical key is designated by the key information Key.

Note that, although timing of the section progression information and the chord progression information is set in measures or in beats, any other desired timing may be used as necessary; for example, the timing of the section progression information and the chord progression information may be set in accordance with clock timing, and the number of the clock timing from the head of a measure of a music piece may be used as various timing data. Further, in a case where a next section Sni+i or chord Cnj+1 is to be started immediately after a given section Sni or chord Cnj, either the end timing Tsei or Tcei of the start timing Tss+1 or Tcei+1 can be omitted, Further, in the instant embodiment, the section progression information and the chord progression information is stored mixedly in a master track.

The following briefly explain a way of obtaining desired performance sounds from the section information and chord progression information. The control section 21 reads out, from the section progression information, accompaniment style designating data St and accompaniment sound data pieces of sections (e.g., "Main-A" of "Bebopo1") designated by sequentially read-out section information Sni and then stores the read-out accompaniment style designating data St and accompaniment sound data pieces into the RAM. Here, the data related to the individual sections are stored on the basis of the basic chord (e.g., "Cmaj"). The storage section 22 contains a conversion table having described therein conversion rules for converting the accompaniment sound data pieces, based on the basic chord, into sounds based on a desired chord. As desired chord information Cnj (e.g., "Dmaj") sequentially read out from the chord progression table is supplied to the control section 21, the accompaniment sound data pieces, based on the basic chord, are converted, in accordance with the conversion table, into sounds based on the read-out desired chord information Cnj. The sound output section 26 outputs the thus-converted sounds. Each time the section information read out from the section progression information changes to another, the accompaniment sound data pieces supplied to the control section 21 change, so that the audibly-generated sounds change. Also, each time chord information read out from the chord progression information changes to another, the conversion rules change, so that the audibly-generated sounds change.

<Behavior>

Figure 20:
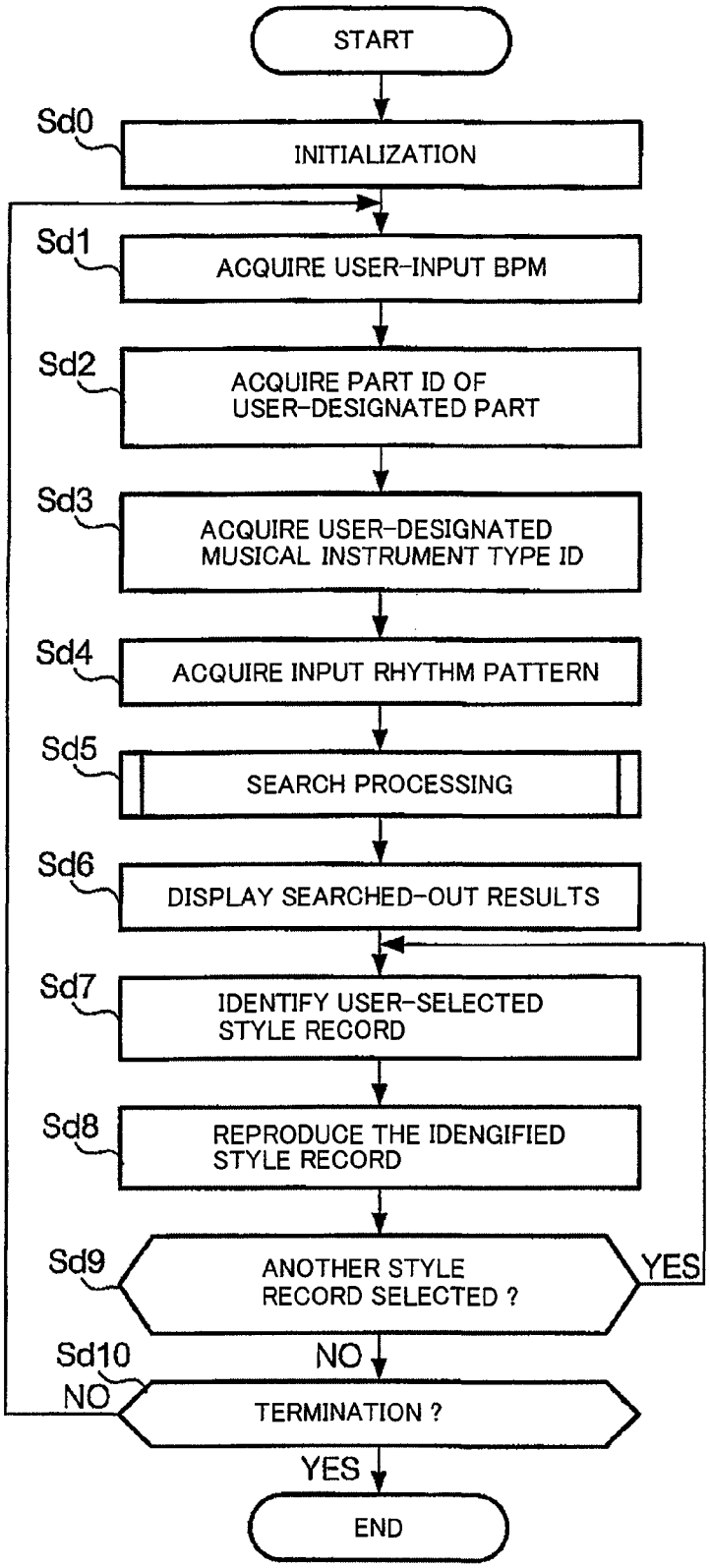
FIG. 20 is a flow chart of processing performed by an information processing device in a third embodiment of the present invention.

FIG. 20 is a flow chart of processing performed by the information processing device 20 in the third embodiment. In FIG. 20, operations of steps Sd0 to Sd5 are similar to the above-described operations of steps Sa0 to Sa5 of FIG. 15 performed in the second embodiment. At step Sd6 in the third embodiment, the control section 21 displays, as searched-out results, style data sets in which same pattern IDs as rhythm pattern records searched out at step Sd5 are set as rhythm pattern IDs of any of the performance parts.

FIG. 21 is a diagram showing examples of searched-out results or searched-out style data sets. (a) of FIG. 21 shows style data displayed on the display section 24 after being output by the control section 21 as searched-out results on the basis of a rhythm pattern input by the user via the chord inputting range keyboard 11*b*. In (a) to (c) of FIG. 21, item "value of similarity" represents a similarity distance between the input rhythm pattern and a rhythm pattern of each of the searched-out style data sets. Namely, a smaller value represented by the "value of similarity" indicates that the rhythm pattern of the searched-out style data set has a higher degree of similarity to the input rhythm pattern. As shown in (a) of FIG. 21, the style data sets are displayed in ascending order the "value of similarity" (i.e., distance between the rhythm patterns calculated at step Sb7), i.e. in descending order of the degree of similarity to the input rhythm pattern. Here, the user can display the searched-out results after filtering the results using at least one of the items "key", "genre" and "BPM". Further, the BPM with which the user input the rhythm pattern, i.e. the input BPM, is displayed on an input BPM display section 301 provided above the searched-out results. Above the searched-out results, there are also displayed a tempo filter 302 for filtering the searched-out style data sets with the input BPM, and a musical time filter 303 for filtering the searched-out style data sets with a designated musical time. In addition, items "chord", "scale" and "tone color" may be displayed so that filtering can be performed with a chord used in the chord par if the user has designated the "chord" item, with a key with which the style data were created if the user has designated the "scale" item, and/or with tone colors of individual performance parts if the user has designated the "tone color" item.

The control section 21 has the filtering function for outputting, as searched-out results, only style data sets having a BMP close to the user-input BPM, and the user can set, as desired via the operation section 25, ON or OFF of the filtering function into the tempo filter 302 displayed above the searched-out results. More specifically, each of the style data sets has its BPM as noted above, and thus, when the filtering function is ON, the control section 21 can display, as searched-out display results, information related to style data sets each having a BPM, for example, in the range of ($\frac{1}{2}^{1/2}$) to ($2^{1/2}$) times of the input BPM. Note that the above-mentioned coefficients ($1/2^{1/2}$) to ($2^{1/2}$) applied to the input BPM are merely illustrative and may be other values.

(b) of FIG. 21 shows a state in which the user has turned ON the filtering function from the state shown (a) of FIG. 21. In (b) of FIG. 21, the control section 21 is performing the filtering by use of the coefficients ($1/2^{1/2}$) to ($2^{1/2}$).) Namely, in (b) of FIG. 21, style data sets having a BPM in the range of 71 to 141 are displayed as filtered results because the input BPM is "100". In this way, the user can obtain, as searched-out results, style data sets having a BPM close to the input BPM, so that the user can have a more feeling of satisfaction with the searched-out results.

Further, by inputting information indicative of a desired musical time, such as four-four (4/4) time, to the musical time filter 303 via the operation section 25, the user can perform filtering such that information indicative of style data sets associated with the input musical time information is displayed as searched-out results. Note that style data sets may be extracted not only by narrowing-down to style data sets of the designated musical time but also narrowing down to style data sets of previously-grouped musical times related to the designated musical time. For example, when quadruple time is designated, not only narrowing down to style data sets of quadruple time but also style data sets of double time and six-eight time that can be easily input via a quadruple-time metronome may be extracted.

Further, the user can obtain second searched-out results narrowed down from first searched-out style data, by first designating a performance part to search for style data sets having a rhythm pattern close to an input rhythm pattern (first search) and then designating another performance part and inputting a rhythm pattern to again search for style data sets (second search). In this case, the similarity distance in the searched-out results is a sum between values of similarity in the performance part designated in the first search and similarity in the performance part designated in the second search. For example, (c) of FIG. 21 shows content displayed as a result of the user designating the high-hat part as the performance part and inputting a rhythm pattern in the state where the searched-out results of (a) of FIG. 21 are being displayed. Further, in (c) of FIG. 21, style data sets having musical time information of "4/4" input to the time filter 303 are displayed as searched-out results. The "value of similarity" in (c) of FIG. 21 is a value obtained by adding together a value of similarity in a case where the subject or target performance part is "chord" and a value of similarity in a case where the subject performance part is "high-hat". Although FIG. 21 shows that the search can be performed using two performance parts as indicated by items "first search part" and "second search part", the number of performance parts capable of being designated for the search purpose is not so limited. Further, if the user inputs, following the search designating a performance part, a rhythm pattern designating a different performance part (second search part) different from the first designated performance part (first search part), the control section 21 may output only searched-out results using (designating) the second search part irrespective of searched-out results using (designating) the first search part (this type of search will be referred to as "overwriting search"). Switching may be made between the narrowing-down search and the overwriting search by the user via the operation section 25 of the information processing device 20.

The search in which a plurality of different performance parts are designated may be performed in any other suitable manner than the aforementioned. For example, when the user has executed performance operation simultaneously designating a plurality of performance parts, the following processing may be performed. Namely, the control section 21 calculates a value of similarity between a rhythm pattern record having a part ID of each of the performance parts designated by the user and an input rhythm pattern of each of the performance parts. Then, the control section 21 adds the value of similarity, calculated for the rhythm pattern record of each of the designated performance parts, to each of style data sets associated with the rhythm pattern record. Then, the display section 24 displays the style data in ascending order of the added similarity distance, i.e. from the style data sets of the smallest added similarity (namely from the style data most similar to the input rhythm pattern). For example, when the user has input a rhythm pattern by executing performance operation simultaneously for the bass drum and snare drum parts, the control section 21 calculates respective values of similarity of the bass drum and snare drum. In this way, the user can simultaneously designate a plurality of parts to search for style data sets having a phrase constructed in such a rhythm pattern whose value of similarity to a user-intended rhythm pattern satisfies a predetermined condition.

Once the user selects any desired style data set via the operation section 25 in the illustrated example of any one of (a) to (c) of FIG. 21, the control section 21 identifies the style data set selected by the user (step Sd7) and displays a configuration display screen of the identified style data set on the display section 24.

Figure 22:
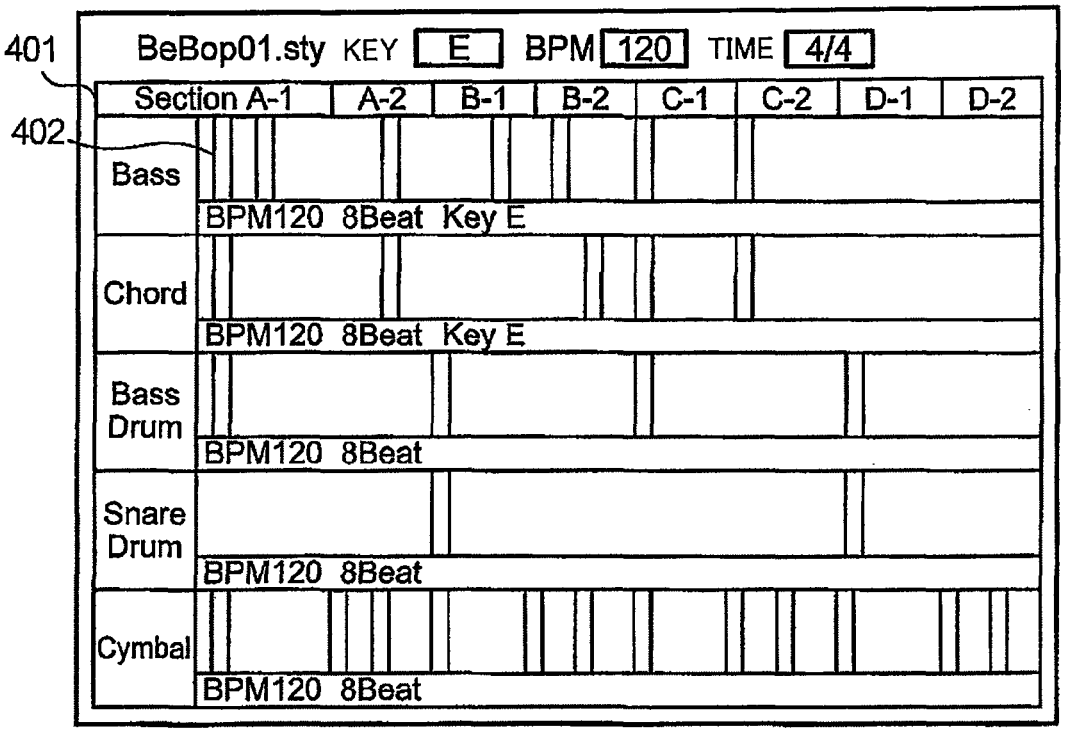
FIG. 22 is a diagram showing an example of a configuration display screen of the style data.

FIG. 22 is a diagram showing an example of the style data configuration display screen. Let it be assumed here that the user has selected a style data set of style name "Bebop01" from among the searched-out results. The style name, key, BPM and musical time of the selected style data set are displayed in an upper region of a reproduction screen, tabs indicative of sections (section tabs) 401 are displayed in an intermediate region of the reproduction screen, and information of individual performance parts of the section indicated by any one of the tabs is unrolled and displayed in respective tracks. In the information of each of the performance parts, not only a BPM, rhythm category and key in a respective rhythm pattern record are displayed, but also the rhythm pattern of each of the performance parts is displayed with a rightward-advancing horizontal axis in the track is set as a time axis and with predetermined images 402 displayed at positions corresponding to individual sound generation times with the left end of the display area of the images 402 set as performance start timing. Here, each of the images 402 is displayed in a bar shape having a predetermined dimension in a vertical direction of the configuration display screen. Once the user selects a desired one of the section tabs 401 via the operation section 25, the control section 21 reproduces a rhythm pattern based on the style data set of the section of the selected tab (step Sd8).

Note that, on the configuration display screen, it is possible to register, edit, confirm and check performance data user-created original style data sets and performance data included in existing and original style data sets.

The information processing device 20*a* can reproduce a style data set in response to a reproduction start instruction given by the user operating a not-shown control on the style data configuration display screen. The reproduction of the style data set can be effected in any one of three reproduction modes: automatic accompaniment mode; replacing search mode; and follow-up search mode. The user can switch among the three modes by use of the operation section 25. In the automatic accompaniment mode, performance data based on the selected style data set are reproduced, but also the user can execute performance operation using the rhythm input device 10*a* and operation section 25 so that sounds based on the performance operation are output together with tones based on the selected style data set. The control section 21 also has a mute function, so that the user can use the operation section 25 to cause the mute function to act on a desired performance part so that performance data of the desired performance part are prevented from being audibly reproduced. In this case, the user itself can execute performance operation for the muted performance part while listening to non-muted performance parts like accompaniment sound sources.

In the replacing search mode, the control section 21 performs the following processing in response to the user inputting a rhythm pattern to the rhythm input device 10*a* after designating a desired performance part via the operation section 25. In this case, the control section 21 replaces performance data of the designated performance part, included in previously-combined performance data of a style data set being currently reproduced, with performance data selected from among searched-out results based on the input rhythm pattern. At that time, once the user inputs a rhythm pattern via the rhythm input device 10*a* after designating a desired performance part, the control section 21 performs the aforementioned search processing for the designated performance part and then displays searched-out results like those of FIG. 16 on the display section 24. Once the user selects a particular one of the searched-out results, the control section 21 replaces performance data of the designated performance part, included in the style data being currently reproduced, with the selected performance data. In this way, the user can replace performance data of desired performance data of a style data set, selected from among the searched-out results, with performance data based on its input rhythm pattern. Thus, the user can obtain not only pre-combined style data sets but also a style data set reflecting therein its intended rhythm pattern per section per performance part, and consequently, the user can perform not only a search but also music composition using the information processing device 20*a*.

Further, in the follow-up search mode, in response to the user itself executing performance operation for a performance part, muted by use of the mute function, while listening to non-muted performance parts like accompaniment sound sources, the control section 21 searches, for each performance part which no performance operation has been executed, for performance data well suited to an input rhythm pattern of the part for which the performance operation has been executed. The "performance data well suited to an input rhythm pattern" may be predetermined, for example, on the basis of factors that the performance data have a same key, belong to a same genre and have a same musical time as the input rhythm pattern, and/or have a BPM within a predetermined range from the input BPM. Once the control section 21 identifies performance data of the smallest value of similarity (i.e., greatest degree of similarity) from among the performance data well suited to the input rhythm pattern, it reproduces these data in a mutually-synchronized fashion. Thus, even where the user has a low feeling of satisfaction with the searched-out results, the user can cause style data suited to its input rhythm pattern to be reproduced, by inputting the input rhythm pattern after designating a performance part.

Once the user selects, after step Sd8, another style data set via the operation section 25 (YES determination at step Sd9), the control section 21 reverts to step Sd7. In this case, the control section 21 identifies newly selected style data (step Sd7) and displays a reproduction screen of the identified style data set on the display section 24. Then, once the user instructs termination of the search processing (YES determination at step Sd10) without selecting another style data set via the operation section 25 after step Sd8, the control section 21 brings the processing to an end.

According to the third embodiment, as described above, the user can obtain, by executing performance operation to input a rhythm pattern for a selected performance part, not only a tone data set of a particular performance part but also a part style data set comprising a combination of a tone data set of a rhythm pattern similar to the input rhythm pattern and tone data sets well suited to the input rhythm pattern. Further, the user can replace a tone data set of a desired performance part, included in searched-out style data sets, with a tone data set similar to another input pattern different from the first input rhythm pattern. In this way, the user can use the information processing device 20*a* to perform not only a search but also music composition.

<Modifications>

The above-described embodiments of the present invention may be modified as follows, except for some exceptions noted below. The following modifications may also be combined as necessary.

<Modification 1>

Whereas the above-described first embodiment is constructed in such a manner that one phrase record is output as a searched-out result in the loop reproduction mode or performance loop reproduction mode, the present invention is not so limited. For example, the rhythm pattern search section 213 may output, as searched-out results, a plurality of phrase records having more than predetermined value of similarity to a user-input rhythm pattern after having rearranged the plurality of phrase records in descending order of the value of similarity. In such a case, the number of the phrase records to be output as the searched-out results may be prestored as a constant in the ROM, or may be prestored as a variable in the storage section 22 so that it is changeable by the user. For example, if the number of the phrase records to be output as the searched-out results is five, five names of respective phrase tone data sets of the five phrase records are displayed in a list format on the display section 24. Then, sounds based on a user-selected one of the phrase records are audibly output from the sound output section 26.

<Modification 2>

In the case of a musical instrument type capable of playing a greater range of tone pitches, it is sometimes possible that keys (tone pitches) of individual component sounds of a phrase tone data set and keys (tone pitches) of an accompaniment including an external sound source do not agree with each other. To deal with such disagreement, the control section 21 may be constructed to be capable of changing the key of any of the component sounds of the phrase tone data set in response to the user performing necessary operation via the operation section 25. Further such a key change may be effected via either the operation section 25 or a control (operator), such as a fader, knob or wheel, provided on the rhythm input device 10. As another alternative, data indicative of the keys (tone pitches) of the component sounds may be prestored in the rhythm DB 221 and the automatic accompaniment DB 222 so that, once the user changes the key of any of the component sounds, the control section 21 can inform the user what the changed key is.

<Modification 3>

In some tone data sets, an amplitude (power) of a waveform dose not necessarily end in the neighborhood of a value "0" near the end of a component sound, in which a case clip noise tends to be generated following audible output of a sound based on the component sound. In order to avoid such unwanted clip noise, the control section 21 may have a function for automatically fading in or fading out predetermined regions in the neighborhood of the start or end of a component sound. In such a case, the user is allowed to select, via some control provided on the operation function or rhythm input device 10, whether or not to apply the fading-in or fading-out.

Figure 23:
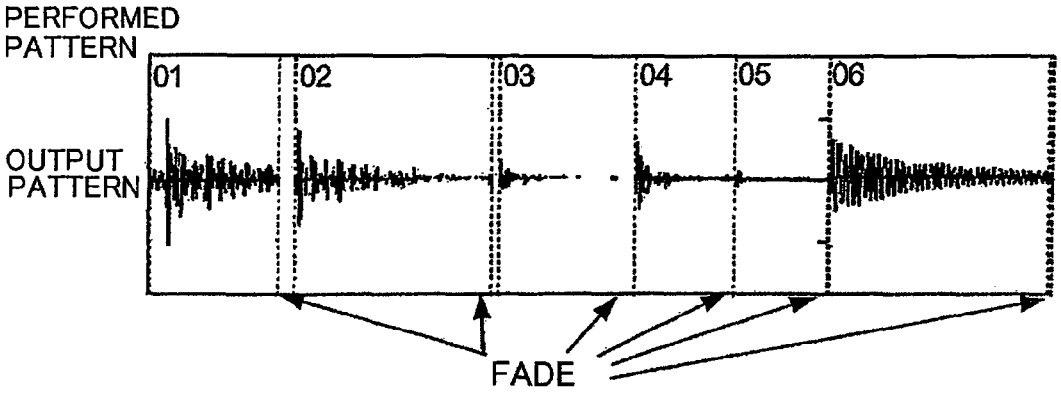
FIG. 23 is a schematic diagram showing an example where a fading-out scheme is applied to individual component sounds of a phrase tone data set.

FIG. 23 is a schematic diagram showing an example where the fading-out is applied to individual sounds of a tone data set. As shown in FIG. 23, the fading-out is applied to portions of the phrase tone data set depicted by arrows labeled "Fade", so that a waveform in each of the arrowed portions gradually decreases in amplitude to take a substantially zero amplitude at the end time of the corresponding component sound. A time period over which the fading-out is applied is in a range of several msec to dozens of msec and adjustable as desired by the user. An operation for applying the fading-out may be performed as preprocessing or preparation for user's performance operation.

<Modification 4>

A phrase obtained as a result of the user executing performance operation may be recorded by the control section 21 so that the recorded content can be output in a file format conventionally used in a sound source loop material. In music piece production, for example, if a rhythm pattern desired by the user is not stored in the rhythm DB 221 but the performance processing section 214 has the function for recording a user's performance, the user can acquire a phrase tone data set very close in image to a user's desired phrase tone data set.

<Modification 5>

The control section 21 may set, as objects of reproduction, a plurality of phrase tone data sets rather than just one tone data set so that the plurality of tone data sets can be output as overlapped sounds. In this case, for example, a plurality of tracks may be displayed on the display section 24 so that the user can allocate different phrase tone data sets and reproduction modes to the displayed tracks. In this way, the user can, for example, allocate a tone data set of a conga to track A in the loop reproduction mode so that the conga tone data set is audibly reproduced as an accompaniment in the loop reproduction mode, and allocate a tone data set of a djembe to track B in the performance reproduction mode so that the djembe tone data set is audibly reproduced in the performance reproduction mode.

<Modification 6>

As still another modification, the following replacement process may be performed in the event that attack intensity of a component sound (hereinafter referred to as "component sound A") having the same sound generation time as trigger data, included in a searched-out tone data set and associated with velocity data input through performance operation by the user, extremely differs from the velocity data (e.g., exceeds a predetermined threshold value). In such a case, the performance processing section 214 replaces the component sound A with a component sound randomly selected from among a plurality of component sounds having attack intensity substantially corresponding to the user-input velocity data. In this case, the user can select, via some control provided on the operation section 25 or rhythm input device 10, whether the replacement process should be performed or not. In this way, the user can obtain an output result much closer to the performance operation performed by the user itself.

<Modification 7>

Whereas the embodiments other than the third embodiment have been described above in relation to the case where the phrase tone data sets are in a file format, such as the WAVE or mp3, the present invention is not so limited, and the phrase tone data sets may be sequence data sets, for example, in the MIDI format. In such a case, files are stored in the storage section 22 in the MIDI format, and a construction corresponding to the sound output section 26 functions as a MIDI tone generator. Particularly, if the tone data sets are in the MIDI format in the second embodiment, processes like the time-stretch process are unnecessary at the time of key shift and pitch conversion. Thus, in this case, once the user designates a key via the key designating keyboard 202, the control section 21 changes key-indicating information, included in MIDI information represented by tone data, into the designated key. Further, in this case, each rhythm pattern record in the rhythm pattern table need not contain tone data corresponding to a plurality of chords. Once the user designates a chord via the chord designating keyboard 203, the control section 21 changes chord-indicating information, included in MIDI information represented by tone data, into the designated chord. Thus, even where the tone data sets are files in the MIDI format, the same advantageous benefits as the above-described embodiment can be achieved. Further, in the third embodiment, style data sets using audio data may be used. In such a case, the style data sets are similar in fundamental construction to the style data sets used in the third embodiment, but different from the style data sets used in the third embodiment in that performance data of individual performance parts are stored as audio data. Alternatively, style data sets each comprising a combination of MIDI data and audio data may be used.

<Modification 8>

Whereas the control section 21 have been described as detecting a particular phrase record or rhythm pattern record through comparison between trigger data input through user's performance operation and rhythm pattern data stored in the rhythm DB 221 or the automatic accompaniment DB 222, the present invention is not so limited. For example, the control section 21 may search through the rhythm DB 221 and automatic accompaniment DB 222 using both trigger data and velocity data input through user's performance operation. In this case, if two tone data sets having a same rhythm pattern exist, one of the two tone data sets, in which attack intensity of each component sound is closer to the velocity data input through the user's performance operation than the other, is detected as a searched-out result. In this manner, for the attack intensity too, a phrase tone data set very close to a user-imaged tone data set can be output as a searched-out result.

—Manner of Calculation of a Difference Between Rhythm Patterns—

The manner in which differences between rhythm patterns is calculated in the above-described embodiments is merely illustrative, and such a difference may be calculated in a different manner, or using a different method, from the above-described embodiments.

<Modification 9>

For example, the rhythm pattern difference calculation at step Sb6 and the rhythm pattern distance calculation at step Sb7 may be performed after a rhythm category which the input rhythm pattern falls in is identified and using, as objects of calculation, only phrase records belonging to the identified rhythm category, so that a phrase record matching the rhythm category of the input rhythm pattern can be reliably output as a searched-out result. Because such a modified arrangement can reduce the quantities of necessary calculations, this modification can not only achieve a lowered load on the information processing device 20 but also reduce response time to the user.

—Difference Smaller than a Reference is Treated as Zero or Corrected to a Small Value—

<Modification 10>

In the calculation of differences between rhythm patterns at step Sb6 above, the following operations may be performed. Namely, in modification 10, for each ON-set time of a rhythm pattern (i.e., rhythm pattern to be compared against the input rhythm pattern) of which an absolute value of a time difference from an ON-set time of the input rhythm pattern is smaller than a threshold value, the control section 21 regards the absolute value of the time difference as one not intended by user's manual input and corrects the difference value to "0" or corrected to a value smaller than an original value. The threshold value is, for example, a value "1" and prestored in the storage section 22*a*. Let it be assumed that ON-set times of the input rhythm pattern are "1, 13, 23, 37" and ON-set times of the to-be-compared rhythm pattern are "0, 12, 24, 36". In this case, absolute values of differences in the individual ON-set times are calculated as "1, 1, 1, 1". If the threshold value is "1", the control section 21 performs correction by multiplying the absolute value of the difference of each of the ON-set times by a coefficient α. The coefficient α takes a value in the range of from "0" to "1" ("0" in this case). Thus, in this case, the absolute values of differences in the individual ON-set times are corrected to "0, 0, 0, 0", so that the control section 21 calculates a difference between the two rhythm patterns as "0". Although the coefficient α may be predetermined and prestored in the storage section 22*a*, a correction curve having values of the coefficient α associated with difference levels between two rhythm patterns may be prestored in the storage section 22*a* so that the coefficient α can be determined in accordance with the correction curve.

—ON-Set Time Having a Difference Greater than a Reference is not Used in the Calculation—

<Modification 11>

In the calculation of differences between rhythm patterns at step Sb6 above, the following operations may be performed. Namely, in modification 11, for each ON-set time of a rhythm pattern (i.e., rhythm pattern to be compared against the input rhythm pattern) of which an absolute value of a time difference from an ON-set time of the input rhythm pattern is smaller than a threshold value, the control section 21 does not use the ON-set time in the calculation, or corrected the difference to be smaller than an original value. Thus, even when the user has input a rhythm pattern only for a former half portion or latter half portion of a measure, a search is performed with the rhythm-pattern-input former or latter half portion of the measure used as an object of the search. Thus, even where rhythm pattern records each having a same rhythm pattern throughout one measure are not contained in the automatic accompaniment DB 222, the user can obtain, as searched-out results, rhythm pattern records similar to the input rhythm pattern to some extent.

—Velocity Pattern Difference is Considered—

<Modification 12>

In the calculation of differences between rhythm patterns at step Sb6 above, a calculation scheme or method taking into account a velocity pattern difference may be employed. Assuming that the input rhythm pattern is "rhythm pattern A" while a rhythm pattern described in a rhythm pattern record is "rhythm pattern B", a difference between rhythm pattern A and rhythm pattern B is calculated in the following operational step sequence.

(11) The control section 21 calculates, using the ON-set times of rhythm pattern A as calculation bases, an absolute value of a time difference between each ON-set time in rhythm pattern A and an ON-set time in rhythm pattern B closest to the ON-set time in rhythm pattern A.

(12) The control section 21 calculates a sum of all of the absolute values of the time differences calculated at step (11) above.

(13) The control section 21 calculates an absolute value of a difference between velocity data at each ON-set time in rhythm pattern A and attack intensity at a corresponding ON-set time in rhythm pattern B and then calculates a sum of all of such absolute values.

(14) The control section 21 calculates, using the ON-set times of rhythm pattern B as calculation bases, an absolute value of a time difference between each ON-set time in rhythm pattern B and an ON-set time in rhythm pattern A closest to the ON-set time in rhythm pattern B.

(15) The control section 21 calculates a sum of all of the absolute values of the time differences calculated at step (14) above.

(16) The control section 21 calculates an absolute value of a difference between velocity data at each ON-set time in rhythm pattern B and attack intensity at a corresponding ON-set time in rhythm pattern A and then calculates a sum of all of such absolute values.

(17) The control section 21 calculates a difference between rhythm pattern A and rhythm pattern B in accordance with the following mathematical expression (1):

difference between rhythm pattern *A* and rhythm pattern *B*=[α×{the sum of all of the absolute values of the time differences calculated at step (12)+the sum of all of the absolute values of the time differences calculated at step (15)}/2]+[(1−α)×{the sum of all of the absolute values of the velocity differences calculated at step (13)+the sum of all of the absolute values of the velocity differences calculated at step (16)}/2] mathematical expression (1)

In mathematical expression (1) above, a is a predetermined coefficient that satisfies $0<\alpha<1$ and is prestored in the storage section 22*a*. The user can change the value of the coefficient α via the operation section 25. For example, in searching for a rhythm pattern, the user may set a value of the coefficient α depending on whether priority should be given to a degree of ON-set time coincidence or to a degree of velocity coincidence. In this way, the user can acquire searched-out results with the velocity taken into consideration.

—Duration Pattern Difference is Considered—

<Modification 13>

In the calculation of differences between rhythm patterns at step Sb6 above, a calculation scheme or method taking into account a duration pattern difference may be employed. Assuming that the input rhythm pattern is "rhythm pattern A" while a rhythm pattern described in a rhythm pattern record is "rhythm pattern B", a level of a difference between rhythm pattern A and rhythm pattern B is calculated in the following operational step sequence.

(21) The control section 21 calculates, using the ON-set times of rhythm pattern A as calculation bases, an absolute value of a time difference between each ON-set time in rhythm pattern A and an ON-set time in rhythm pattern B closest to the ON-set time in rhythm pattern A.

(22) The control section 21 calculates a sum of all of the absolute values of the time differences calculated at step (21) above.

(23) The control section 21 calculates an absolute value of a difference between a duration pattern at each ON-set time in rhythm pattern A and a duration pattern at a corresponding ON-set time in rhythm pattern B and calculates a sum of all of such absolute values.

(24) The control section 21 calculates, using the ON-set times of rhythm pattern B as calculation bases, an absolute value of a time difference between each ON-set time in rhythm pattern B and an ON-set time in rhythm pattern A closest to the ON-set time in rhythm pattern B.

(25) The control section 21 calculates a sum of all of the absolute values of the time differences calculated at step (24) above.

(26) The control section 21 calculates an absolute value of a difference between a duration pattern at each ON-set time in rhythm pattern B and a duration pattern at a corresponding ON-set time in rhythm pattern A and calculates a sum of all of such absolute values.

(27) The control section 21 calculates a difference between rhythm pattern A and rhythm pattern B in accordance with the following mathematical expression (2):

difference between rhythm pattern *A* and rhythm pattern *B*=[β×{the sum of all of the absolute values of the time differences calculated at step (22)+the sum of all of the absolute values of the time differences calculated at step (25)}/2]+[(1−β)×(the sum of all of the absolute values of the duration differences calculated at step (23)+(the sum of all of the absolute values of the duration differences calculated at step (26)/2] mathematical expression (2)

In mathematical expression (2) above, β is a predetermined coefficient that satisfies 0<β<1 and is prestored in the storage section 22*a*. The user can change the value of the coefficient β via the operation section 25. For example, in searching for a rhythm pattern, the user may set a value of the coefficient β depending on whether priority should be given to a degree of ON-set time coincidence or to a degree of duration pattern coincidence. In this way, the user can acquire searched-out results with the duration taken into consideration.

The foregoing has been an explanation about variations of the manner or method for calculating of a difference between rhythm patterns.

—Method for Calculating a Distance Between Rhythm Patterns—

The aforementioned manner or method in which a distance between rhythm patterns is calculated merely illustrative, and such a distance between rhythm patterns may be calculated using a different method from the aforementioned. The following describe variations of the method for calculating a distance between rhythm patterns.

—Coefficients are Applied to Respective Sums of Two Rhythm Patterns—

<Modification 14>

At step Sb7 in each of the first to third embodiments, as set forth above, the control section 21 calculates a distance between rhythm patterns by multiplying a similarity distance, calculated for a rhythm category at step Sb4, and a difference between the rhythm patterns calculated at step Sb6. However, if one of the similarity distance and the difference is of a value "0", then the distance between rhythm patterns would be calculated as "0" that does not reflect therein a value of the other of the similarity distance and the difference. Thus, as a modification, the control section 21 may calculate a distance between rhythm patterns in accordance with the following mathematical expression (3):

distance between rhythm patterns=(similarity distance calculated for the rhythm category at step *Sb*4+γ)×(difference between the rhythm patterns calculated at step *Sb*6+δ) mathematical expression (3)

In mathematical expression (3), γ and δ are predetermined constants that are prestored in the storage section 22*a*. Here, γ and δ only need be appropriately small values. In this way, even when one of the similarity distance for the rhythm category at step Sb4 and the difference between the rhythm patterns is of a value "0", it is possible to calculate a distance between the rhythm patterns that reflects therein a value of the other of the similarity distance and the difference between the rhythm patterns.

—Sum of Values of Rhythm Patterns Multiplied by Constants is Used—

<Modification 15>

The calculation of a distance between rhythm patterns at step Sb7 may be performed in the following manner rather than the above-described. Namely, in modification 15, the control section 21 calculates, at step Sb7, a distance between rhythm patterns in accordance with the following mathematical expression (4):

distance between rhythm patterns=ϵ×similarity distance calculated for a rhythm category at step *Sb*4+(1−ϵ)×difference between the rhythm patterns calculated at step *Sb*6 mathematical expression (4)

In mathematical expression (4) above, ϵ is a coefficient that satisfies "0<ϵ<1". The coefficient c is prestored in the storage section 22, and the user can change the value of the coefficient c via the operation section 25. For example, in searching for a rhythm pattern, the user may set a value of the coefficient ϵ depending on whether priority should be given to the similarity distance calculated for the rhythm category or to the difference between the rhythm patterns. In this way, the user can obtain more desired searched-out results.

—Distance of a Rhythm Pattern Having a Tempo Close to that of an Input Rhythm Pattern is Calculated as a Small Value—

<Modification 16>

The calculation of a distance between rhythm patterns at step Sb7 may be performed in the following manner other than the above-described. Namely, in modification 16, the control section 21 calculates, at step Sb7, a distance between rhythm patterns in accordance with the following mathematical expression (5-1):

distance between rhythm patterns=(similarity distance calculated for a rhythm category at step *Sb*4+difference between the rhythm patterns calculated at step *Sb*6)×ϵ×|input BPM−BMP of a rhythm pattern record| mathematical expression (5-1)

In mathematical expression (5-1) above, ϵ is a predetermined constant that satisfies "0<ϵ<1". The constant ϵ is prestored in the storage section 22, and the user can change the value of the coefficient ϵ via the operation section 25. For example, in searching for a rhythm pattern, the user may set a value of the constant c depending on how much priority should be given to the difference in BPM. At that time, each rhythm pattern record whose difference in BPM from the input BPM is over a predetermined threshold value may be excluded by the control section 21 from the searched-out results. In this way, the user can obtain more desired searched-out results, taking the BPM into account.

Further, as another example of mathematical expression (5-1) above, the following may be used:

distance between rhythm patterns=(similarity distance calculated for a rhythm category at step *Sb*4+difference between the rhythm patterns calculated at step *Sb*6)+ϵ×|input BPM−BMP of the rhythm pattern record mathematical expression (5-2)

Like in mathematical expression (5-1) above, ϵ in mathematical expression (5-2) is a predetermined constant that satisfies "0<ϵ<1". The coefficient ϵ is prestored in the storage section 22, and the user can change the value of the coefficient ϵ via the operation section 25. In the case where mathematical expression (5-2) is used, and if, for example, the constant ϵ is set to a considerably small value, searched-out results are output in such a manner that, fundamentally, rhythm patterns closer to the input rhythm pattern are output earlier than rhythm patterns less close the input rhythm pattern, and also in such a manner that rhythm patterns coinciding with the input rhythm pattern are displayed in descending order of closeness to a tempo of the input rhythm pattern.

—Correction is Made in Such a Manner that a Distance of a Rhythm Pattern Having a Tone Color Close to that of an Input Pattern is Calculated as a Small Value—

<Modification 17>

The calculation of a distance between rhythm patterns at step Sb7 may be performed in the following manner rather than the above-described. Namely, in modification 17, the control section 21 multiplies the right side of any one of the aforementioned mathematical expressions, applicable to step Sb7, by a degree of coincidence between a tone color designated at the time of input of the rhythm pattern and a tone color of a rhythm pattern to be compared against the input rhythm pattern. Note that the degree of coincidence may be calculated in any well-known manner. Let it be assumed here that a smaller value of the degree of coincidence indicates that the two rhythm patterns are closer to each other in tone pitch while a greater value of the degree of coincidence indicates that the two rhythm patterns are less close to each other in tone pitch. In this way, the user can readily obtain, as searched-out results, rhythm pattern records of tone colors close to the tone color which the user feels when inputting the rhythm pattern, and thus, the user can have a more feeling of satisfaction with the searched-out results.

As an example specific scheme of searching with a tone color taken into consideration, the following is conceivable. First, tone color data (specifically, respective program numbers and MSBs (Most Significant Bits) and LSBs (Least Significant Bits) of tone colors) used in individual performance parts are described in advance in the style table in association with their respective tone color IDs. The user inputs a rhythm pattern after designating tone color data via the operation section 25. Then, the control section 21 performs control such that style data sets corresponding to tone color data coinciding with the designated tone color data are readily output as searched-out results. Alternatively, a data table where degrees of similarity of the individual tone data are described on a tone color ID by tone color ID basis may be prestored in the storage section 22, and the control section 21 may search for style data sets having tone color IDs of tone color data having high degrees of similarity to the designated tone color data.

—Correction is Made in Such a Manner that a Distance of a Rhythm Pattern of a Genre Closer to that of an Input Rhythm Pattern is Calculated as a Small Value—

<Modification 18>

The calculation of a distance between rhythm patterns at step Sb7 may be performed in the following manner rather than the above-described. Namely, in modification 18, the user can designate, at the time of input of a rhythm pattern, a genre via the operation section 25. In modification 18, the control section 21 multiplies the right side of any one of the aforementioned mathematical expressions, applicable to step Sb7, by a degree of coincidence between the genre designated at the time of input of the rhythm pattern and a genre of a rhythm pattern to be compared against the input rhythm pattern. Here, genres may be classified stepwise or hierarchically into a major genre, middle genre and minor genre. The control section 21 may calculate a degree of coincidence of genre in such a manner that a distance between a rhythm pattern record of a genre coinciding with the designated genre, or a rhythm pattern record including the designated genre, and the input pattern becomes small, or in such a manner that a distance between a rhythm pattern record of a genre not coinciding with the designated genre, or a rhythm pattern record not including the designated genre, and the input pattern becomes great, and then, the control section 21 may perform correction on the mathematical expression to be used at step Sb7. In this manner, the user can more easily obtain, as searched-out results, rhythm pattern records coinciding with the genre designated by the user at the time of input of a rhythm pattern or including the designated genre.

The foregoing has been a description about variations of the manner or method for calculating a distance between rhythm patterns.

—Manner of Calculation of a Distance Between an Input Rhythm Pattern and a Rhythm Category—

The aforementioned methods for calculating an input rhythm pattern and a rhythm pattern are merely illustrative, and such a distance may be calculated in any other different manners, or using any other different methods, as explained below.

—Number of Input Intervals Unique to a Category—

<Modification 19>

In modification 19, the control section 21 calculates a distance between an input rhythm pattern and each of rhythm patterns on the basis of the number of ON-set time intervals symbolic of, or unique to, the rhythm pattern, which is to be compared against the input rhythm pattern, included in the input rhythm pattern. FIG. 24 is a diagram showing an example of an ON-set time interval table that is prestored in the storage section 22. The ON-set time interval table comprises combinations of names indicative of classifications of the rhythm categories and target ON-set time intervals of the individual rhythm categories. Note that content of the ON-set time interval table is predetermined with the ON-set time intervals normalized with one measure divided into 48 equal time segments.

Let it be assumed here that the control section 21 has calculated ON-set time intervals from ON-set times of the input rhythm pattern and then calculated a group of values indicated in (d) below as a result of performing a quantization process on the calculated ON-set time intervals.

(d) 12, 6, 6, 6, 6, 6

In accordance with the calculated group of values and the ON-set time interval table shown in FIG. 24, the control section 21 identifies that there are one fourth(-note) ON-set time interval and five eighth(-note) ON-set time intervals in the input rhythm pattern. Then, the control section 21 calculates a distance between the input rhythm pattern and each of the rhythm categories as follows:

distance between the input rhythm pattern and a rhythm category $N$=1−{(the number of relevant ON-set time intervals, in the input rhythm pattern, of the rhythm category $N$)/(the total number of ON-set time intervals in the input rhythm pattern)} mathematical expression (6)

Note that the above mathematical expression is merely illustrative, and that any other mathematical expression may be employed as long as it causes the distance of the rhythm category from the input pattern to be calculated to be a smaller value as the rhythm category contains more target ON-set time intervals. Also, using mathematical expression (6) above, the control section 21 calculates, for example, a distance between the input rhythm pattern and eighth(-note) rhythm pattern as “0.166”, or a distance between the input rhythm pattern and quadruple(-note) rhythm pattern as "0.833". In the aforementioned manner, the control section 21 calculates a distance between the input rhythm pattern and each of the rhythm categories, and determines that the input rhythm pattern belong to a particular rhythm category for which the calculated distance is the smallest among the rhythm categories.

—Matrix Between DB Rhythm Categories and Input Rhythm Categories—

<Modification 20>

The method for calculating a distance between the input rhythm pattern and a rhythm category is not limited to the aforementioned and may be modified as follows. Namely, in modification 20, a distance reference table is prestored in the storage section 22. FIG. 20 is a diagram showing an example of the distance reference table where distances between rhythm categories which input patterns can belongs to and categories which individual rhythm pattern records stored in the automatic accompaniment database 222 can belong to are indicated in a matrix configuration. Let it be assumed here that the control section 21 has determined that the rhythm category which an input pattern belong to is the eighth (i.e., eighth-note) rhythm category. In this case, the control section 21 identifies, on the basis of the rhythm category which the input pattern has been determined to belong to and the distance reference table, distances between the input rhythm pattern and the individual rhythm categories. For example, in this case, the control section 21 identifies a distance between the input rhythm pattern and the fourth (fourth-note) rhythm category as "0.8" and identifies a distance between the input rhythm pattern and the eighth rhythm category as "0". Thus, the control section 21 determines that the eighth rhythm category is smallest in distance from the input rhythm pattern.

—Based on an Input Time Unique to a Category and a Score—

<Modification 21>

The method for calculating a distance between an input rhythm pattern and a rhythm category is not limited to the above-described and may be modified as follows. Namely, in modification 21, the control section 21 calculates a distance between an input rhythm pattern and each of the rhythm categories on the basis of the number of ON-set times, in the input rhythm pattern, symbolic of symbolic of, or unique to, a rhythm category to be compared against the input rhythm pattern. FIG. 26 is a diagram showing an example of an ON-set time table that is prestored in the storage section 22*a*. The ON-set time table comprises combinations of names indicative of classifications of rhythm categories, subject or target ON-set times in the individual rhythm categories, and scores to be added in a case where the input rhythm pattern includes the target ON-set times. Note that the content of the ON-set time table is predetermined as normalized with one measure segmented into 48 equal segments.

Let it be assumed here that the control section 21 has obtained ON-set times as indicated at (e) below.

(e) 0, 12, 18, 24, 30, 36, 42

In this case, the control section 21 calculates a score of an input rhythm pattern relative to each of the rhythm categories. Here, the control section 21 calculates "8" as a score of the input rhythm pattern relative to the fourth rhythm category, "10" as a score of the input rhythm pattern relative to the eighth rhythm category, "4" as a score of the input rhythm pattern relative to the eighth triplet rhythm category, and "7" as a score of the input rhythm pattern relative to the sixteenth rhythm category. Then, the control section 21 determines, as a rhythm category having the smallest distance from the input rhythm pattern, the rhythm category for which the calculated score is the greatest.

The foregoing has been a description about variations of the method for calculating a distance between an input rhythm pattern and each of the rhythm categories.

—Search Using a Tone Pitch Pattern—

<Modification 22>

The search may be performed on the basis of a tone pitch pattern input by the user after designating a performance part. For convenience of description, the modified search will be described in relation to the above-described second embodiment and third embodiment. In the following description of modification 22, the item name "rhythm pattern ID" in the rhythm pattern table shown in FIG. 13A is referred to as "pattern ID". Further, in modification 22, an item "tone pitch pattern data" is added to the rhythm pattern table of FIG. 13A. The tone pitch pattern data is a data file having recorded therein variation along a time series of pitches of individual component sounds in a phrase constituting a measure. For example, the tone pitch pattern data is a text data file having recorded therein variation along a time series of pitches of individual component sounds in a phrase constituting a measure. Further, as noted above, ON-set information includes note numbers of the keyboard in addition to trigger data. A series of ON-set times in the trigger data corresponds to an input rhythm pattern, and a series of note numbers of the keyboard corresponds to an input pitch pattern. Here, the information processing device 20 may search for a tone pitch pattern, using any one of the conventionally-known methods. For example, when the user has input a tone pitch sequence of "C-D-E" after designating "chord" as the performance part, the control section 21 of the information processing device 20 outputs, as a searched-out result, a rhythm pattern record having tone pitch data representing the tone pitch progression of the sequence represented by relative numerical values "0-2-4".

Further, when, for example, the user has input a tone pitch pattern of "D-D-E-G" after designating "phrase" as the performance part, the control section 21 generates MIDI information indicative of the input pitch pattern. The control section 21 outputs, as searched-out results, tone pitch pattern records having tone pitch pattern data identical to or similar to the MIDI information from among tone pitch records contained in the rhythm pattern table. Switching may be made, by the user via the operation section 25 of the information processing device 20, between such a search using a tone pitch pattern and a search using a rhythm pattern.

—Search Designating Both a Rhythm Pattern and a Tone Pitch Pattern—

Of results of a search performed using or designating a rhythm pattern input by the user after designating a performance part, a rhythm pattern more similar in tone pitch pattern to the input rhythm pattern may be output as a searched-out result. For convenience of description, this modification will be described in relation to the above-described second embodiment and third embodiment. In modification 23, each of the rhythm pattern records in the rhythm pattern table includes not only "pattern IDs" and "tone pitch pattern data" of individual performance parts.

FIG. 27 is a schematic diagram explanatory of the search using a tone pitch pattern, in (a) and (b) of which the horizontal axis represents the passage of time while the vertical axis represents various tone pitches. In modification 23, the following processes are added to the above-described search processing flow of FIG. 5. Let it be assumed here that the user has operated the bass inputting range keyboard 11*a* to input a tone pitch pattern "C-E-G-E" in a fourth(-note) rhythm. The input pitch pattern is represented, for example, by a series of note numbers "60, 64, 67, 64". (a) of FIG. 27 represents such a tone pitch pattern. Because the performance part here is "bass", the rhythm pattern search section 214 identifies, as objects of comparison, tone pitch pattern records whose part ID is "01 (bass)" and calculates a difference, from the input pitch pattern, tone pitch pattern data included in each of these tone pitch pattern records identified as the objects of comparison.

The control section 21 calculates a tone pitch interval variance between the input pitch pattern and a tone pitch pattern represented by tone pitch pattern data included in each of the tone pitch pattern records whose part ID is "01 (bass)"; the latter tone pitch pattern will hereinafter be referred to as "sound-source tone pitch pattern". This is based on the thought that the less variation there is in tone pitch interval difference, the more similar two melody patterns can be regarded. Assume here that the input pitch pattern is represented by "60, 64, 67, 64" as note above and a given sound-source tone pitch pattern is represented by represented by "57, 60, 64, 60". In (b) of FIG. 27, the input pitch pattern and the sound-source tone pitch pattern are shown together. In this case, a tone pitch interval variance between the input pitch pattern and the sound-source tone pitch pattern can be calculated in accordance with mathematical expression (8) by calculating an average value of tone pitch intervals in accordance mathematical expression (7) below.

$$\{(|60-57|)+(|64-60|)+(|67-64|)+(|64-60|)\}/4=3.5 \qquad \text{mathematical expression (7)}$$

$$\{(|3.5-3|)^2+(|3.5-4|)^2+(|3.5-3|)^2+(|3.5-4|)^2\}/4=0.25 \qquad \text{mathematical expression (8)}$$

As shown in the mathematical expressions above, a tone pitch difference variance between the input pitch pattern represented by "60, 64, 67, 64" and the sound-source tone pitch pattern represented by "57, 60, 64, 60" is calculated as "0.25". The control section 21 calculates such a tone pitch interval variance for all of sound-source tone pitch patterns.

Next, at step Sb7, the control section 21 obtains a degree of similarity between the input rhythm pattern and the searched-out rhythm patterns with their respective tone pitch patterns taken into account. If a degree of similarity between the input rhythm pattern and each of the searched-out rhythm patterns without their respective tone pitch patterns taken into account is defined as "S" and the tone pitch difference variance is defined as "V", then a degree of similarity Sp between the input rhythm pattern and each of the searched-out rhythm patterns with their respective tone pitch patterns taken into account can be expressed by the following mathematical expression (9) using a variable x and a constant y, where $0 \le x \le 1$ and $y>0$:

$$Sp=(1-x)S+xyV \qquad \text{mathematical expression (9)}$$

If the variable x is "0", the above mathematical expression becomes "Sp=S", the calculated degree of similarity will not reflect the tone pitch patterns. As the variable x approaches a value "1", the degree of similarity obtained by the above mathematical expression reflects more of the tone pitch patterns. The variable x may be made changeable in value by the user via the operation section 25. Further, in mathematical expression (9), an average error of tone pitch differences may be used in place of the tone pitch difference variance. Then, the control section 21 rearranges the searched-out rhythm patterns in the descending order of the degrees of similarity (i.e., ascending order of the distances) between the searched-out rhythm patterns and the input rhythm pattern calculated with the tone pitch patterns taken into account, and then stores the rearranged searched-out rhythm patterns into the RAM.

Further, the ON-set times and the number of ON-sets in the input pitch pattern and the ON-set times and the number of ON-sets of individual notes constituting a sound-source tone pitch pattern do not necessarily coincide with each other. In such a case, the control section 21 determines, for each of the ON-sets of the input pitch pattern, which of the notes of the sound-source tone pitch pattern corresponds to that ON-set of the input pitch pattern, in accordance with the following operational step sequence.

(31) The control section 31 calculates, using the ON-set times of individual notes of an input tone pitch pattern as calculation bases, a tone pitch difference between the ON-set of each of the notes of the input pitch pattern and a note of an ON-set time of the sound-source tone pitch pattern closest to the ON-set of the note of the input pitch pattern.

(32) The control section 31 calculates, using the ON-set times of the individual notes of the sound-source tone pitch pattern as calculation bases, a tone pitch difference between the ON-set of each of the notes of the sound-source tone pitch pattern and the note of an ON-set time of the input pitch pattern closest to the ON-set of the note of the sound-source tone pitch pattern.

(33) Then, the control section 31 calculates, as a tone pitch difference between the input pitch pattern and the sound-source tone pitch pattern, an average value between the difference calculated at step (31) and the difference calculated at step (32).

Note that, in order to reduce the quantity of necessary calculations, the tone pitch difference between the input pitch pattern and the sound-source tone pitch pattern may be calculated using only any one of steps (31) and (32) above. Also note that the method for calculating a degree of similarity between the input rhythm pattern and each of the searched-out rhythm patterns with their tone pitch patterns taken into account is not limited to the aforementioned and any other suitable method may be used for that purpose.

Further, if an absolute value of a difference between corresponding tone pitches is divided by "12", it is possible to search out not only an accompaniment similar to the input pitch pattern itself but also an accompaniment similar in 12-tone tone pitch pattern to the input pitch pattern. The following describe a case where tone pitches are represented by note numbers and where a comparison is made between tone pitch pattern A of "36, 43, 36" and tone pitch pattern B of "36, 31, 36". Although the two tone pitch patterns differ from each other, the two patterns represent same component sounds "C, G, C" of which the note number of "G" is different by one octave between the two patterns. Thus, tone pitch pattern A of "36, 43, 36" and tone pitch pattern B can be regarded as similar tone pitch patterns. The control section 21 calculates a difference in 12-tone tone pitch pattern between tone pitch patterns A and B, in accordance with mathematical expressions (10) and (11) below.

$$(|36-36|/12)+(|43-31|/12)+(|36-36|/12)=0 \qquad \text{mathematical expression (10)}$$

$$(|0-0|\hat{}2)(|0-0|\hat{}2)(|0-0|\hat{}2)=0 \qquad \text{mathematical expression (11)}$$

Because tone pitch patterns A and B coincide with each other in 12-tone tone pitch variation pattern, similarity in 12-tone tone pitch pattern between tone pitch patterns A and B is calculated as "0". Namely, in this case, tone pitch pattern B is output as a tone pitch pattern most similar to tone pitch pattern A. If not only a degree of similarity to the input pitch pattern itself but also a 12-tone tone pitch variation pattern to the input pitch pattern is considered as set forth above, the user can have an even more feeling of satisfaction.

Further, a searched-out result may be output on the basis of a value of similarity determined with both the input pitch pattern itself and the 12-tone tone pitch variation pattern taken into account. A mathematical expression to be used in this case can be expressed like the following mathematical expression (13):

$$\text{similarity in rhythm pattern with both the input pitch pattern itself and the 12-tone tone pitch variation pattern taken into account} = (1-X)\times(\text{similarity in rhythm pattern}) + XY\{(1-\kappa)(\text{similarity in tone pitch pattern}) + \kappa(\text{similarity in 12-tone tone pitch variation pattern})\}, \quad \text{mathematical expression (13)}$$

where X, Y and κ are predetermined constants that satisfy $0 \le x \le 1$, $Y>0$ and $0<\kappa<1$. Note that the above mathematical expressions are merely illustrative and should not be construed as so limited.

In the aforementioned manner, rhythm patterns record close to not only a user-intended rhythm pattern but also a user-intended tone pitch pattern can be output as searched-out results. Thus, the user can obtain, as a searched-out result, a rhythm pattern record that is identical in rhythm pattern to an input rhythm pattern but different in tone pitch pattern from the input rhythm pattern.

—Search Using Both Trigger Data and Velocity Data—

<Modification 24>

The control section 21 may search through the rhythm DB (database) 221 and automatic accompaniment DB 222 using both trigger data and velocity data generated in response to performance operation by the user. In this case, if there exist two rhythm pattern data having extremely similar rhythm patterns, the control section 21 outputs, as a searched-out result, rhythm pattern data where attack intensity of individual component sounds described in attack intensity pattern data is closer to the velocity data generated in response to the user's performance operation. In this way, for attack intensity too, automatic accompaniment data sets close to a user's image can be output as searched-out results.

<Modification 25>

Further, when searching through the rhythm DB 221 and the automatic accompaniment DB 222, the control section 21 may use, in addition to trigger data and velocity data, duration data indicative of a time length for which audible generation of a same sound continues or lasts. The duration data of each component sound is represented by a time length calculated by subtracting, from an OFF-set time, an ON-set time immediately preceding the OFF-set time of the component sound. Particularly, in a case where the input means of the rhythm input device 10 is a keyboard, the duration data can be used very effectively because the duration data allows the information processing device 20 to clearly acquire the OFF-set time of the component sound. In this case, an item "Duration Pattern Data" is added to the phrase table and the rhythm pattern table. The duration pattern data is a data file, such as a text file, having recorded therein duration (audible generation time lengths) of individual component sounds of a phrase constituting one measure. In this case, the information processing device 20 may be constructed to search through the phrase table by use of a user-input duration pattern of one measure and output, as a searched-out result from the phrase table or rhythm pattern table, a phrase record or a rhythm pattern record having duration pattern data most similar (or closest) to the user-input duration pattern. Thus, even where a plurality of phrase records or rhythm pattern records having similar rhythm patterns exist, the information processing device 20 can identify and output a particular rhythm pattern, having a slur, staccato (bounce feeling) or the like, from among the similar rhythm patterns.

—Search for Automatic Accompaniment Data Sets Similar in Tone Color to an Input Rhythm Pattern—

<Modification 26>

The information processing device 20 may search for automatic accompaniment data sets including a phrase of a tone color identical to or having a high degree of similarity to a tone color of an input rhythm pattern. For example, for that purpose, identification information identifying tone colors to be used may be associated in advance with individual rhythm pattern data; in this case, when the user is about to input a rhythm pattern, the user designates a tone color so that the rhythm patterns can be narrowed down to rhythm patterns to be audibly generated with a corresponding tone color and then particular rhythm patterns having a high value of similarity can be searched out from among the narrowed-down rhythm patterns. For convenience of description, this modification 26 will be described in relation to the above-described second embodiment and third embodiment. In this case, an item "tone color ID" is added in the rhythm pattern table. In inputting a rhythm pattern via any of the performance controls, the user designates a tone color, for example, via the operation section 25; the designation of a tone color may be performed via any of the controls provided in the rhythm input device 10. Once the user executes performance operation, the ID of a tone color designated by the user in executing the performance operation is input to the information processing device 20 as a part of MIDI information. Then, the information processing device 20 compares a tone color of a sound based on the input tone color ID and a tone color based on a tone color ID in each of rhythm pattern records of a designated performance part contained in the rhythm pattern table, and, if the compared tone colors have been determined in predetermined correspondence relationship on the basis of a result of the comparison, then the information processing device 20 identifies that rhythm pattern record to be similar to the input rhythm pattern, The correspondence relationship is predetermined such that the compared two tone colors can be identified to be of a same musical instrument type on the basis of the result of the comparison, and the predetermined correspondence relationship is prestored in the storage section 22*a*. The aforementioned tone color comparison may be made in any conventionally-known method, e.g. by comparing spectra in respective sound waveforms. In the aforementioned manner, the user can acquire automatic accompaniment data sets not only similar in rhythm pattern to the input rhythm pattern, but also similar in tone color to the input rhythm pattern in terms of the designated performance part. An example specific method for such a search may be generally the same as the one described above in relation to Modification 17.

<Modification 27>

Whereas the above embodiments have been described as determining that a sound generation time interval histogram has a high value of similarity to an input time interval histogram when an absolute value of a difference between the input time interval histogram and the sound generation time interval histogram is the smallest, the condition for determining a high degree of similarity between the two histograms is not limited to the absolute value of the difference between the two histograms and may be any other suitable condition, such as a condition that a degree of correlation between the two histograms, such as a product of individual time interval components of the two histograms, is the greatest or greater than a predetermined threshold value, a condition that the square of the difference between the two histograms is the smallest or smaller than a predetermined threshold value, or a condition that the individual time interval components are similar in value between the two histograms, or the like.

<Modification 28>

Whereas the above embodiments have been described in relation to the case where the information processing device 20 searches for and retrieves a tone data set having a rhythm pattern similar to a rhythm pattern input via the rhythm input device 10 and converts a searched-out tone data set into sounds for audible output, the following modified arrangement may be employed. For example, in a case where the processing performed by the above embodiments is performed by a Web service, the functions possessed by the information processing device 20 in the above embodiments are possessed by a server apparatus providing the Web service, and a user's terminal, such as a PC, that is a client apparatus, transmits an input rhythm pattern to the server apparatus via the Internet, dedicated line, etc. On the basis of the input rhythm pattern received from the client apparatus, the server apparatus searches through a storage section for a tone data set having a rhythm pattern similar to the input rhythm pattern and then transmits a searched-out result or searched-out tone data set to its terminal. Then, the terminal audibly outputs sounds based on the tone data set received from the server apparatus. Note that, in this case, the bar line clock signals may be presented to the user in the Web site or application provided by the server apparatus.

<Modification 29>

The performance control in the rhythm input device 10 may be of other than a drum pad type or a keyboard type, such as a string instrument type, wind instrument type or button type, as long as it outputs at least trigger data in response to performance operation by the user. Alternatively, the performance control may be a tablet PC, smart phone, portable or mobile phone having a touch panel, or the like.

Let's now consider a case where the performance control is a touch panel. In some cases, a plurality of icons are displayed on a screen of the touch panel. If images of musical instruments and controls (e.g., keyboard) of musical instruments are displayed in the icons, the user can know which of the icons should be touched to audibly generate a tone based on a particular musical instrument or particular control of a musical instrument. In this case, regions of the touch panel where the icons are displayed correspond to the individual performance controls provided in the above-described embodiments.

—Reproducible with an Original BPM Rather than a Designated BPM—

<Modification 30>

Because each of the rhythm pattern records includes information indicative of an original BPM in the above-described second and third embodiments, the control section 21 may be arranged to reproduce tones, represented by a tone data set included in the rhythm pattern record, with the original BPM in response to operation performed by the user via the operation section 25. Further, once a particular rhythm pattern record is selected by the user from among searched-out results and the control section 21 identifies the thus-selected rhythm pattern record, the control section 21 may perform control in such a manner that tones, represented by the tone data set included in the rhythm pattern record, are reproduced with a user-input or user-designated BPM at a stage immediately following the identification of the selected rhythm pattern record and then the BPM gradually approaches the original BPM of the rhythm pattern record as the time passes.

<Modification 31>

The method for allowing the user to have a feeling of satisfaction with searched-out results should not be construed as limited to the above-described filtering function.

—Weighting Similarity with a BPM Difference—

For convenience of description, this modification 31 will be described in relation to the above-described second embodiment and third embodiment. For example, weighting based on a difference between an input BPM and an original BPM of a rhythm pattern record contained in the rhythm pattern table may be applied to the mathematical expression for calculating a distance between the input rhythm pattern and the rhythm pattern record contained in the rhythm pattern table. Assuming that "a" represents a predetermined constant and "L" represents a distance between the input rhythm pattern and the rhythm pattern record contained in the rhythm pattern table, a mathematical expression for calculating similarity with the weighing applied can be expressed as follows:

$$\text{similarity}=L+|\text{input BPM}-\text{BPM of the rhythm pattern record}|/a \qquad \text{mathematical expression (14)}$$

Note, however, that the mathematical expression for calculating such similarity is not limited to mathematical expression (14) above and any other mathematical expression may be employed as long as the similarity decreases (i.e., the degree of similarity increases) as the input BPM and the BPM of the rhythm pattern record are closer to each other.

<Variation of the Filtering>

Although the filtering may be used such that displayed results are narrowed down by the user designating a particular object of display via a pull-down list as in the above-described embodiments, the displayed results may alternatively be automatically narrowed down through automatic analysis of performance information obtained from input of a rhythm pattern. Further, a chord type or scale may be identified on the basis of pitch performance information indicative of pitches of a rhythm input via a keyboard or the like so that accompaniments registered with the identified chord type or scale can be automatically displayed as searched-out results. For example, if a rhythm has been input with a rock-like chord, it becomes possible for a rock style to be searched out with ease. Further, if a rhythm has been input with a Middle-East-like scale, then it becomes possible for a Middle-East-like phrase to be searched out with ease. Alternatively, searching may be performed on the basis of tone color information indicative of a tone color designated at the time of input via a keyboard in such a manner that accompaniments having the same tone color information as the input tone color information and the same rhythm pattern as the input rhythm are searched out. For example, if a rhythm has been input with a rimshot on a snare drum, accompaniments of a rimshot tone color can be displayed with priority from among candidates having the same rhythm pattern as the input rhythm.

—Drum Input Via a Keyboard Instead of a Pad—

<Modification 32>

If the rhythm input device 10 includes no input pad 12 in the above-described second and third embodiments, the rhythm input device 10 may be constructed as follows. Here, by default, the bass inputting range keyboard 11*a*, chord inputting range keyboard 11*b* and phrase inputting range keyboard 11*c* are allocated to respective predetermined key ranges of the keyboard 11. Once the user instructs that the user is about to input a rhythm pattern for drums parts, the control section 21 allocates the drums parts to predetermined key ranges of the keyboard 11; for example, the control section 21 allocates the bass drum part to "C3", the snare drum part to "D3", the high-hat part to "E3", and the cymbal part to "F3". Note that, in this case, the control section 21 can allocate different musical instrument tones to individual controls (i.e., individual keys) located in the entire key range of the keyboard 11. Further, the control section 21 may display images of allocated musical instruments (e.g., image of the snare drum and the like) above and/or below the individual controls (keys) of the keyboard 11.

—Allows the User to Readily Visually Identify Controls of Performance Parts—

<Modification 33>

The second and third embodiments may be arranged as follows in order to allow the user to readily visually identify which of the controls should be operated to cause the control section 21 to perform a search for a particular performance part. For example, the control section 21 displays, above or below each predetermined one of the controls (keys), an image of an allocated performance part (e.g., an image of a guitar being depressed for a chord performance, an image of a piano being played for a single tone (like an image of a single key being depressed by a finger), or image of the snare drum). The above-mentioned images may be displayed on the display section 24 rather than above or below the predetermined controls (keys). In such a case, not only a keyboard image simulating, for example, the keyboard 11 is displayed on the display section 24, but also images of performance parts allocated to respective key ranges of the keyboard image in the same allocated state as on the actual keyboard 11 are displayed on the display section 24. Alternative arrangement may be made as follows for allowing the user to readily auditorily identify which of the controls should be operated to cause the control section 21 to perform a search for a particular performance part. For example, once the user makes input to the bass inputting range keyboard 11*a*, the control section 21 causes the sound output section 26 to output a bass sound. In the aforementioned manner, the user can visually or auditorily identify which of the controls should be operated to cause the control section 21 to perform a search for a particular performance part, and thus, user's input operation can be facilitated; as a result, the user can obtain any desired accompaniment sound source with an increased ease.

—Searching Calculations: Processing Turns Changeable—

<Modification 34>

Whereas the processing flow of FIG. 5 has been described above in relation to the case where a distribution of ON-set time intervals in an input rhythm pattern is calculated (step Sb3) after a distribution of ON-set time intervals is calculated for each of the rhythm categories (step Sb1), the processing turns of steps Sb1 and Sb3 may be reversed. Further, irrespective of the reversal of the processing turns of steps Sb1 and Sb3, the control section 21 may store the distribution of ON-set time intervals, calculated for each of the rhythm categories, into the storage section 22 after the calculation. In this way, there is no need for the control section 21 to recalculate the once-calculated results, which can achieve an increased processing speed.

—Rounding of a Chord—

<Modification 35>

According to the above-described first to third embodiments, when the user inputs a rhythm pattern by operating a plurality of controls within a predetermined time period, e.g. when the user depresses the bass inputting range keyboard 11*a* to input a chord, there would arise the following problem. Let it be assumed here that the user has input a rhythm at a time point of "0.25" within a measure. In this case, even when the user attempts to operate a plurality of controls at a same time point, the user may, in effect, operate only some of the controls at an ON-set time of "0.25" and others of the controls at an ON-set time of "0.26", in which case the control section 21 would store the input rhythm pattern exactly at these ON-set times. Consequently, searched-out results different from the user's intention may be undesirably output; thus, good operability cannot be provided to the user. To address the problem, the following arrangements may be employed. For convenience of description, the following arrangements will be described in relation to the above-described second embodiment and third embodiment.

In this modification 35, the control section 21 determines, on the basis of ON-set information input from the rhythm input device 10 and the part table contained in the automatic accompaniment DB 211, whether or not user's operation has been performed on a plurality of controls at a same time point for a same performance part. For example, if a difference between an ON-set time of one of the controls included in the bass inputting range keyboard 11*a* and an ON-set time of another of the controls included in the bass inputting range keyboard 11*a* falls within a predetermined time period, then the control section 21 determines that these controls have been operated at the same time point. Here, the predetermined time period is, for example, 50 msec (millisecond). Then, the control section 21 outputs a result of the determination, i.e. information indicating that the plurality of controls can be regarded as having been operated at the same time point, to the control section 21 in association with trigger data having the above-mentioned ON-set times. Then, the control section 21 performs a rhythm pattern search using the input rhythm pattern after excluding, from the input rhythm pattern, one of the trigger data (with which has been associated the information indicating that the plurality of controls can be regarded as having been operated at the same time point) that has the ON-set time indicative of a later sound generation start time than the ON-set time of the other trigger data. Namely, in this case, of the ON-set times based on the user's operation within the predetermined time period, the ON-set time indicative of an earlier sound generation start time will be used in the rhythm pattern search. Alternatively, however, of the ON-set times based on the user's operation within the predetermined time period, the ON-set time indicative of an later sound generation start time may be used in the rhythm pattern search. Namely, the control section 21 may perform the rhythm pattern search using any one of the ON-set times based on the user's operation within the predetermined time period. As another alternative, the control section 21 may calculate an average value of the ON-set times based on the user's operation within the predetermined time period and then perform the rhythm pattern search using the thus-calculated average value as an ON-set time in the user's operation within the predetermined time period. In the aforementioned manner, even when the user has input a rhythm using a plurality of controls within a predetermined time period, searched-out results close to an user's intention can be output.

—Solution to a First Beat Lack Problem—

<Modification 36>

The following problem can arise if the control section 21 sets the timing for storing an input rhythm pattern on a per-measure basis to coincide with measure switching timing based on the bar line clock. For example, when a rhythm pattern is input through user's operation, an error in the range of several msec to dozens of msec may occur between a rhythm pattern intended by the user and an actual ON-set time due to differences between time intervals being felt by the user and the bar line clock signals. Therefore, even when the user thinks it is inputting a beat at the head of a measure, that beat may be erroneously treated as a rhythm input of a preceding measure due to the above-mentioned error. In such a case, searched-out results different from user's intention would be undesirably output; thus, good operability cannot be provided to the user. To address such a problem, the control section 21 only has to set, as a processing range, a range from a time point dozens of msec earlier than the head of the current measure (namely, last dozens of msec in the preceding measure) to a time point dozens of msec earlier than the end of the current measure, when storing the input rhythm pattern into the RAM. Namely, the control section 21 shifts a target range of the input rhythm pattern, which is to be stored into the RAM, forward by dozens of msec. In this way, this modification can prevent searched-out results different from user's intention from being output.

—Reproduction Immediately Following a Search—

<Modification 37>

The following problem can arise if the control section 21 sets the timing for performing a rhythm pattern search to coincide with the measure switching timing based on the bar line clock. For example, the search method of the present invention is also applicable to a tone data processing apparatus provided with a playback function that allows a searched-out tone data set to be played back or reproduced in synchronism with the bar line clock in a measure immediately following rhythm input. In this case, in order for the searched-out tone data set (searched-out result) to be reproduced from the head of a measure immediately following the rhythm input, the searched-out result has to be output before the time point of the head of the measure, i.e. within the same measure where the rhythm input has been made. Further, in a case where a tone data set to be reproduced cannot be read out and stored into the RAM in advance due to a storage capacity problem or the like of the RAM, there is a need to read out a searched-out tone data set and store the read-out tone data set into the RAM within the same measure where the rhythm input has been made. To address such a problem, the control section 21 only has to shift the timing for performing a rhythm pattern search to be dozens of msec earlier than the measure switching timing. In this way, the search is performed and a searched-out tone data set is stored into the RAM before the measure switching is effected, so that the searched-out tone data set can be reproduced from the head of the measure immediately following the rhythm input.

—Search for a Rhythm Pattern of a Plurality of Measures—

<Modification 38>

The following arrangements may be made for allowing a search for a rhythm pattern of a plurality of measures (hereinafter referred to as "N" measures) rather than a rhythm pattern of one measure. For convenience of description, the following arrangements will be described in relation to the above-described second embodiment and third embodiment. For example, in this case, a method may be employed in which the control section 21 searches through the rhythm pattern table by use of an input rhythm pattern having a group of the N measures. However, with this method, the user has to designate where the first measure is located, at the time of inputting a rhythm pattern in accordance with the bar line clock signals. Also, because searched-out results are output following the N measures, it would take a long time before the searched-out results are output. To address such an inconvenience, the following arrangements may be made.

FIG. 28 is a schematic diagram explanatory of processing for searching for a rhythm pattern of a plurality of measures. For convenience of description, the following arrangements will be described in relation to the above-described second embodiment and third embodiment. In modification 38, the rhythm pattern table of the automatic accompaniment DB 222 contains rhythm pattern records each having rhythm pattern data of N measures. The user designates, via the operation section 25, the number of measures in a rhythm pattern to be searched for. Content of such user's designation is displayed on the display section 24. Let's assume here that the user has designated "two" as the number of measures. Once the user inputs a rhythm by use of any of the controls, the control section 21 first stores an input rhythm pattern of the first measure and then searches for a rhythm pattern on the basis of the input rhythm pattern of the first measure. The search is performed in accordance with the following operational sequence. First, regarding the rhythm pattern records each having rhythm pattern data of two measures, the control section 21 calculates a distance between the input rhythm pattern of the first measure and rhythm patterns of the first measure and second measure of each of the rhythm pattern data. Then, for each of the rhythm pattern data, the control section 21 stores the smaller of the calculated distance between the input rhythm pattern of the first measure and the rhythm pattern of the first measure and the calculated distance between the input rhythm pattern of the first measure and the rhythm pattern of the second measure into the RAM. Then, the control section 21 performs similar operations for the input rhythm pattern of the second measure. After that, the control section 21 adds together the distances, thus stored in the RAM, for each of the rhythm pattern data, and then sets the sum (added result) as a score indicative of a distance of the rhythm pattern data from the input rhythm pattern. Then, the control section 21 rearranges, in ascending order of the above-mentioned scores, individual rhythm pattern data of which the above-mentioned score is less than a predetermined threshold value, and then outputs such rhythm pattern data as searched-out results. In the aforementioned manner, it is possible to search for rhythm pattern data each having a plurality of measures. Because a distance between the input rhythm pattern and the rhythm pattern data is calculated for each of the measures, there is no need for the user to designate where the first measure is located, and no long time is taken before the searched-out results are output.

—Input Pattern Acquisition Method 1: Coefficient 0.5→Rounding—

<Modification 39>

The control section 21 may store an input rhythm pattern into the RAM in the following manner, rather than in accordance with the aforementioned method. Mathematical expression (11) below is intended to acquire an nth input ON-set time in the input rhythm pattern. In mathematical expression (11) below, "L" represents the end of a measure with the head of the measure set at a value "0" and is a real number equal to or greater than "0". Further, in mathematical expression (11) below, "N" represents resolution that is specifically in the form of the number of clock signals within one measure.

$$[(n\text{th ON-set time}-\text{start time of the measure})/(\text{end time of the measure}-\text{start time of the measure})\times N+0.5]\times L/N \qquad \text{mathematical expression (11)}$$

In mathematical expression (11), the value "0.5" provides a rounding effect to a fraction, and it may be replaced with another value equal to or greater than "0" but smaller than "1". For example, if the value is set at "2", it provides a discarding-seven/retaining-eight effect to a fraction. This value is prestored in the storage section 22 and changeable by the user via the operation section 25.

As set forth above, phrase data and rhythm pattern data may be created in advance by a human operator extracting generation start times of individual component sounds from a commercially available audio loop material. With such an audio loop material, backing guitar sounds are sometimes intentionally shifted from their predetermined original timing in order to increase auditory thicknesses of the sounds. In such a case, phrase data and rhythm pattern data having fractions rounded up and rounded down can be obtained by adjusting the values of the above-mentioned parameters. Thus, the created phrase data and rhythm pattern data have the above-mentioned shifts eliminated therefrom, so that the user can input a rhythm pattern at desired timing without caring about the shifts from the predetermined original timing.

<Modification 40>

The present invention may be implemented by an apparatus where the rhythm input device 10 and the information processing device 20 are constructed as an integral unit. Such a modification will be described in relation to the above-described second embodiment and third embodiment. Note that the apparatus where the rhythm input device 10 and the information processing device 20 are constructed as an integral unit may be constructed, for example, as a portable telephone, mobile communication terminal provided with a touch screen, or the like. This modification 40 will be described below in relation to a case where the apparatus is a mobile communication terminal provided with a touch screen.

Figure 29:
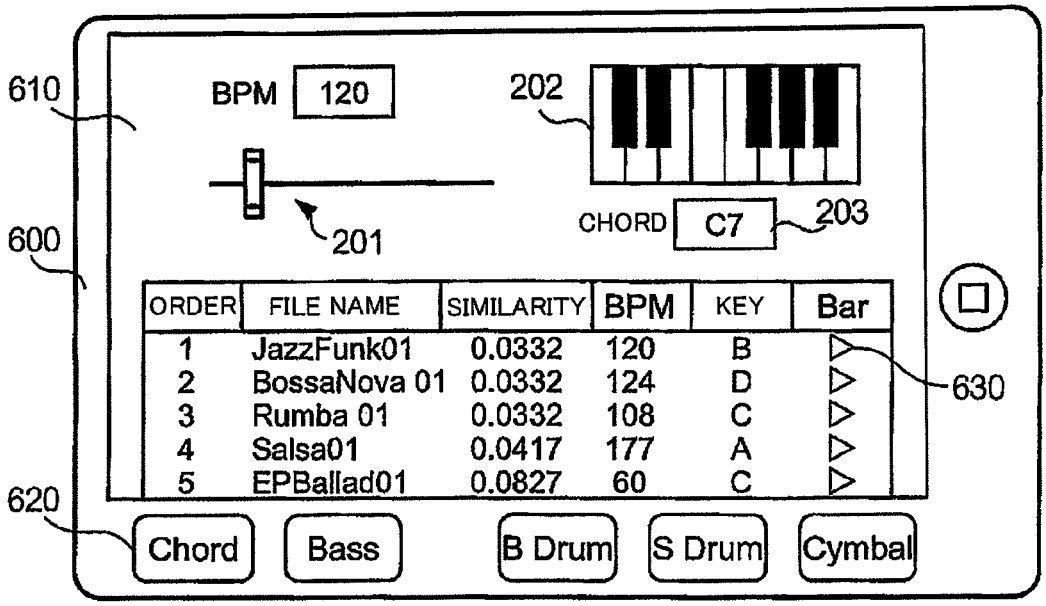
FIG. 29 is a diagram showing a mobile communication terminal.

FIG. 29 is a diagram showing the mobile communication terminal 600 constructed as modification 40. The mobile communication terminal 600 includes a touch screen 610 provided on its front surface. The user can perform operation on the mobile communication terminal 600 by touching a desired position of the touch screen 610, and content corresponding to the user's operation is displayed on the touch screen 610. Note that a hardware construction of the mobile communication terminal 600 is similar to the one shown in FIG. 11, except that the functions of the display section 24 and the operation section 25 are realized by the touch screen 610 and that the rhythm input device 10 and the information processing device 20 are constructed as an integral unit. The following describe the control section, the storage section and the automatic accompaniment DB using the same reference numerals and characters as in FIG. 11.

The BPM designating slider 201, key (musical key) designating keyboard 202 and chord designating box 203 are displayed on an upper region of the touch screen 610. These BPM designating slider 201, key designating keyboard 202 and chord designating box 203 are similar in construction and function to those described above in relation to FIG. 16. Further, a list of rhythm pattern records output as searched-out results is displayed on a lower region of the touch screen 610. Once the user designates any one of part selecting images 620 indicative of different performance parts, the control section 21 displays a list of rhythm pattern records output as searched-out results for the user-designated performance part.

Items "order", "file name", "similarity", "BPM" and "key" are similar to those described above in relation to FIG. 16. In addition, other related information, such as "genre" and "musical instrument type" may be displayed. Once the user designates any desired one of reproduction instructing images 630 from the list, a tone data set of the rhythm pattern record corresponding to the user-designated reproduction instructing image 630 is reproduced. Such a mobile communication terminal 600 too can achieve generally the same advantageous benefits as the above-described second embodiment and third embodiment.

<Modification 41>

The present invention may be practiced as other than the tone data processing apparatus, such as a method for realizing such tone data processing, or a program for causing a computer to implement the functions shown in FIGS. 4 and 14. Such a program may be provided to a user stored in a storage medium, such as an optical disk, or downloaded and installed into a user's computer via the Internet and/or the like.

<Modification 42>

In addition to the three types of search modes, i.e. automatic accompaniment mode, replacing search mode and follow-up search mode, employed in the above-described embodiments, switching to the following other modes may be effected. The first one is a mode in which the search processing is constantly running on a per-measure basis and one most similar to the input rhythm pattern or a predetermined number of searched-out results similar to the input rhythm pattern are reproduced automatically. This mode is applied primarily to an automatic accompaniment etc. The second one is a mode in which only metronome sounds are reproduced in response to the user instructing a start of a search and in which searched-out results are displayed automatically or in response to an operation instruction upon completion of rhythm input by the user.

<Modification 43>

As another modification of the first embodiment, when the search function is ON, the rhythm pattern search section 213 (FIG. 4) may display, in a list format, a plurality of accompaniment sound sources having more than a predetermined degree of similarity to a user-input rhythm pattern after having rearranged the plurality of accompaniment sound sources in descending order of the degrees of similarity. (a) and (b) of FIG. 30 are diagrams showing lists of searched-out results for the accompaniment sound sources. As shown in (a) and (b) of FIG. 30, the lists of searched-out results for the accompaniment sound sources each comprise a plurality of items, "File Name", "Degree of Similarity", "Key", "Genre" and "BPM" (Beats Per Minute). "File Name" uniquely identifies the name of an accompaniment sound source. "Degree of Similarity" is a value indicating how much a rhythm pattern of the accompaniment sound source is similar to an input rhythm pattern; a smaller value of the degree of similarity represents a higher degree of similarity (i.e., shorter distance, from the input rhythm pattern, of the rhythm pattern of the accompaniment sound source). "Key" indicates a musical key (tone pitch) of the accompaniment sound source. "Genre" indicates a musical genre (such as rock, Latin or the like) which the accompaniment sound source belongs to. "BPM" indicates the number of beats per minute and more specifically a tempo of the accompaniment sound source.

More specifically, (a) of FIG. 30 shows an example of a list of accompaniment sound sources which have rhythm patterns of more than a predetermined degree of similarity to a user-input rhythm pattern and which are displayed as searched-out results in the descending order of the degree of similarity. Here, the user can cause the searched-out results to be displayed after filtering the searched-out results using (i.e., focusing on) a desired one of the items, such as the "Key", "Genre" or "BPM". (b) of FIG. 10 shows a list of searched-out results having been filtered by the user focusing on "Latin" as the "Genre".

<Other Modifications>

Whereas the above embodiments have been described in relation to the case where the rhythm pattern difference calculation at step Sb6 uses two time differences, i.e. time difference of the rhythm pattern A based on the rhythm pattern B and time difference of the rhythm pattern B based on the rhythm pattern A, (so-called "symmetric distance scheme or method"), the present invention is not so limited, and only either one of the two time differences may be used in the rhythm pattern difference calculation.

Further, in a case where the above-described search or audible reproduction is performed using MIDI data and where performance data sets of a plurality of performance parts (sometimes also referred to as "parts") are reproduced in a multi-track fashion, the search may be performed only on a particular one of the tracks.

Furthermore, the rhythm category determination or identification operations (steps Sb2 to Sb5) may be dispensed with, in which case the rhythm pattern distance calculation operation of step Sb7 may be performed using only the result of the rhythm pattern difference calculation of step Sb6.

Furthermore, in the rhythm pattern difference calculation (step Sb6) in the first to third embodiments, the value of the calculated difference may be multiplied by the value of attack intensity of each corresponding component sound so that a phrase record including component sounds having greater attack intensity can be easily excluded from searched-out result candidates.

Furthermore, whereas the above embodiments have been described as using automatic accompaniment data sets each having a one-measure length, the sound lengths need not be so limited.

Further, in the above-described second and third embodiments, the user may designate a performance part by use of the operation section 25 rather than the performance controls. In this case, input is made for the designated performance part as the user operates the performance controls after designating a performance part. For example, in this case, even when the user operates the chord inputting range keyboard 11*b* after designating the "bass" part via the operation section 25, the control section 21 regards this user's operation as input of the "bass" part.

Furthermore, whereas the second and third embodiments have been described above in relation to the case where different pads, such as the bass drum input pad 12*a*, snare drum input pad 12*b*, high-hat input pad 12*c* and cymbal input pad 12*d*, are allocated to the individual rhythm parts of different tone colors in one-to-one relationship, the present invention is not so limited, and may be arranged in such a manner that input operation for rhythm parts of different tone colors can be performed via a single pad. In such a case, the user can designate a tone color of a desired rhythm part via the operation section 25.

Furthermore, whereas each of the embodiments has been described above in relation to the case where rhythm pattern data are represented in fractional values in the range from "0" to "1", rhythm pattern data may be represented in a plurality of integral values, for example, in the range of "0" to "96".

Furthermore, whereas the embodiments have been described above in relation to the case where a predetermined number of searched-out results having high similarity are detected, such a predetermined number of searched-out results may be detected on the basis of another condition than the aforementioned. For example, searched-out results having similarity falling within a predetermined range are detected, and such a predetermined range may be set by the user so that a search is made from the thus-set range.

Furthermore, the present invention may be equipped with a function for editing tone data, automatic accompaniment data, style data, etc. so that desired tone data, automatic accompaniment data and style data can be selected from a screen displaying searched-out results, and that the selected data are unrolled and displayed, on a part-by-part basis, on a screen displaying the selected data in such a manner that editing of various data, such as the desired tone data, automatic accompaniment data and style data can be done for each of the performance parts.

What is claimed is:

1. A tone data processing apparatus comprising:

a storage section storing therein tone data sets, each representative of a plurality of sounds in a predetermined time period, and tone rhythm patterns, each representative of a series of sound generation times of the plurality of sounds, in association with each other;

a notification section which not only causes designated times in the time period to progress in accordance with passage of time but also notifies a user of the designated times;

an acquisition section which, on the basis of operation input by a user while the designated times are being notified by said notification section, acquires an input rhythm pattern representative of a series of the designated times corresponding to a pattern of the operation input by the user; and a search section which searches the tone data sets stored in said storage section for a tone data set associated with a tone rhythm pattern whose degree of similarity to the input rhythm pattern satisfies a predetermined condition, wherein said storage section stores therein categories of rhythms, determined on the basis of the sound generation time intervals represented by the tone rhythm patterns, in association with the tone rhythm patterns, wherein said tone data processing apparatus further comprises: a determination section which, on the basis of intervals between the designated times represented by the input rhythm pattern, determines a category of rhythm the input rhythm pattern belongs to; and a calculation section which calculates a distance between the input rhythm pattern and each of the tone rhythm patterns, and wherein said search section calculates a degree of similarity between the input rhythm pattern and each of the tone rhythm patterns on the basis of relationship between the category of rhythm the input rhythm pattern belongs to and a category of rhythm the tone rhythm pattern belongs to, and the tone data set identified by said search section is a tone data set associated with a tone rhythm pattern of which the degree of similarity to the input rhythm pattern, calculated by said search section, satisfies a predetermined condition.

2. The tone data processing apparatus as claimed in claim 1, wherein said search section compares an input time interval histogram representative of a frequency distribution of sound generation times represented by the input rhythm pattern and a rhythm category histogram representative, for each the categories of rhythms, a frequency distribution of the sound generation time intervals in the tone rhythm patterns, to thereby identify a particular category of rhythm of the rhythm category histogram that presents high similarity to the input time interval histogram, and wherein the tone data identified by said search section is a tone data set associated with a tone rhythm pattern, included in the tone rhythm patterns associated with the identified category of rhythm, of which the degree of similarity to the input rhythm pattern satisfies a predetermined condition.

3. The tone data processing apparatus as claimed in claim 1, wherein the predetermined time period comprises a plurality of time segments, said storage section stores therein, for each of the time segments, a tone rhythm pattern representative of a series of sound generation times of the plurality of sounds and the tone data set in association with each other, said calculation section calculates a distance between the input rhythm pattern and the tone rhythm pattern of each of the time segments stored in said storage section, and said search section calculates a degree of similarity between the input rhythm pattern and the tone rhythm pattern on the basis of relationship among the distance between the input rhythm pattern and the tone rhythm pattern calculated for each of the time segments by said calculation section, the category of rhythm the input rhythm pattern belong to and the category of rhythm the tone rhythm pattern belong to, and wherein the tone data set identified by said search section is a tone data set associated with a tone rhythm pattern of which the calculated degree of similarity to the input rhythm pattern satisfies a predetermined condition.

4. The tone data processing apparatus as claimed in claim 1, which further comprises a supply section which, in synchronism with notification of the designated times by said notification section, supplies the tone data set, searched out by said search section, to a sound output section which audibly output sounds corresponding to the tone data set.

5. The tone data processing apparatus as claimed in claim 1, wherein said storage section stores therein tone pitch patterns, each representative of a series of tone pitches of sounds represented by a corresponding one of the tone data sets, in association with the tone data sets, wherein said tone data processing apparatus further comprises a tone pitch pattern acquisition section which, on the basis of operation input by the user while the designated times are being notified by said notification section, acquires an input pitch pattern representative of a series of tone pitches, wherein said search section calculates the degree of similarity between the input pitch rhythm and each of the tone pitch patterns further on the basis of a variance in tone pitch difference between individual sounds of the input pitch pattern and individual sounds of the tone pitch pattern, and wherein the tone data identified by said search section is a tone data set associated with a tone rhythm pattern of which the calculated degree of similarity to the input pitch pattern satisfies a predetermined condition.

6. The tone data processing apparatus as claimed in claim 1, wherein said storage section stores therein tone velocity patterns, each representative of a series of sound intensity represented by a corresponding one of the tone data sets, in association with the tone data sets, wherein said tone data processing apparatus further comprises a velocity pattern acquisition section which, on the basis of operation input by the user while the designated times are being notified by said notification section, acquires an input velocity pattern representative of a series of sound intensity, and wherein said search section calculates the degree of similarity between the input rhythm pattern and each of the tone rhythm patterns further on the basis of absolute values of differences in intensity between individual sounds of the input velocity pattern and individual sounds of the tone velocity pattern.

7. The tone data processing apparatus as claimed in claim 1, wherein said storage section stores therein tone duration patterns, each representative of a series of durations of sounds represented by a corresponding one of the tone data sets, in association with the tone data sets, wherein said tone data processing apparatus further comprises a duration pattern acquisition section which, on the basis of operation input by the user while the designated times are being notified by said notification section, acquires an input duration pattern representative of a series of sound intensity, and wherein said search section calculates the degree of similarity between the input rhythm pattern and each of the tone rhythm patterns further on the basis of absolute values of differences in duration between individual sounds of the input duration pattern and individual sounds of a corresponding one of the tone duration patterns.

8. A tone data processing system comprising:

an input device via which performance operation by a user is input; and a tone data processing apparatus recited in claim 1, the tone data processing apparatus acquiring, as a rhythm pattern representative of a series of sound generation times at which individual sounds are to be audibly generated, a series of time intervals at which individual performance operation has been input by the user to said input device while designated times in a predetermined time period are being caused to progress by a notification section of said tone data processing apparatus.

9. A computer-implemented method for searching for a tone data set, comprising:

a step of storing in a storage device tone data sets, each representative of a plurality of sounds in a predetermined time period, and tone rhythm patterns, each representative of a series of sound generation times of the plurality of sounds, in association with each other;

a notification step performed by a notification section of not only causing designated times in the time period to progress in accordance with passage of time but also notifying a user of the designated times;

a step of, on the basis of operation input by a user while the designated times are being notified by said notification step, acquiring by an acquisition section an input rhythm pattern representative of a series of the designated times corresponding to a pattern of the operation; and a step of searching by a search section the tone data sets stored in the storage device for a tone data set associated with a tone rhythm pattern whose degree of similarity to the input rhythm pattern satisfies a predetermined condition, wherein said storage device stores therein categories of rhythms, determined on the basis of the sound generation time intervals represented by the tone rhythm patterns, in association with the tone rhythm patterns, wherein said method further comprises: a step of, on the basis of intervals between the designated times represented by the input rhythm pattern, determining by a determination section a category of rhythm the input rhythm pattern belongs to; and a step of calculating by a calculation section a distance between the input rhythm pattern and each of the tone rhythm patterns, and wherein said step of searching calculates a degree of similarity between the input rhythm pattern and each of the tone rhythm patterns on the basis of relationship between the category of rhythm the input rhythm pattern belongs to and a category of rhythm the tone rhythm pattern belongs to, and the tone data set identified by said step of searching is a tone data set associated with a tone rhythm pattern of which the degree of similarity to the input rhythm pattern, calculated by said step of searching, satisfies a predetermined condition.

10. A non-transitory computer-readable storage medium storing therein a program executable by a computer for performing a method for searching for a tone data set, said method comprising:

a step of storing in a storage device tone data sets, each representative of a plurality of sounds in a predetermined time period, and tone rhythm patterns, each representative of a series of sound generation times of the plurality of sounds, in association with each other;

a notification step of not only causing designated times in the time period to progress in accordance with passage of time but also notifying a user of the designated times;

a step of, on the basis of operation input by a user while the designated times are being notified by said notification step, acquiring an input rhythm pattern representative of a series of the designated times corresponding to a pattern of the operation; and a step of searching the tone data sets stored in the storage device for a tone data set associated with a tone rhythm pattern whose degree of similarity to the input rhythm pattern satisfies a predetermined condition, wherein said storage device stores therein categories of rhythms, determined on the basis of the sound generation time intervals represented by the tone rhythm patterns, in association with the tone rhythm patterns, wherein said method further comprises: a step of, on the basis of intervals between the designated times represented by the input rhythm pattern, determining a category of rhythm the input rhythm pattern belongs to; and a step of calculating a distance between the input rhythm pattern and each of the tone rhythm patterns, and wherein said step of searching calculates a degree of similarity between the input rhythm pattern and each of the tone rhythm patterns on the basis of relationship between the category of rhythm the input rhythm pattern belongs to and a category of rhythm the tone rhythm pattern belongs to, and the tone data set identified by said step of searching is a tone data set associated with a tone rhythm pattern of which the degree of similarity to the input rhythm pattern, calculated by said step of searching, satisfies a predetermined condition.

11. A tone data processing apparatus comprising:

a storage section storing therein tone data sets, each representative of a plurality of sounds in a predetermined time period, and tone rhythm patterns, each representative of a series of sound generation times of the plurality of sounds, in association with each other, said storage section further storing therein categories of rhythms, determined on the basis of the sound generation time intervals represented by the tone rhythm patterns, in association with the tone rhythm patterns;

an acquisition section which, on the basis of operation input by a user, acquires an input rhythm pattern representative of a series of designated times corresponding to a pattern of the operation input by the user;

a determination section which, on the basis of intervals between the designated times represented by the input rhythm pattern, determines a category of rhythm the input rhythm pattern belongs to;

a calculation section which calculates a distance between the input rhythm pattern and each of the tone rhythm patterns; and a search section which calculates a degree of similarity between the input rhythm pattern and each of the tone rhythm patterns on the basis of the distance calculated by the calculation section and relationship between the category of rhythm the input rhythm pattern belongs to and a category of rhythm the tone rhythm pattern belongs to, and searches the tone data sets stored in said storage section for a tone data set associated with a tone rhythm pattern of which the calculated degree of similarity to the input rhythm pattern satisfies a predetermined condition.

12. A computer-implemented method for searching for a tone data set, comprising:

a step of storing in a storage device tone data sets, each representative of a plurality of sounds in a predetermined time period, and tone rhythm patterns, each representative of a series of sound generation times of the plurality of sounds, in association with each other, said step of storing further storing in the storage device categories of rhythms, determined on the basis of the sound generation time intervals represented by the tone rhythm patterns, in association with the tone rhythm patterns;

a step of, on the basis of operation input by a user, acquiring by an acquisition section an input rhythm pattern representative of a series of designated times corresponding to a pattern of the operation;

a step of, on the basis of intervals between the designated times represented by the input rhythm pattern, determining by a determination section a category of rhythm the input rhythm pattern belongs to;

a step of calculating by a calculation section a distance between the input rhythm pattern and each of the tone rhythm patterns; and a search step performed by a search section of calculating a degree of similarity between the input rhythm pattern and each of the tone rhythm patterns on the basis of the distance calculated by the step of calculating and relationship between the category of rhythm the input rhythm pattern belongs to and a category of rhythm the tone rhythm pattern belongs to, and searching the tone data sets stored in the storage device for a tone data set associated with a tone rhythm pattern of which the calculated degree of similarity to the input rhythm pattern satisfies a predetermined condition.

13. A non-transitory computer-readable storage medium storing therein a program executable by a computer for performing a method for searching for a tone data set, said method comprising:

a step of storing in a storage device tone data sets, each representative of a plurality of sounds in a predetermined time period, and tone rhythm patterns, each representative of a series of sound generation times of the plurality of sounds, in association with each other, said step of storing further storing in the storage device categories of rhythms, determined on the basis of the sound generation time intervals represented by the tone rhythm patterns, in association with the tone rhythm patterns;

a step of, on the basis of operation input by a user, acquiring an input rhythm pattern representative of a series of designated times corresponding to a pattern of the operation;

a step of, on the basis of intervals between the designated times represented by the input rhythm pattern, determining a category of rhythm the input rhythm pattern belongs to;

a step of calculating a distance between the input rhythm pattern and each of the tone rhythm patterns; and a search step of calculating a degree of similarity between the input rhythm pattern and each of the tone rhythm patterns on the basis of the distance calculated by the step of calculating and relationship between the category of rhythm the input rhythm pattern belongs to and a category of rhythm the tone rhythm pattern belongs to, and searching the tone data sets stored in the storage device for a tone data set associated with a tone rhythm pattern of which the calculated degree of similarity to the input rhythm pattern satisfies a predetermined condition.

* * * * *